US009529318B2

(12) United States Patent
Sato et al.

(10) Patent No.: US 9,529,318 B2
(45) Date of Patent: Dec. 27, 2016

(54) IMAGE FORMING APPARATUS WITH CARTRIDGE SUPPORTING MOVABLE MEMBER

(71) Applicant: CANON KABUSHIKI KAISHA, Tokyo (JP)

(72) Inventors: Masaki Sato, Kawasaki (JP); Isao Matsuoka, Kamakura (JP); Osamu Sasaoka, Yokohama (JP); Tetsuo Furukawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/454,870

(22) Filed: Aug. 8, 2014

(65) Prior Publication Data

US 2015/0055975 A1 Feb. 26, 2015

(30) Foreign Application Priority Data

Aug. 20, 2013 (JP) ..... 2013-170302

(51) Int. Cl.
*G03G 15/00* (2006.01)
*G03G 21/18* (2006.01)
(Continued)

(52) U.S. Cl.
CPC ..... *G03G 21/1661* (2013.01); *G03G 15/0178* (2013.01); *G03G 21/1623* (2013.01);
(Continued)

(58) Field of Classification Search
CPC ..... G03G 21/1661; G03G 21/1807; G03G 15/0178; G03G 21/1853; G03G 21/1623; G03G 21/1633; G03G 2221/1684
(Continued)

(56) References Cited

U.S. PATENT DOCUMENTS 5,802,433 A 9/1998 Sato et al.
7,567,769 B2 7/2009 Noguchi et al.
(Continued)

FOREIGN PATENT DOCUMENTS

JP 2008-165027 A 7/2008

OTHER PUBLICATIONS

Atsushi Murakami et al., U.S. Appl. No. 14/462,761, filed Aug. 19, 2014.

*Primary Examiner* — Susan Lee
(74) *Attorney, Agent, or Firm* — Fitzpatrick, Cella, Harper & Scinto

(57) ABSTRACT

An image forming apparatus includes an opening, an openable member, and a movable member for supporting cartridges in a state in which the cartridges are arranged in an arranging direction, movable in the arranging direction while passing through the opening between an inside position and an outside position in a direction crossing the arranging direction and a longitudinal direction. When the movable member is positioned at the inside position, adjacent two cartridges of the cartridges are in an overlapping state as seen in a direction perpendicular to the arranging direction and the longitudinal direction. When the movable member is moved from the inside position to the outside position and then one of the adjacent two cartridges is dismounted from the movable member, the one of the adjacent two cartridges is moved relative to the movable member so as to be prevented from interfering with the other cartridge.

39 Claims, 79 Drawing Sheets

(51) Int. Cl.
*G03G 21/16* (2006.01)
*G03G 15/01* (2006.01)

(52) U.S. Cl.
CPC ..... *G03G 21/1807* (2013.01); *G03G 21/1853* (2013.01); *G03G 21/1633* (2013.01); *G03G 2221/1684* (2013.01)

(58) Field of Classification Search
USPC ..... 399/299, 107
See application file for complete search history.

(56) References Cited

U.S. PATENT DOCUMENTS

| | | | |
|---|---|---|---|
| 8,862,022 | B2 | 10/2014 | Sato et al. |
| 2010/0080618 | A1 | 4/2010 | Suzuki |
| 2011/0262181 | A1* | 10/2011 | Noguchi |
| 2012/0195627 | A1 | 8/2012 | Kikuchi |
| 2012/0328331 | A1 | 12/2012 | Sato |
| 2013/0022367 | A1* | 1/2013 | Choi et al. |
| 2013/0315618 | A1* | 11/2013 | Koishi et al. |
| 2014/0064782 | A1 | 3/2014 | Furukawa et al. |
| 2014/0161483 | A1 | 6/2014 | Fukui et al. |
| 2014/0376959 | A1* | 12/2014 | Hashimoto |
| 2015/0043937 | A1* | 2/2015 | Choi et al. |
| 2015/0185683 | A1* | 7/2015 | Mori et al. |

* cited by examiner

IMAGE FORMING APPARATUS WITH CARTRIDGE SUPPORTING MOVABLE MEMBER

FIELD OF THE INVENTION AND RELATED ART

The present invention relates to an image forming apparatus, in which a plurality of cartridges are detachably mounted in a main assembly thereof, for forming a color image on a recording material (medium).

Here, the image forming apparatus is an apparatus for forming the image on the recording material by using known various image forming principles and types (processes) such as an electrophotographic process, an electrostatic recording process and a magnetic recording process. The image forming apparatus includes, e.g., a copying machine, a printer (a laser (beam) printer, an LED printer, or the like), a facsimile machine, an image display apparatus (electronic blackboard or electronic white board) and the like. On the recording material, the image is formed by the image forming apparatus, and the recording material may include, e.g., a sheet, an OHT sheet, an intermediary transfer member, an image displaying material, and the like.

The cartridge is prepared by integrally assembling, into a cartridge (unit), a part or all of an image forming portion including an image bearing member for forming an image and an image forming process means actable on the image bearing member. Further, the cartridge is detachably mounted in an apparatus main assembly of the image forming apparatus, and contributes to an image forming process for forming the image on the recording material. The apparatus main assembly is an image forming apparatus constituent portion excluding the cartridge in the image forming apparatus of the cartridge type.

As the image bearing member, it is possible to use an electrophotographic photosensitive member in the electrophotographic process, an electrostatic recording dielectric member in the electrostatic recording process, a magnetic recording magnetic material in the magnetic recording process, and members capable of forming the image by other various image forming principles and types. The image forming process means is a device for forming the image by acting on the image bearing member.

In the following, for convenience, an electrophotographic image forming apparatus of the cartridge type will be described as an example. As the cartridge, e.g., a process cartridge or a developing cartridge may be cited.

The process cartridge is prepared by integrally assembling, into a cartridge, an electrophotographic photosensitive member and, as an electrophotographic process means actable on the member, at least one of a charging means, a developing means and a cleaning means, and is detachably mountable to the apparatus main assembly of the electrophotographic image forming apparatus.

Accordingly, the process cartridge includes a cartridge which is prepared by integrally assembling the electrophotographic photosensitive member and the developing means as the process means into a cartridge, which is detachably mountable to the apparatus main assembly. Further, the process cartridge includes a cartridge which is prepared by integrally assembling, into a cartridge, the electrophotographic photosensitive member and, as the process means, the charging means, the developing means or the cleaning means, and is detachably mountable to the apparatus main assembly.

The process cartridge integrally including the electrophotographic photosensitive member and the developing means is referred to as a so-called integral type process cartridge. Further, the process cartridge integrally including the electrophotographic photosensitive member and the process means other than the developing means is referred to as a so-called (function) separation type process cartridge. That is, the developing means is provided in a developing unit other than the process cartridge, and the process cartridge for forming the image by being paired with the developing unit is referred to as the so-called separation type process cartridge.

According to this process cartridge type, maintenance of the image forming apparatus was able to be performed by a user himself (herself) without relying on a service person, and therefore operativity was able to be remarkably improved.

Further, the developing cartridge includes a developer carrying member (hereinafter referred to as a developing roller) for supplying the developer to the electrophotographic photosensitive member. Further, the developing cartridge accommodates a powdery developer (toner) used for developing an electrostatic latent image, formed on the electrophotographic member, by the developing roller, and is detachably mountable to the apparatus main assembly.

In the case of the developing cartridge, the electrophotographic member is mounted in the apparatus main assembly or a cartridge supporting member. Alternatively, the electrophotographic photosensitive member is provided in the so-called separation type process cartridge described above. In this case, the process cartridge does not include the developing means. Also the developing cartridge can be mounted in and dismounted from the apparatus main assembly by the user himself (herself). For that reason, the maintenance of the apparatus main assembly can be easily performed.

Therefore, the cartridge includes the above-described so-called integral type process cartridge or the above-described so-called separation type process cartridge. Further, the cartridge includes the case where the so-called separation type process cartridge and the developing cartridge are used in a pair. Further, the cartridge includes the case where the electrophotographic photosensitive member is fixedly mounted in the apparatus main assembly or on the cartridge supporting member and the developing cartridge is used so as to be actable on and detachably mountable to the electrophotographic photosensitive member. Further, the cartridge includes a unit, detachably mounted in the apparatus main assembly, which contributes to the image forming process for forming the image on the recording material.

Mounting and dismounting of the process cartridge relative to the image forming apparatus will be described. In an electrophotographic image forming apparatus in which a plurality of process cartridges are arranged in a substantially horizontal direction and are detachably mountable to the apparatus main assembly, in order to facilitate mounting and dismounting of the process cartridges, a constitution in which the plurality of the process cartridges are pulled out as a unit and then are detachably mountable in a vertical direction has been proposed (Japanese Laid-Open Patent Application (JP-A) 2008-165027 corresponding to U.S. Pat. No. 7,567,769).

In the image forming apparatus having the pulling-out constitution such that the plurality of process cartridges are pulled out as the unit and are then detachably mountable, when a pitch between adjacent drums is narrowed in order to shorten FPOT (first print-out time), parts (components) of adjacent process cartridges are disposed in an overlapping manner in some cases. In such cases, it can be difficult to ensure a mounting locus along which an intended process cartridge is detachably mountable in the vertical direction.

Here, the FPOT is a time until a first recording material on which the image is formed is discharged. The drum is a photosensitive drum.

SUMMARY OF THE INVENTION

A principal object of the present invention is to realize a state in which even under a condition such that adjacent two cartridges partly overlap with each other at an image formable position inside an apparatus main assembly of an image forming apparatus, a movable member for supporting the cartridges is moved to make the cartridges detachably mountable to the movable member at a position outside the apparatus main assembly. As a result, there is provided an image forming apparatus capable of improving usability and also capable of not only shortening FPOT but also downsizing the apparatus main assembly.

According to an aspect of the present invention, there is provided an image forming apparatus capable of forming a color image on a recording material, comprising: an opening provided in a main assembly of the image forming apparatus; an openable member for opening and closing the opening; and a movable member, supporting a plurality of cartridges in a state in which the cartridges are arranged in an arranging direction, movable in the arranging direction while passing through the opening between an inside position where the cartridges are positioned inside the main assembly and an outside position where the cartridges are detachably mountable, in a direction crossing the arranging direction and a longitudinal direction of each of the cartridges, at a position outside the main assembly, wherein when the movable member is positioned at the inside position, adjacent two cartridges of the cartridges are in an overlapping state as seen in a direction perpendicular to the arranging direction and the longitudinal direction, and wherein when the movable member is moved from the inside position to the outside position and then one of the adjacent two cartridges is dismounted from the movable member, the one of the adjacent two cartridges is moved relative to the movable member so as to be prevented from interfering with the other cartridge.

According to another aspect of the present invention, there is provided an image forming apparatus capable of forming a color image on a recording material, comprising: an opening provided in a main assembly of the image forming apparatus; an openable member for opening and closing the opening; and a movable member, supporting a plurality of cartridges in a state in which the cartridges are arranged in an arranging direction, movable in the arranging direction while passing through the opening between an inside position where the cartridges are positioned inside the main assembly and an outside position where the cartridges are detachably mountable, in a direction crossing the arranging direction and a longitudinal direction of each of the cartridges, at a position outside the main assembly, wherein when the movable member is moved from the inside position to the outside position so as to increase an interval between at least one pair of adjacent cartridges with respect to the arrow direction, and then one of the adjacent cartridges is dismounted from the movable member, the one of the adjacent cartridges is prevented from interfering with the other cartridge.

These and other objects, features and advantages of the present invention will become more apparent upon a consideration of the following description of the preferred embodiments of the present invention taken in conjunction with the accompanying drawings.

DESCRIPTION OF THE EMBODIMENTS

<Embodiment 1>

Embodiment 1 of the present invention will be described with reference to FIGS. 1-12. Description will be made in the order of a general structure of an image forming apparatus, a mounting and dismounting method of a process cartridge, a structure of the process cartridge and a structure of a cartridge tray.

In this embodiment, as the image forming apparatus, an electrophotographic laser beam printer capable of forming a color image on a recording material is illustrated. Further, as the image forming apparatus, an image forming apparatus in which respective color toner images on photosensitive drums are successively transferred onto a belt (intermediary recording medium) and then are collectively transferred from the belt onto a recording material as a final recording medium is illustrated.

In this embodiment, a position where an image is formed on the photosensitive drum in contact with an intermediary transfer belt is defined as an "image forming position". Further, a position where the photosensitive drum is spaced from the intermediary transfer belt and is movable toward an outside of the image forming apparatus is defined as an "inside position". Further, a position where a cartridge tray is pulled out and then a process cartridge is detachably mountable is defined as an "outside position".

(General Structure of Image Forming Apparatus)

Figure 1:
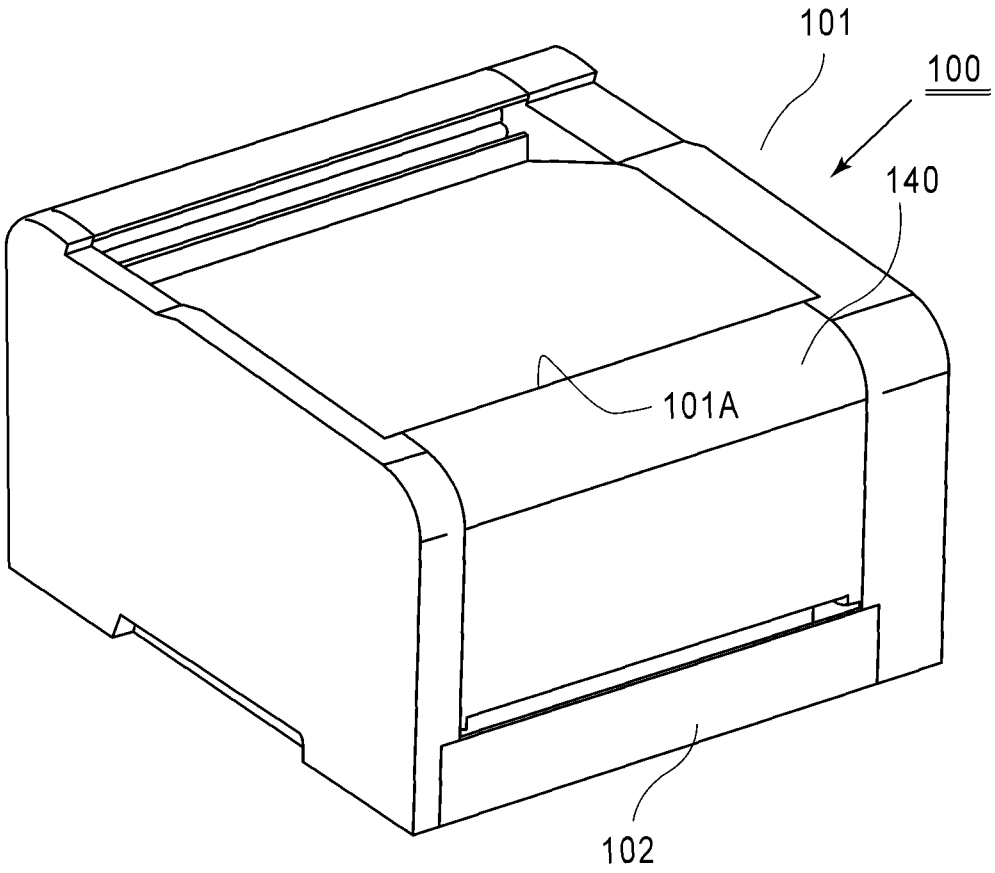
FIG. 1 is a perspective view of an outer appearance of an image forming apparatus in Embodiment 1.
Figure 2:
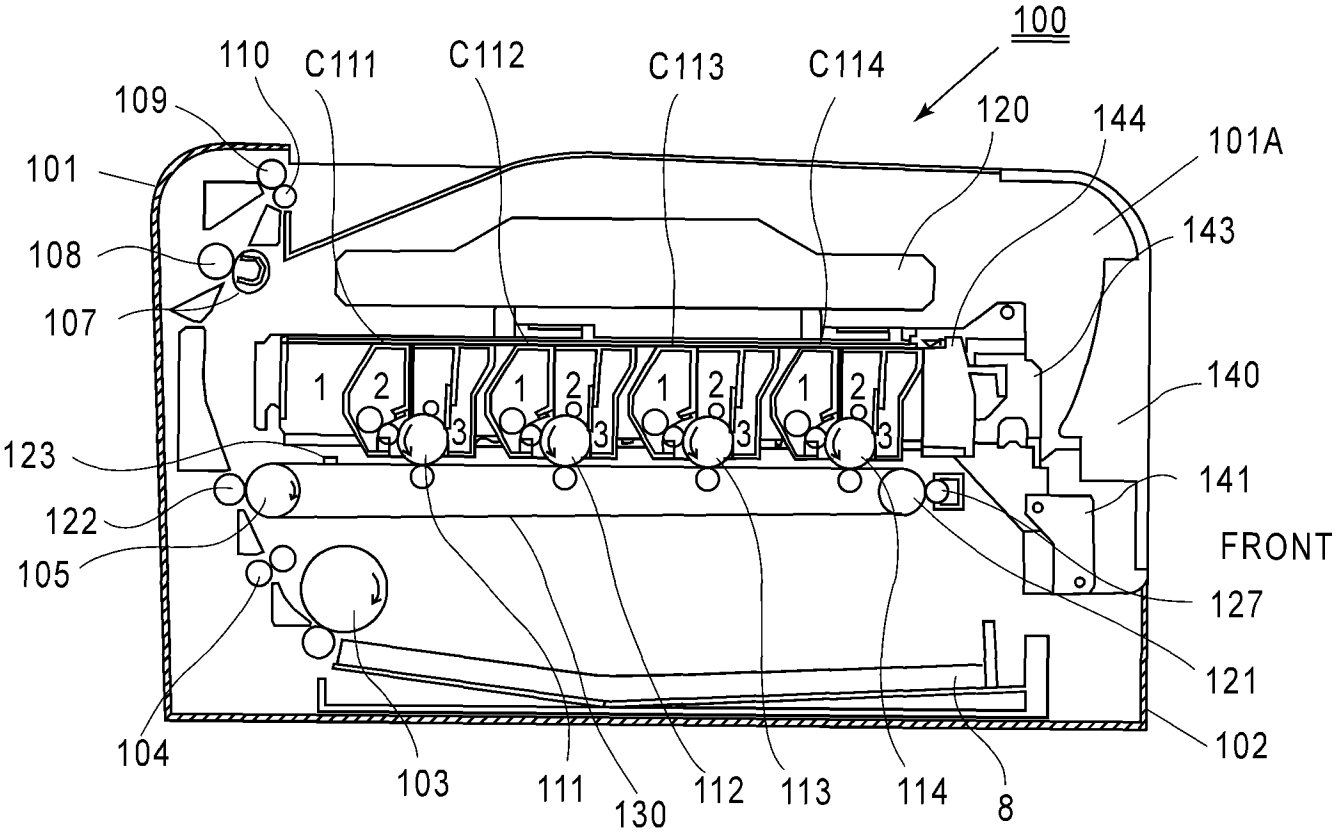
FIG. 2 is a longitudinal schematic side view of the image forming apparatus in a state in which a door is closed.

With reference to FIGS. 1 and 2, an outline of a general structure of an image forming apparatus 100 in this embodiment will be described. FIG. 1 is a perspective view of an outer appearance of the image forming apparatus 100. FIG. 2 is a longitudinal schematic side view of the image forming apparatus 100 in a state in which each of photosensitive drums is located at the image forming position where the photosensitive drum contacts the intermediary transfer belt.

In FIG. 2, a recording material 8 stacked and accommodated in a feeding tray 102 is fed by a feeding roller 103 rotating in the clockwise direction in the figure, and is sent to a conveying roller 104 and then is sent to a nip between an inner belt roller 105 and a transfer roller 122.

As image bearing members constituting a plurality of image forming portions, i.e., four image forming portions in this embodiment, photosensitive drums 111, 112, 113 and 114 rotate in the counterclockwise direction in FIG. 2. At each of the image forming portions, on an outer peripheral surface of an associated photosensitive drum, an electrostatic latent image is successively formed by laser light from a laser scanner 120 and then is developed by a developing roller 1, so that a toner image is formed. The toner image formed on each of the photosensitive drums 111-114 is transferred onto an intermediary transfer belt 130.

The intermediary transfer belt 130 is extended and stretched between the inner belt roller 105 and a tension roller 121, and is circulated and driven by the inner belt roller 105 in the same direction as a rotational direction of the photosensitive drums at the substantially same peripheral speed as a rotational speed of the photosensitive drums.

In the case where a color image is formed, toner images of colors of yellow, magenta, cyan and black are formed and developed on the photosensitive drums 111-114, respectively, and then are successively transferred onto the intermediary transfer belt 130. Then, the toner images transferred (formed) on the intermediary transfer belt 130 are collectively transferred into the recording material 8 sent to the nip between the inner belt roller 105 and the transfer roller 122.

Further, the recording material 8 on which the toner images are transferred is sent to a nip between a fixing film 107 and a pressing roller 108, and is heated and pressed at the nip, so that the toner images are fixed on the recording material 8. The recording material 8 on which the toner images are fixed is discharged to an outside of the image forming apparatus by discharging rollers 109 and 110. A cleaning portion 127 for the intermediary transfer belt 130 is provided.

Here, at the image forming portions, the photosensitive drums 111, 112, 113 and 114 are assembled with process means actable thereon into units to constitute process cartridges C111, C112, C113 and C114, respectively. The process cartridges C111, C112, C113 and C114 are provided detachably mountable to an apparatus main assembly 101 of the image forming apparatus 100.

The process cartridge is prepared by integrally assembling, into a cartridge or a unit, the photosensitive drum as the image bearing member and at least one of a charging means, a developing means, a cleaning means and the like as a process means actable on the photosensitive drum. Further, this cartridge is detachably mountable to the apparatus main assembly 101 of the image forming apparatus 100. In this embodiment, the photosensitive drum and, as the process means actable on the photosensitive drum, a developing roller 1 as the developing means, a charging roller 2 as the charging means, and a blade 3 as the cleaning means are integrally assembled into the cartridge.

(Mounting and Dismounting Method of Contact)

Figure 3:
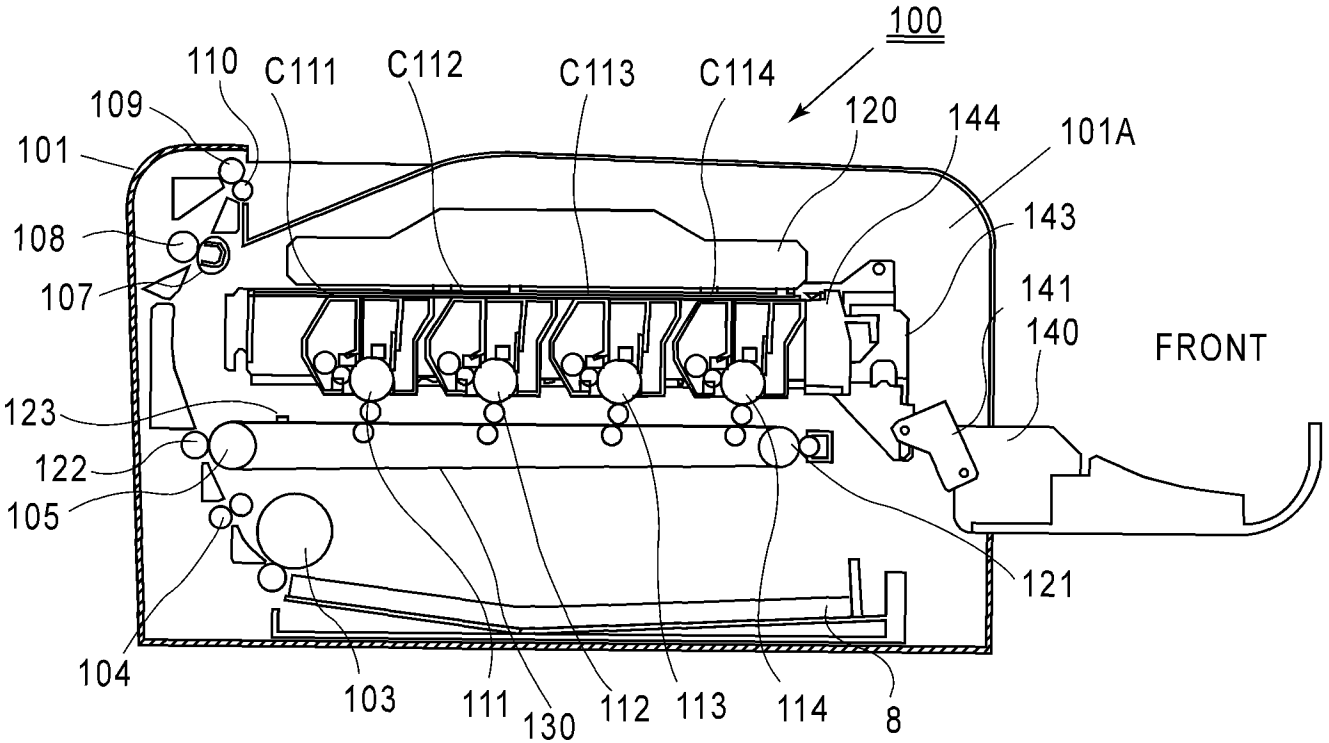
FIG. 3 is a longitudinal schematic side view of the image forming apparatus in a state in which the door is open.
Figure 4:
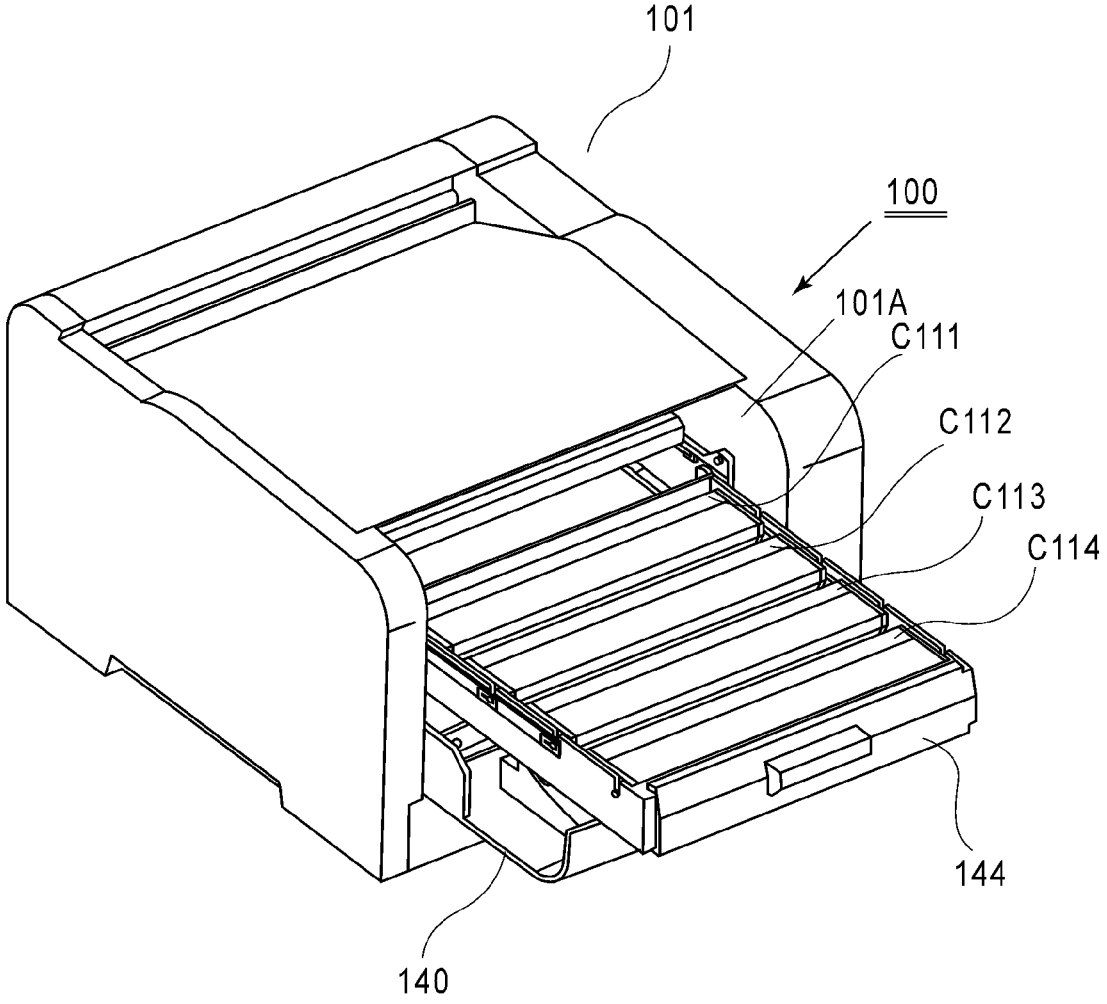
FIG. 4 is a perspective view of an outer appearance of the image forming apparatus in a state in which a cartridge tray is pulled out.

An outline of a mounting and dismounting method of the process cartridge will be described with reference to FIGS. 3 and 4. FIG. 3 is a longitudinal schematic side view of the image forming apparatus 100 in a state in which a cartridge cover (openable member) 140 is open. FIG. 4 is a perspective view of an outer appearance of the image forming apparatus in a state in which a cartridge tray 144 as a movable member is pulled out from an inside of the apparatus main assembly 101 to an outside of the apparatus main assembly 101 through an opening 101A which is exposed (opened).

Here, with respect to the image forming apparatus, a type of exchange (replacement) of the process cartridge is such that in order to improve usability, the cartridge is placed on the tray 144 of a pulling-out type and then is exchanged in a front access manner.

That is, the apparatus main assembly 101 is provided with the opening 101A in a front (surface) side. The opening 101A permits passing of the cartridge therethrough in order to insert the cartridge into the inside of the apparatus main assembly 101 and in order to dismount the cartridge to the outside of the apparatus main assembly 101. Further, the cartridge door 140 as the openable member for closing and opening the opening 101A is provided openably relative to the apparatus main assembly 101. In this embodiment, the cartridge door 140 is openable, closable and rotatable, relative to the apparatus main assembly 101, about a horizontal shaft 141 provided in a lower side thereof.

Further, as shown in FIG. 4, the process cartridges C111, C112, C113 and C114 are roughly held by and detachably mountable to the cartridge tray 144 to be inserted into and pulled out from the apparatus main assembly 101. This cartridge tray 144 is horizontally held slidably and movably in a front-rear direction by a pair of tray holding members 143 provided on left and right frames, of the apparatus main assembly, constituting an apparatus main assembly frame. Here, a front direction is a direction in which the tray 144 is pulled out from the apparatus main assembly, and a rear direction is a direction in which the tray 144 is inserted into the apparatus main assembly.

The tray 144 is movable, in a state in which the tray 144 supports the above-described plurality of the process cartridges C111, C112, C113 and C114, between the inside and the outside of the apparatus main assembly 101 with respect to a movement direction crossing a longitudinal direction of the photosensitive drum of each of the process cartridges.

Further, the cartridge tray 144 is provided with intermediary electrical contacts (not shown) electrically connectable with electrical contacts (not shown) of the process cartridges. The intermediary electrical contacts are electrically connectable with main assembly(-side) electrical contacts provided in the apparatus main assembly 101.

The tray holding members 143 are moved by predetermined amounts in the front direction and an upward direction in interrelation with an opening rotation of the cartridge door 140. By this positional movement of the tray holding members 143, also the cartridge tray 144 is moved upwardly, so that the photosensitive drums 111-114 are floated (spaced) from the intermediary transfer belt 130, so that the cartridge tray 144 is placed in a pullable-out state from the apparatus main assembly.

Figure 10:
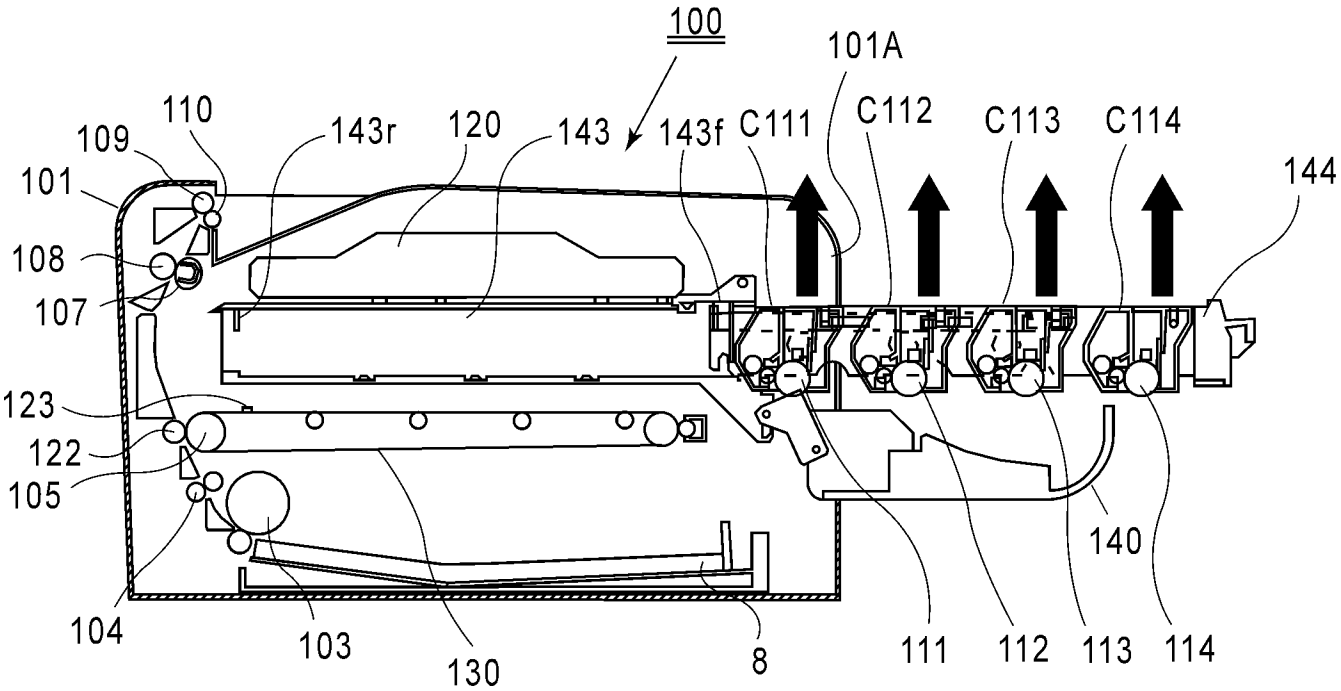
FIG. 10 is a longitudinal schematic side view of the image forming apparatus in a state in which the cartridge tray is pulled out.

As shown in FIGS. 4 and 10, when the cartridge tray 144 is pulled out from the inside to the outside of the apparatus main assembly 101, an upper surface of each of the process cartridges is exposed (opened). Further, in interrelation with the pulling-out operation of the cartridge tray 144, a pitch between adjacent two photosensitive drums of the respective process cartridges is increased. As a result, a mounting locus along which the process cartridges do not interfere with each other can be ensured, so that each of the process cartridges C111, C112, C113 and C114 is dismountable in an arrow direction.

A method of changing the pitch between the photosensitive drums will be described later specifically. Further, when the process cartridges C111, C112, C113 and C114 are mounted in the apparatus main assembly 101, a reverse procedure is performed.

(Structure of Process Cartridge)

Figure 5:
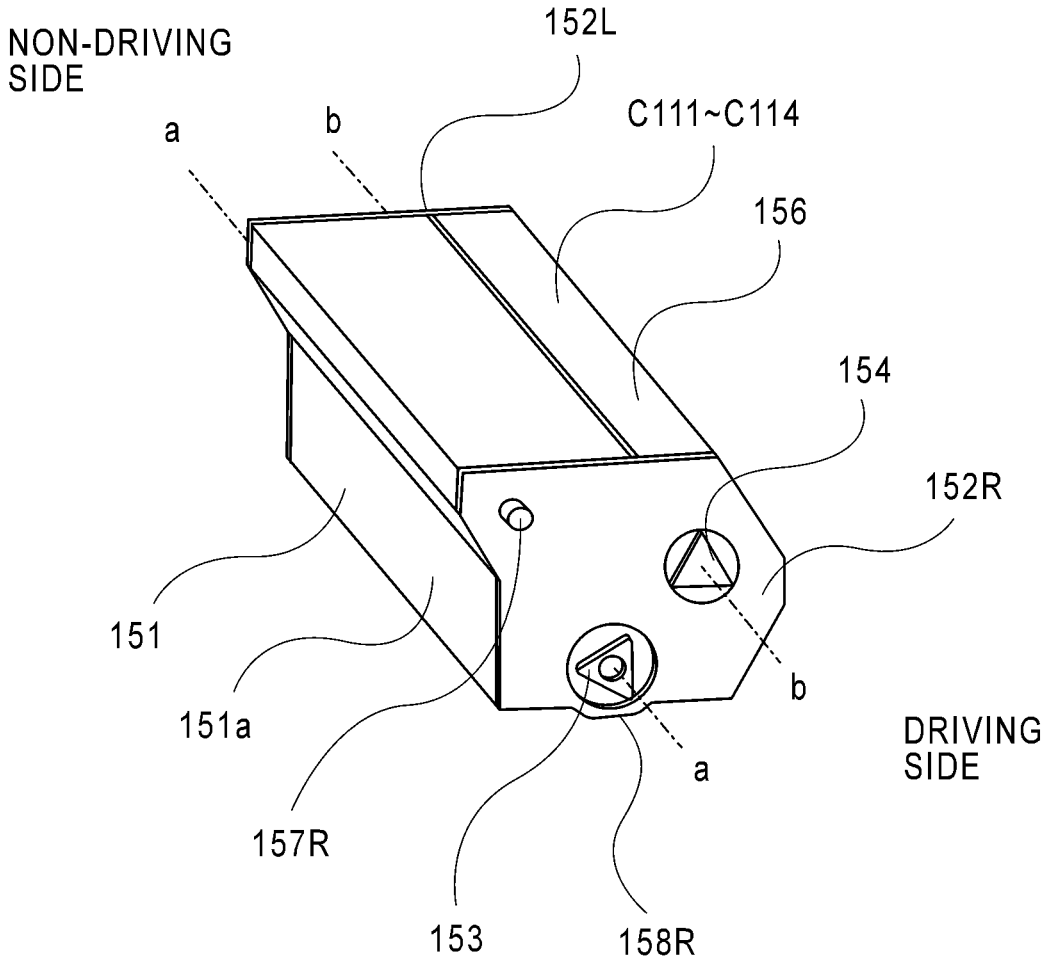
FIG. 5 is a perspective view of an outer appearance of a cartridge as seen from a driving side.
Figure 6:
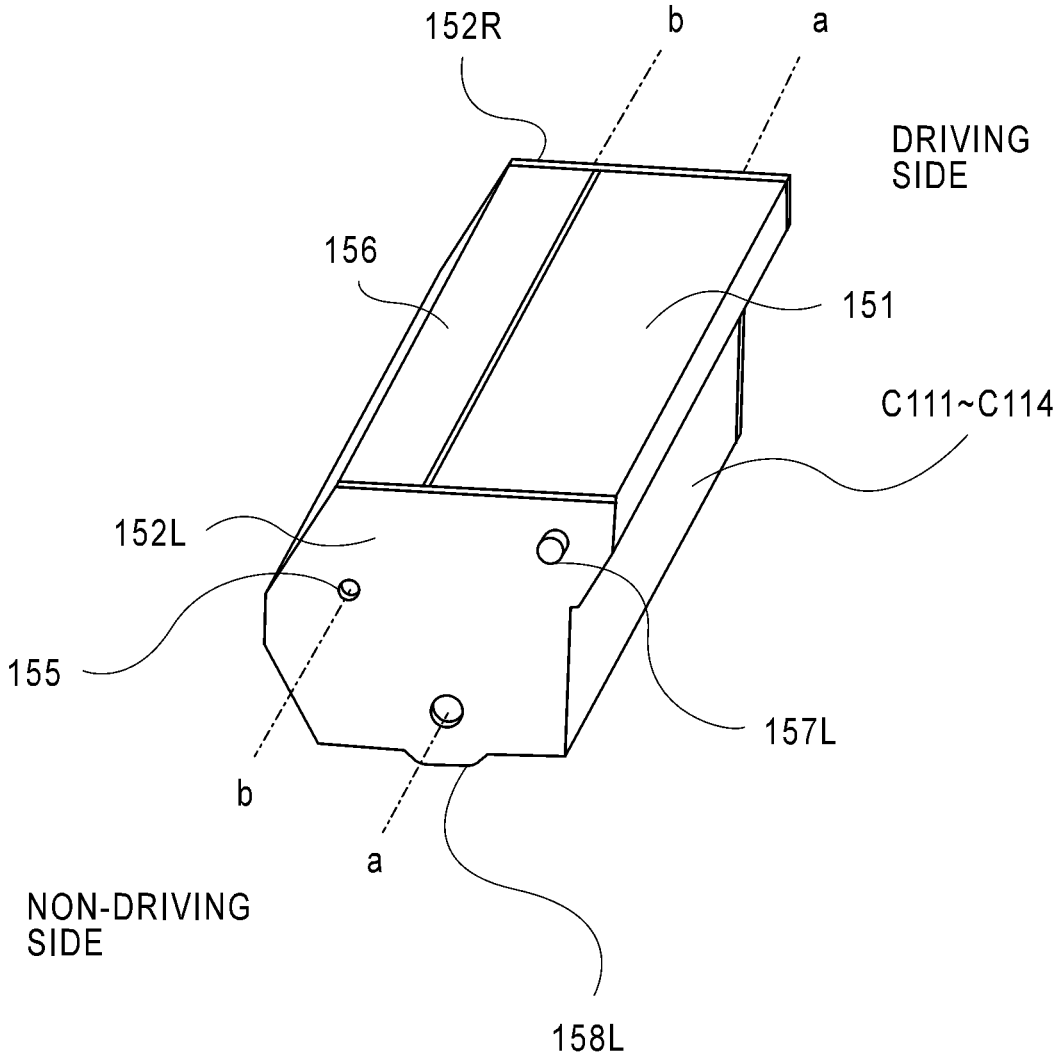
FIG. 6 is a perspective view of an outer appearance of the cartridge as seen from a non-driving side.

In this embodiment, the first to fourth process cartridges C111-C114 have the same structure. The structure of each process cartridge will be described with reference to FIGS. 5 and 6. FIGS. 5 and 6 are perspective views of the process cartridge C (C111-C114) as seen from a driving side and a non-driving side, respectively.

The process cartridge C is an elongated assembly having, as a longitudinal direction, a left-right direction which is an axial direction a-a of the photosensitive drum. Further, the process cartridge C includes a drum unit (first frame) 151, a developing unit (second frame) 156, a left side plate (non-driving side plate) 152L and a right side plate (driving side plate) 152R.

In this embodiment, the pitch between the photosensitive drums is decreased (narrowed) while ensuring a space of parts necessary to the process cartridge and a volume of the developer. For that reason, the drum unit 151 of one of adjacent cartridges and the developing unit 156 of the other cartridge are disposed so as to overlap with each other with respect to an up-down direction relative to the apparatus main assembly 101.

The left side plate 152 and the right side plate 152R are fixedly mounted from the outside of a container 151*a* of the drum unit 151 on a left side surface and a right side surface, respectively, of the container 151*a*. Each of the left and right side plates 152L and 152R includes an extended portion extended rearward from the container 151*a*. Further, the developing unit 156 is provided between the left and right extended portions. The developing unit 156 is swingably supported by these extended portions so as to rotate about an axis b-b parallel to the drum axis a-a.

That is, the developing unit 156 is rotatably connected with the drum unit 151. The rotation center b-b of the developing unit 156 is aligned with a center of a developing roller driving coupling (second drive input portion, developing roller driving force receiving portion) 154 in the right side plate 152R side as the driving side. Further, in the left side plate 152L side as the non-driving side, the rotation center b-b is aligned with a center of a supporting shaft 155. A position of the supporting shaft 155 is substantially aligned with the center of the coupling 154 with respect to cross-sectional coordinates. That is, a center axis of the coupling 154 and a center axis of the supporting shaft 155 are substantially aligned with each other.

At a side surface portion of the process cartridge C in the driving side, a drum driving coupling (first drive input portion, drum driving force receiving portion) 153, the developing roller driving coupling 154, a driving side rotation preventing portion 157R and a driving side portion-to-be-supported (first portion-to-be-positioned) 158R are provided. A center of the drum coupling 153 is aligned with a drum axis. At a side surface portion of the process cartridge C in the non-driving side, a non-driving side rotation preventing portion 157L and a non-driving side portion-to-be-supported (second portion-to-be-positioned) 158L are provided.

The driving side rotation preventing portion 157R and the non-driving side rotation preventing portion 157L are, as described later, engaged with engaging portions (144*h* and 144*i*) provided in the cartridge tray 144 side when the process cartridge C is inserted into the cartridge tray 144. Further, in interrelation with a pulling-out operation of the cartridge tray 144, the rotation preventing portions 157R and 147L are translated in a cartridge tray pulling-out direction along the engaging portions in the cartridge tray 144.

Further, the rotation preventing portions 157R and 157L act as means for preventing rotation of the process cartridge C when the process cartridge is positioned relative to the apparatus main assembly 101. That is, the rotation preventing portions 157R and 157L prevent the process cartridge C from rotating when the process cartridge C receives the rotational driving force from the apparatus main assembly 101.

The first portion-to-be-positioned 158R provided in the driving side is an arcuate downward projection and is provided on a lower edge of the right side plate 152R so as to be coaxial with the drum. The second portion-to-be-positioned 158L provided in the non-driving side is also an arcuate downward projection and is provided on a lower edge of the left side plate 152L so as to be coaxial with the drum.

These portions-to-be-positioned (supported) 158R and 158L are engaged with main assembly-side positioning portions (not shown) provided in the apparatus main assembly 101 in a state in which the process cartridge C is accommodated in an accommodating portion of the apparatus main assembly 101, and effect positioning of the process cartridge C in the accommodating portion. The portions-to-be-positioned 158R and 158L are positioned by the main assembly-side positioning portions (not shown) in midstream of a descent of the cartridge tray (movable member) 144 when the cartridge tray 144 descends toward the intermediary transfer belt 130.

(Structure of Cartridge Tray)

Figure 7:
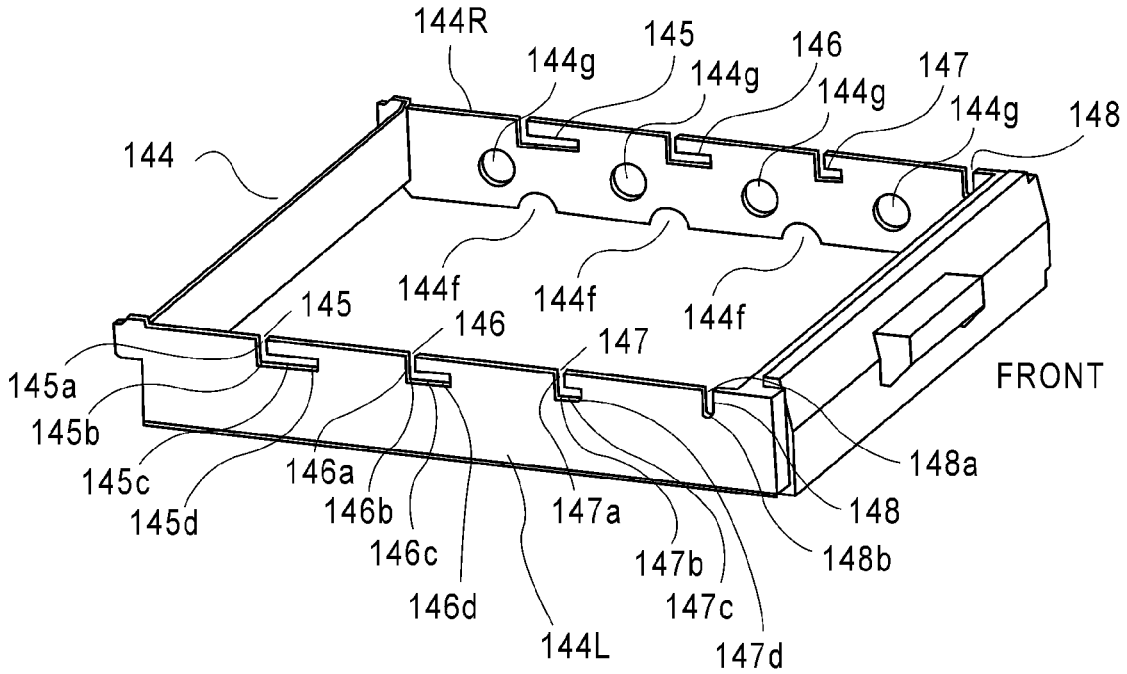
FIG. 7 is a perspective view of an outer appearance of the cartridge tray.
Figure 8:
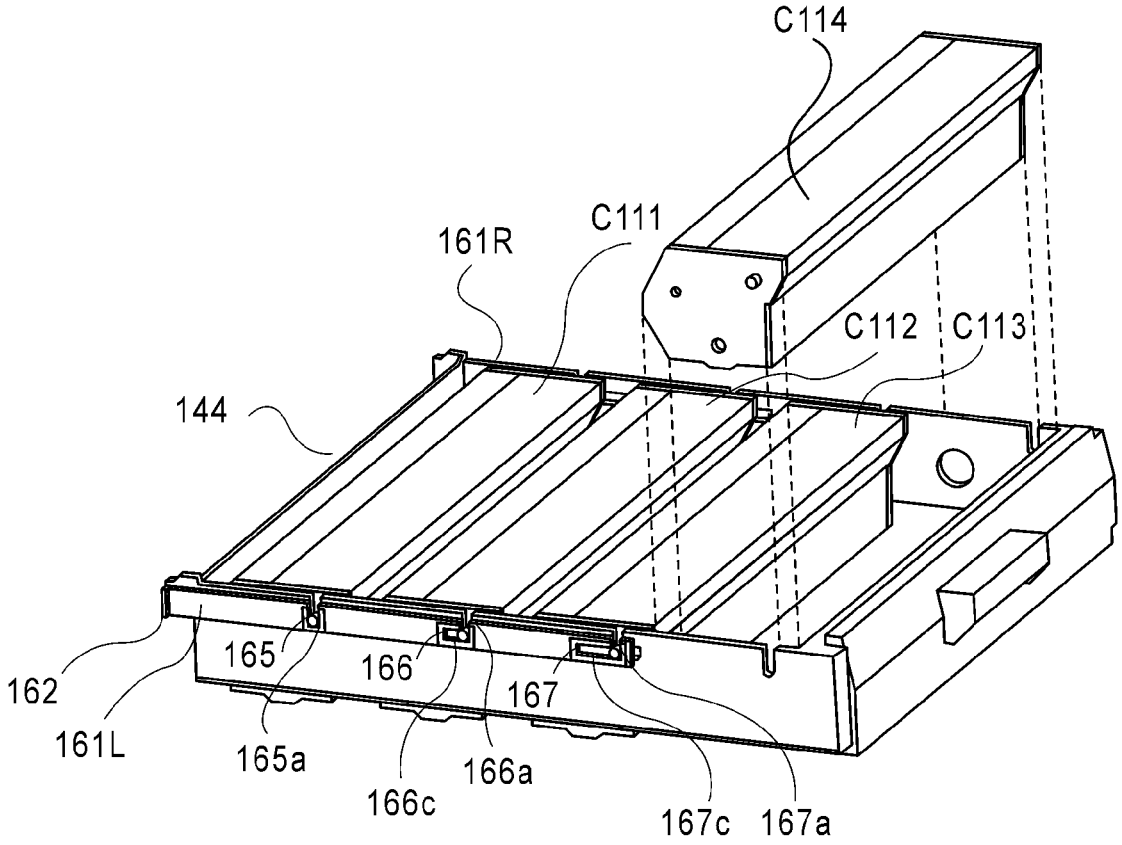
FIG. 8 is a perspective view of an outer appearance of the cartridge tray at an outside position.
Figure 9:
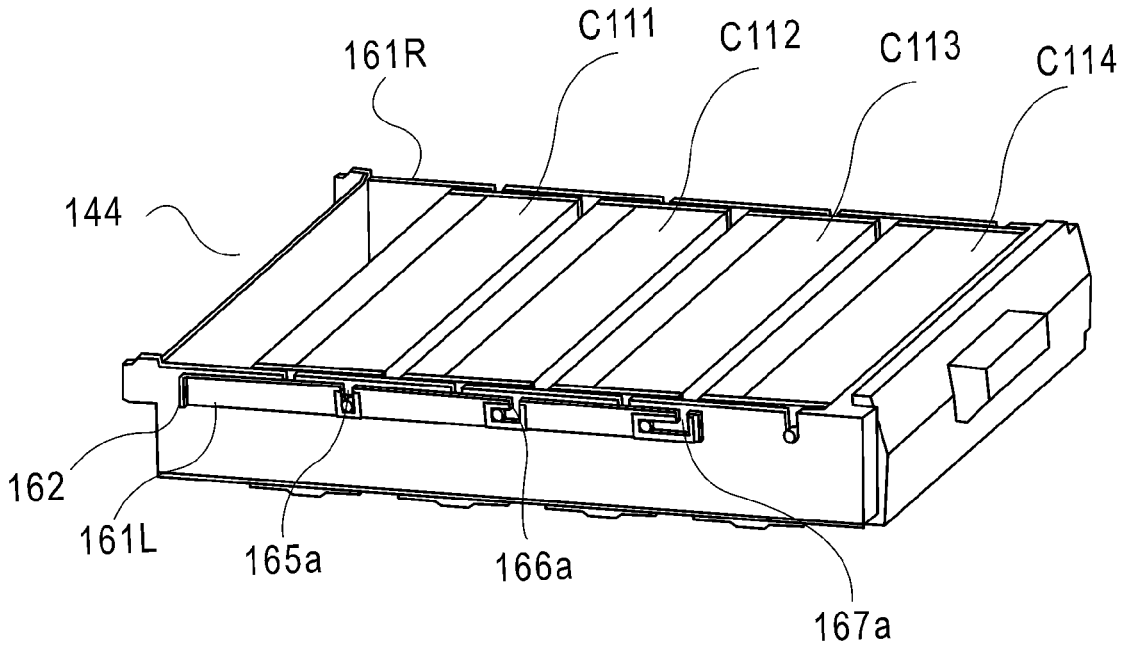
FIG. 9 is a perspective view of an outer appearance of the cartridge tray at an image forming position.

A structure of the cartridge tray 144 will be described with reference to FIGS. 7 to 10. FIG. 7 is a perspective view of an outer appearance of the cartridge tray 144. FIG. 8 is a perspective view of an outer appearance of the cartridge tray 144 at an outside position after pulling-out of the cartridge tray 144. FIG. 9 is a perspective view of an outer appearance of the cartridge tray 144 at an image forming position. FIG. 10 is a schematic sectional view of the image forming apparatus at the outside position after the cartridge tray 144 is pulled out.

The cartridge tray 144 roughly supports the process cartridges C111, C112, C113 and C114. A right frame portion 144R (driving side) is provided with holes 144*f* and 144*g* through which first and second drive output portions provided in the apparatus main assembly 101 side go in and out of the cartridge tray 144. Further, the right frame portion 144R is provided with engaging portions 145, 146, 147 and 148 with which the driving side rotation preventing portions 157R of the cartridges C are to be engaged. Further, a left frame 144L (non-driving side) is provided with engaging portions 145, 146, 147 and 148 with which the non-driving side rotation preventing portions 157L of the cartridges are to be engaged.

The engaging portions 145-148 will be described specifically. The engaging portions 145-148 are different in shape for the respective stations (image forming portions). The engaging portion 148 associated with the process cartridge C114 is provided with an I-shaped groove including a cut-away portion 148*a* and a lower supporting portion 148*b* with respect to a cartridge mounting and dismounting direction. Further, the engaging portions 145-147 associated with the cartridges C111-C113, respectively, are provided with L-shaped grooves including cut-away portions 145*a*-147*a*, respectively, with respect to the cartridge mounting and dismounting direction and guiding portions 145*c*-147*c*, respectively, with respect to the pulling-out direction.

The guiding portions 145*c*-147*c* extending in the pulling-out direction are different in length for the respective stations. Further, supporting portions (recessed portions) 145*b*-147*b* are provided at corners of the associated L-shaped grooves.

The above-described four cut-away portions are disposed at positions so that adjacent process cartridges do not overlap with each other with respect to the up-down direction as the mounting and dismounting direction. The shapes of the engaging portions 145-148 are the same between the driving side and the non-driving side.

Each of the process cartridges C111, C112, C113 and C114 is inserted into the cartridge tray from above in a drop-in manner. When the process cartridge C is gradually inserted, each of the driving side rotation preventing portion 157R and the non-driving side rotation preventing portion 157L is gradually engaged with an associated one of the engaging portions 145-148 provided in the cartridge tray 144 side (FIG. 8).

Further, when the process cartridge C is moved downward so as to be accommodated in the cartridge tray 144, the rotation preventing portions 157R and 157L abut against the supporting portions 144*b*-147*b* of the engaging portions, thus being positioned. In this way, the cartridge tray 144 positions and supports the cartridge C at a position where an adjacent process cartridge does not overlap with the cartridge C with respect to the up-down direction. As a result, as shown in FIGS. 4 and 10, the cartridge tray 144 supports the respective process cartridges C so as to be dismountable right above.

When the cartridge tray 144 is moved to the accommodating portion of the apparatus main assembly 101, the rotation preventing portions 157R and 157L of each of the cartridges are moved by guiding rails 161R and 161L, respectively, provided in the cartridge tray 144. That is, in interrelation with movement of the cartridge tray 144, the rotation preventing portions 157R and 157L of each cartridge C are pushed by the guiding rails 161R and 161L to move along the associated guiding portion.

With reference to FIG. 8, the guiding rail 161 will be described specifically, the guiding rail 161 is slidably held by the cartridge tray 144. Further, the frame 161 is provided with guiding rail engaging portions 165-167 each with which the associated rotation preventing portion 157 is engaged. The guiding rail engaging portions 165-167 are different in shape for the respective stations.

The guiding rail engaging portion 165 associated with the process cartridge C111 is provided with an I-shaped groove including a cut-away portion 165*a* with respect to the cartridge mounting and dismounting direction. Further, the guiding rail engaging portions 166 and 167 associated with the cartridges C112 and C113, respectively, are provided with L-shaped grooves including cut-away portions 166*a* and 167*a*, respectively, with respect to the cartridge mounting and dismounting direction and guiding portions 166*c* and 167*c*, respectively, with respect to the pulling-out direction.

The guiding portions 166*c* and 167*c* extending in the pulling-out direction are different in length for the respective stations.

The above-described three cut-away portions are disposed at positions so that adjacent process cartridges do not overlap with each other with respect to the up-down direction as the mounting and dismounting direction. Further, each of the guiding rails 161 is provided with an abutting portion 162 to be abutted against projections 143*f* and 143*r* (FIGS. 10 and 11) of the tray holding member 143. The shapes of the guiding rails 161 are the same between the driving side guiding rail 161R and the non-driving side guiding rail 161L.

The cartridge tray 144 is moved to the accommodating portion, as an inside position, of the apparatus main assembly 101, so that the abutting portion 162 of the guiding rail 161 provided in the cartridge tray 144 abuts against the projection 143*r* of the tray holding member 143. Then, the guiding rail engaging portions 165-167 start pushing of the rotation preventing portion 157 to move the process cartridges C111, C112 and C113 in the listed order. As a result, the pitch between the photosensitive drums is narrowed (FIG. 9).

Further, when the cartridge tray 144 is pulled out from the apparatus main assembly 101, a reverse procedure is performed. The abutting portion 162 of the guiding rail 161 provided in the cartridge tray 144 abuts against the projection 143*f* of the tray holding member 143. Then, the engaging portions 165-167 of the guiding rail 161 start pushing of the rotation preventing portion 157 to move the process cartridges C111, C112 and C113 in the listed order. As a result, the pitch between the photosensitive drums is broadened (FIG. 8).

In this way, the cartridge tray 144 is provided with the engaging portions 145-148, and in interrelation with the pulling-out operation of the tray 144, a pitch between the process cartridges and the pitch between the photosensitive drums are broadened (increased). As a result, it is possible to ensure a mounting locus without causing interference between the adjacent process cartridges with each other during mounting and dismounting of the process cartridge. Further, the process cartridge C can be pulled out upward, so that usability is improved. Further, during the mounting of the cartridge into the apparatus main assembly, the pitch between the photosensitive drums is narrowed (decreased), and therefore FPOT can be shortened.

Incidentally, in Embodiment 1, description was made based on the arrangement such that the drum unit 151 of the cartridge C and the developing unit 156 of the process cartridge C adjacent to the cartridge C overlapped with each other with respect to the up-down direction as the mounting and dismounting direction of the cartridge C relative to the apparatus main assembly 101. However, an arrangement such that the adjacent cartridges do not overlap with each other may also be employed.

Figure 11:
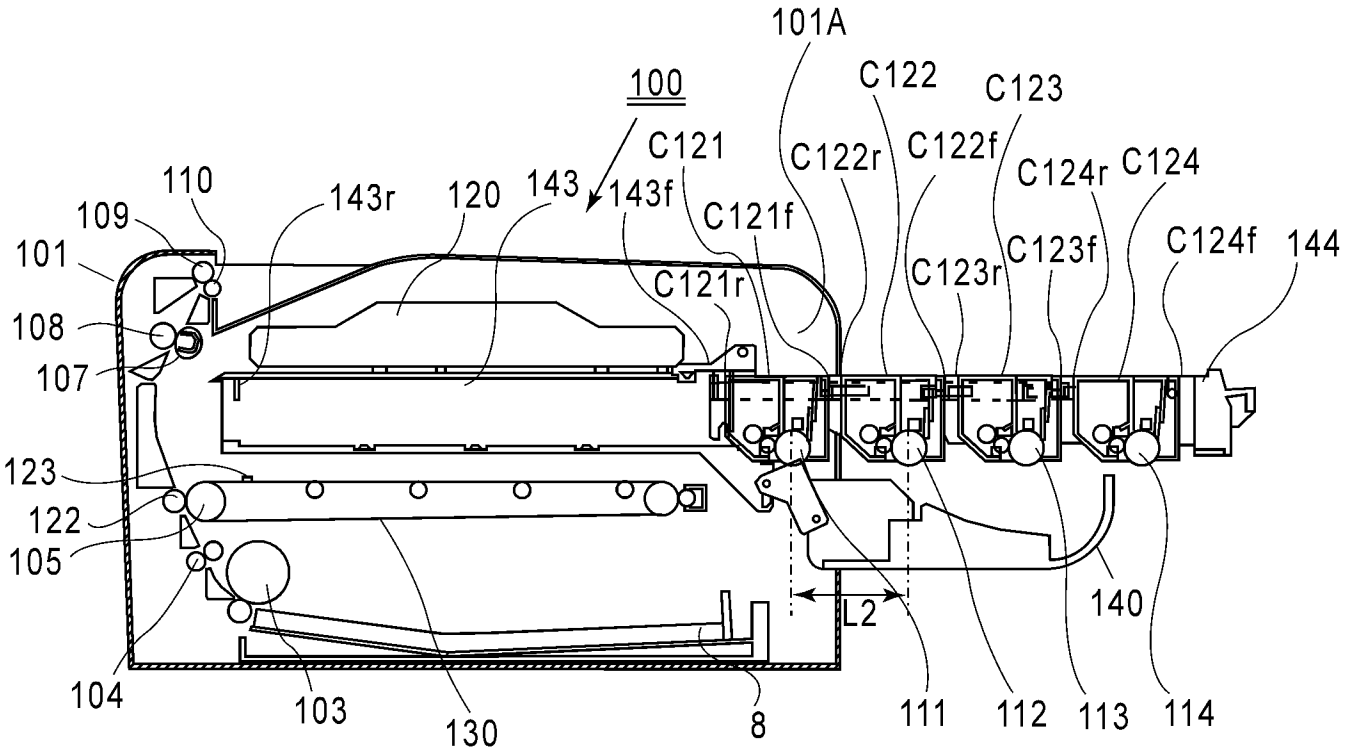
FIG. 11 is a longitudinal schematic side view of an image forming apparatus having another structure in Embodiment 1 in a state in which a cartridge tray is pulled out.
Figure 12:
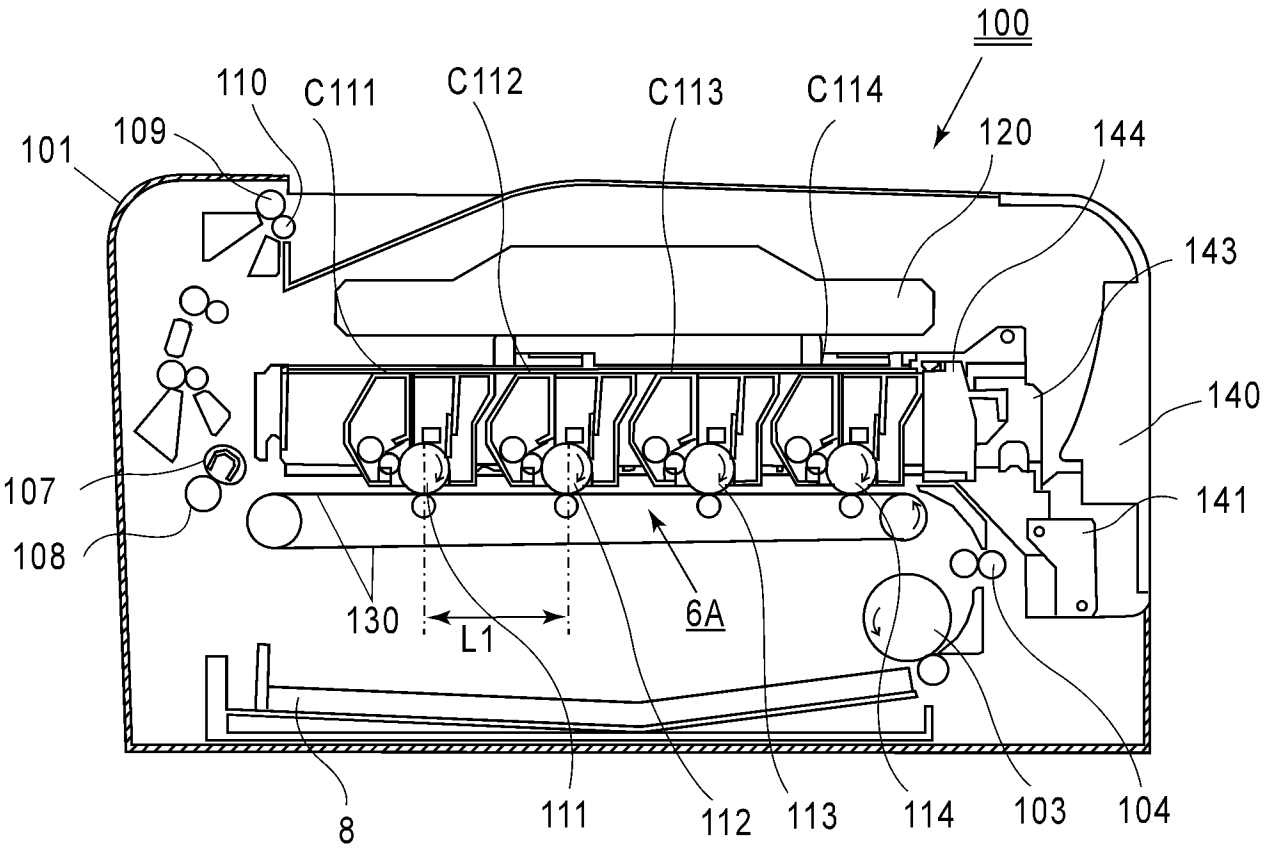
FIG. 12 is a longitudinal schematic side view of an image forming apparatus having still another structure in Embodiment 1.

In this case, as shown in FIGS. 11 and 12, the pitch between the photosensitive drums is increased from L1 to L2, so that upper-side both ends C121*f*-C124*f* and C121*r*-C124*r* of the process cartridges C are easily held. As a result, without providing recessed portions for holding the process cartridges at the upper-side both ends of the process cartridges, usability is improved while ensuring a space of parts necessary to the process cartridges and a volume of the developer.

Further, in Embodiment 1, although the description is made based on an ITB (intermediary transfer belt) type using the intermediary transfer belt 130, also in an image forming apparatus of an ETB (electrostatic transfer belt) type using an electrostatic conveying belt as shown in FIG. 12, a similar effect can be obtained by employing a similar constitution. In FIG. 12, the electrostatic conveying belt is represented by a reference symbol 6A.

<Embodiment 2>

Embodiment 2 of the present invention will be described with reference to FIGS. 13-17. In this embodiment, constituent elements similar to the above-described constituent elements in Embodiment 1 will be omitted from description by adding the same reference numerals or symbols. In this embodiment, a cartridge tray 244 is used.

(Structure of Cartridge Tray)

Figure 13:
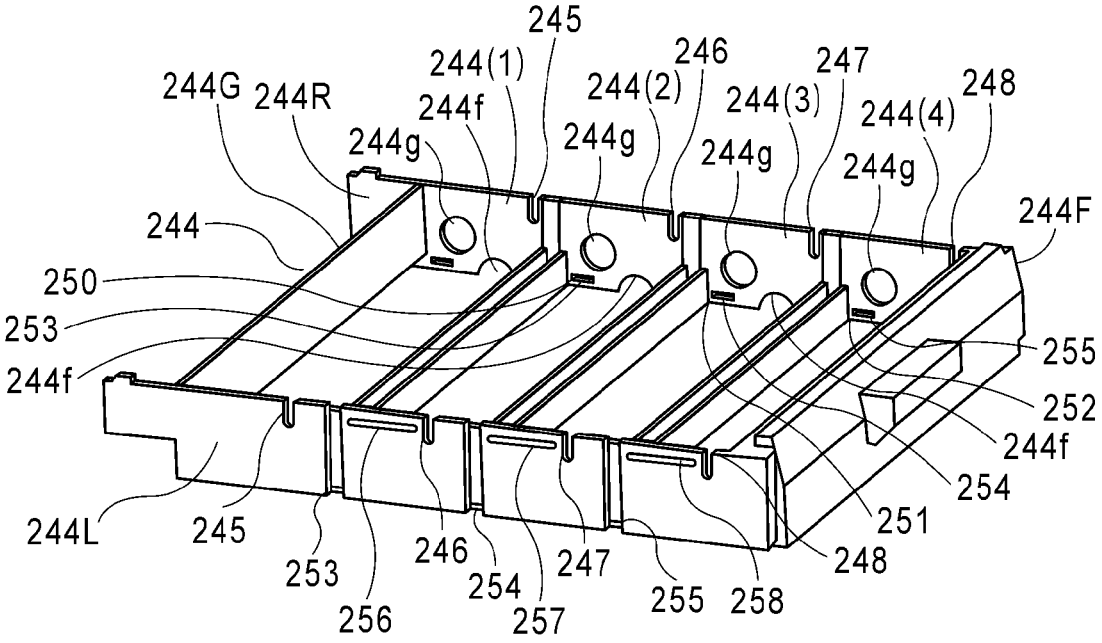
FIG. 13 is a perspective view of an outer appearance of a cartridge tray in Embodiment 2.
Figure 14:
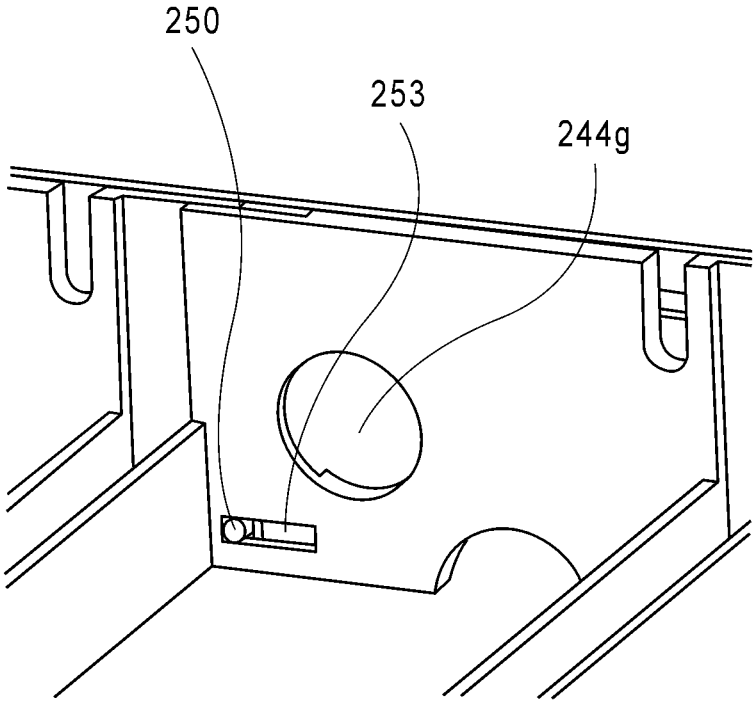
FIG. 14 is a partly enlarged view of the cartridge tray at an outside position.
Figure 15:
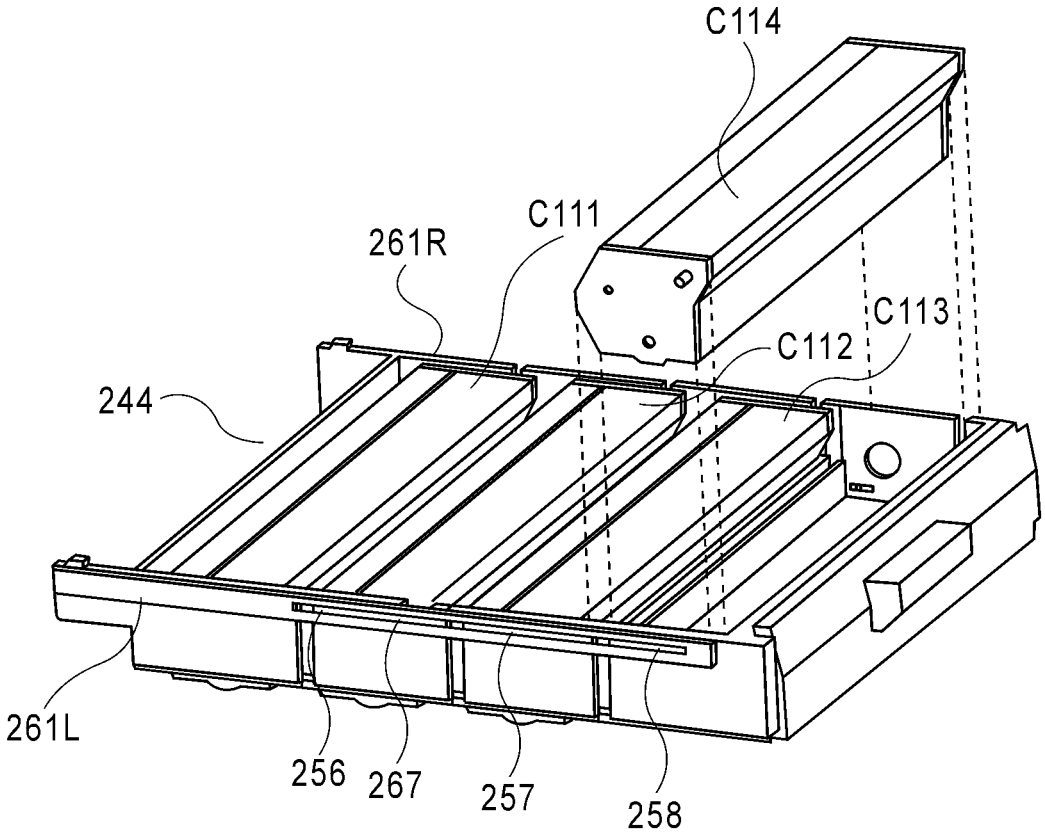
FIG. 15 is a perspective view of an outer appearance of the cartridge tray at the outside position.
Figure 16:
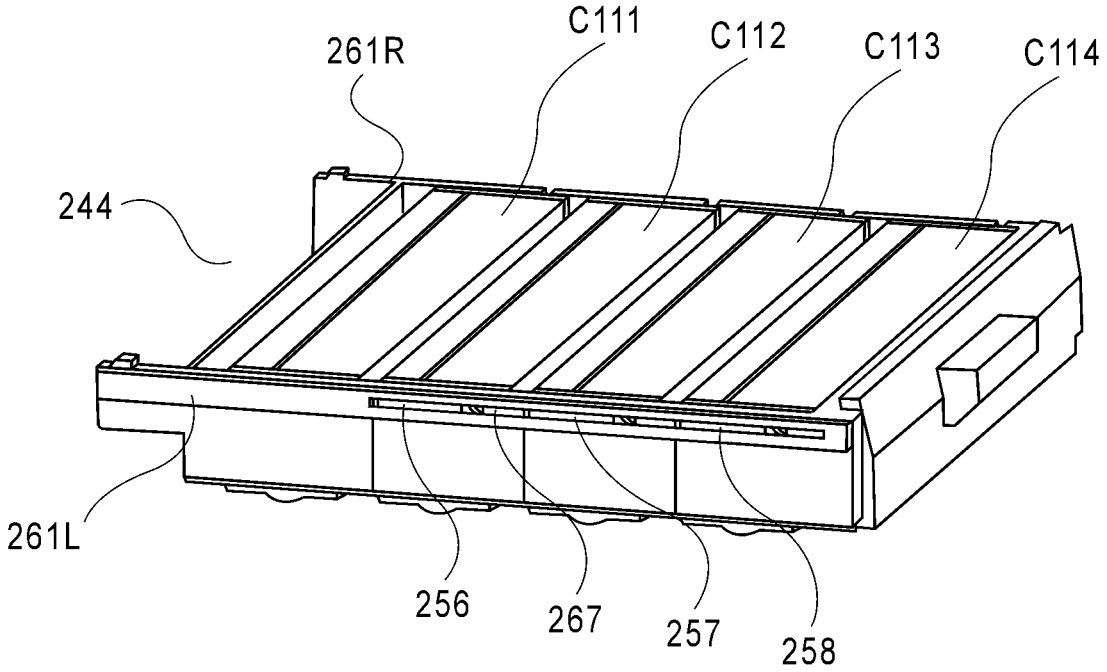
FIG. 16 is a perspective view of an outer appearance of the cartridge tray at an image forming position.
Figure 17:
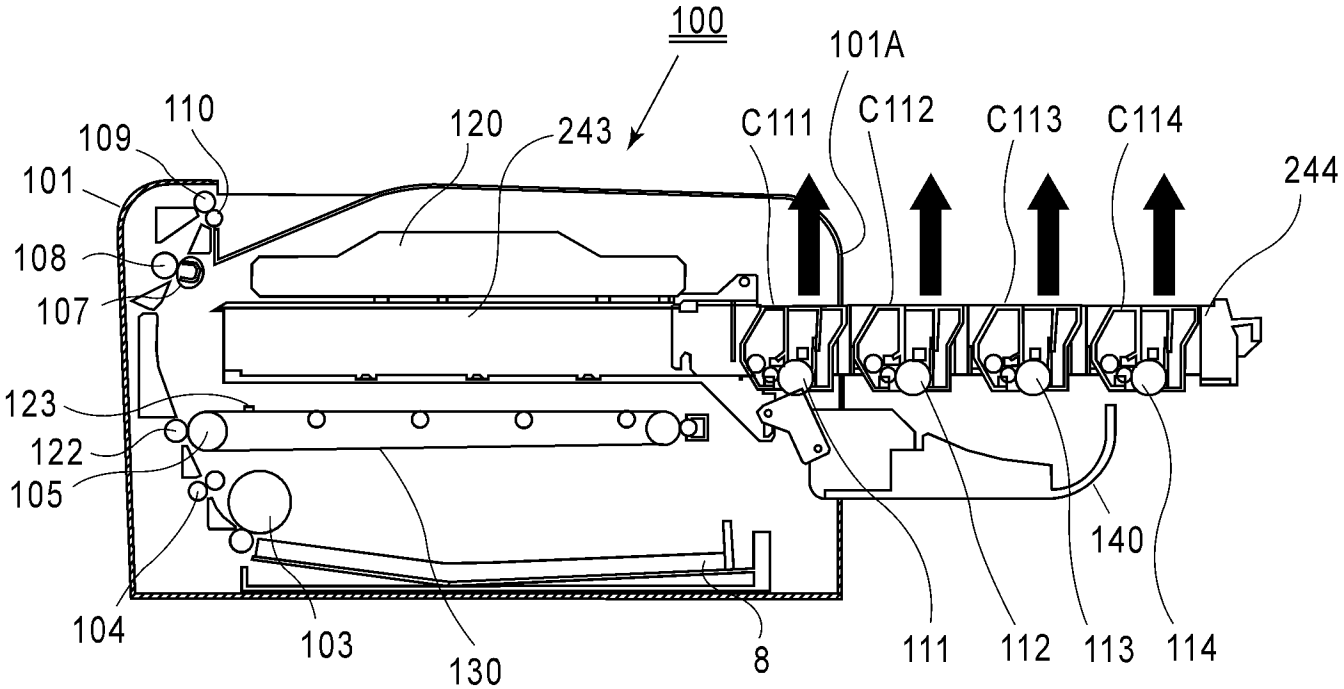
FIG. 17 is a longitudinal schematic side view of the image forming apparatus in a state in which the cartridge tray is pulled out.

FIG. 13 is a perspective view of an outer appearance of the cartridge tray 244 at an outside position. FIG. 14 is a partly enlarged view of the cartridge tray 244 at the outside position. FIG. 15 is a perspective view of an outer appearance of the cartridge tray 244 at the outside position after pulling-out of the cartridge tray 244. FIG. 16 is a perspective view of an outer appearance of the cartridge tray 244 at an image forming position. FIG. 17 is a schematic sectional view of the image forming apparatus at the outside position after the cartridge tray 244 is pulled out.

The cartridge tray 244 is constituted by four mounting portions 244(1)-244(4). Further, at left and right ends of the mounting portion 244(1), mounting portion holding members 261L and 261R for slidably holding the mounting portions 244(2)-244(4) are provided (FIG. 15). The mounting portions 244(1)-244(4) are portions (cartridge accommodating spaces, cartridge mounting portions) where the first to fourth (four) cartridges C111, C112, C113 and C114, respectively, are to be inserted and supported.

The cartridge tray 244 roughly supports the process cartridges C111, C112, C113 and C114 at the mounting portions 244(1)-244(4). The mounting portions 244(1)-244(4) are surrounded and defined by a right frame portion 244R (driving side), a left frame portion 244L (non-driving side), a rear frame portion 244G and a front frame portion 244F.

A right frame portion 244R (driving side) is provided with holes 244*f* and 244*g* through which first and second drive output portions provided in the apparatus main assembly 101 side go in and out of the cartridge tray 244. Further, the right frame portion 244R is provided with engaging portions 245-248 with which the rotation preventing portions 157R of the cartridges C are to be engaged. Each of these engaging portions 245-248 is provided with an I-shaped groove including a cut-away portion with respect to the cartridge mounting and dismounting direction.

Further, supporting portions (which are not shown but have the substantially same shape as those for the left frame portion) engageable with mounting portion holding member engaging portions of the mounting portion holding member 261R are provided. Each of the mounting portion holding member engaging portions is provided with a groove with respect to the pulling-out direction, and the associated supporting portion engageable with the mounting portion holding member engaging portion is provided with a projection with respect to the pulling-out direction. Further, positioning portions 250-252 and guiding portions 253-255 engageable with the positioning portions of adjacent mounting portions are provided (FIG. 14). Each of the positioning portions has a round boss shape, and an associated one of the guiding portions 253-255 engageable therewith is provided with a groove with respect to the pulling-out direction.

The left frame portion 244L (non-driving side) have many shapes similar to those for the right frame portion 244R (driving side), and is provided with engaging portions 245-248 engageable with the non-driving side rotation preventing portions 157L of the process cartridges C. Each of the engaging portions 245-248 is provided with an I-shaped groove with respect to the cartridge mounting and dismounting direction.

Further, supporting portions 256-258 engageable with a mounting portion holding member engaging portion 267 of the mounting portion holding member 261L are provided. The mounting portion holding member engaging portion 267 is provided with a groove with respect to the pulling-out direction, and each of the supporting portions 256-258 engageable with the mounting portion holding member engaging portion 267 is provided with a projection with respect to the pulling-out direction. Further, positioning portions 250-252 and guiding portions 253-255 engageable with the positioning portions of adjacent mounting portions are provided. Each of the positioning portions has a round boss shape, and an associated one of the guiding portions 253-255 engageable therewith is provided with a groove with respect to the pulling-out direction.

The process cartridges C111, C112, C113 and C114 are inserted into the corresponding mounting portions 244(1)-244(4), respectively, from above in a drop-in manner. When the process cartridge C is gradually inserted, each of the driving side rotation preventing portion 157R and the non-driving side rotation preventing portion 157L is gradually engaged with an associated one of the engaging portions 245-248 provided in the mounting portions 244(1)-244(4) sides (FIG. 15). Further, when the process cartridge C is moved downward so as to be accommodated in the mounting portions, lower surfaces of the rotation preventing portions 157R and 157L abut against the engaging portions 245-248 in the mounting portions 244(1)-244(4) sides, thus being received (caught).

As a result, the process cartridges are in a state in which the process cartridges are placed on and supported by the mounting portions 244(1)-244(4). That is, the mounting portions 244 support the cartridges so as to be dismountable right above and support the cartridges by moving the cartridges toward right below.

When the cartridge tray 244 is moved to the accommodating portion of the apparatus main assembly, in interrelation with the movement, the supporting portions 256-258 of the mounting portions 244(2)-244(4) are translated along the mounting portion holding members 261R and 261L. Further, the positioning portions 250-252 of the mounting portions 244(1)-244(3) are translated along the corresponding guiding portions 253-255, respectively, thus abutting against corresponding abutting portions provided at ends of the guiding portions 253-255. As a result, the length of the cartridge tray 244 with respect to the pulling-out direction is shortened, and at the same time, the pitch between the photosensitive drums is narrowed (FIG. 16).

Further, when the cartridge tray 244 is pulled out from the apparatus main assembly, in interrelation with the movement, the supporting portions 256-258 of the mounting portions 244(2)-244(4) are translated in the pulled-out direction along the mounting portion holding members 261R and 261L. Further, the positioning portions 250-252 of the mounting portions 244(1)-244(3) are translated along the corresponding guiding portions 253-255, respectively, thus abutting against corresponding supporting portions provided at ends of the guiding portions 253-255, so that positioning is made. In this way, each of the mounting portions 244(1)-244(4) of the cartridge tray 244 positions the cartridge C at a position where an adjacent process cartridge does not overlap with the cartridge C with respect to the up-down direction. As a result, the mounting portions 244(1)-244(4) support the respective process cartridges C so as to be dismountable right above (FIG. 17).

In this way, the cartridge tray 244 is provided with the plurality of mounting portions 244(1)-244(4), and in interrelation with the pulling-out operation of the tray 244, the mounting portions are translated to broaden (increase) the pitch between the photosensitive drums. As a result, it is possible to ensure a mounting locus without causing interference between the adjacent cartridges with each other during mounting and dismounting of the cartridge. Further, the process cartridge C can be pulled out upward, so that usability is improved. Further, during the mounting of the cartridge into the apparatus main assembly, the pitch between the photosensitive drums is narrowed (decreased), and therefore FPOT can be shortened. Further, during mounting of the cartridges into the apparatus main assembly 101, the length of the cartridge tray 244 with respect to the pulling-out direction is shortened, and therefore it becomes possible to downsize the image forming apparatus 100.

In Embodiment 2, description was made based on the arrangement such that the drum unit 151 of the cartridge C and the developing unit 156 of the process cartridge C adjacent to the cartridge C overlapped with each other with respect to the up-down direction as the mounting and dismounting direction of the cartridge C relative to the apparatus main assembly 101. However, an arrangement such that the adjacent cartridges C do not overlap with each other may also be employed.

The pitch between the drums is increased similarly as in Embodiment 1, so that the cartridges are easily held, and usability is improved while ensuring a space of parts necessary to the process cartridges and a volume of the developer.

Further, in Embodiment 2, although the description is made based on an ITB (intermediary transfer belt) type using the intermediary transfer belt, also in an image forming apparatus of an ETB (electrostatic transfer belt) type using an electrostatic conveying belt (FIG. 12), a similar effect can be obtained by employing a similar constitution.

<Embodiment 3>

Embodiment 2 of the present invention will be described with reference to FIGS. 18-21. In this embodiment, constituent elements similar to the above-described constituent elements in Embodiment 1 will be omitted from description by adding the same reference numerals or symbols. In this embodiment, a cartridge tray 344 is used.

(Structure of Cartridge Tray)

Figure 18:
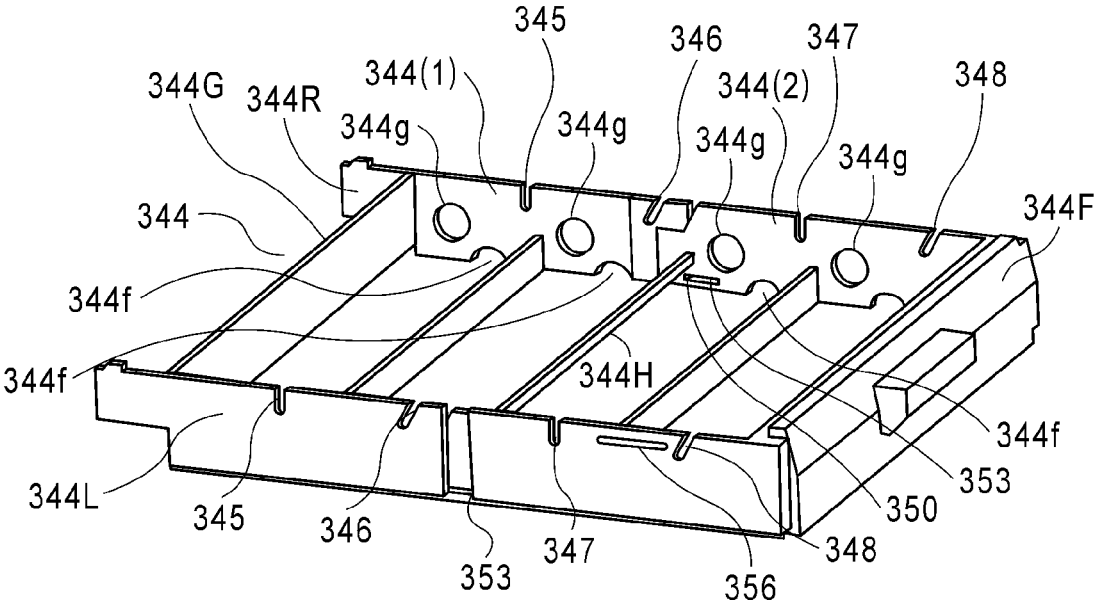
FIG. 18 is a perspective view of an outer appearance of a cartridge tray in Embodiment 3.
Figure 19:
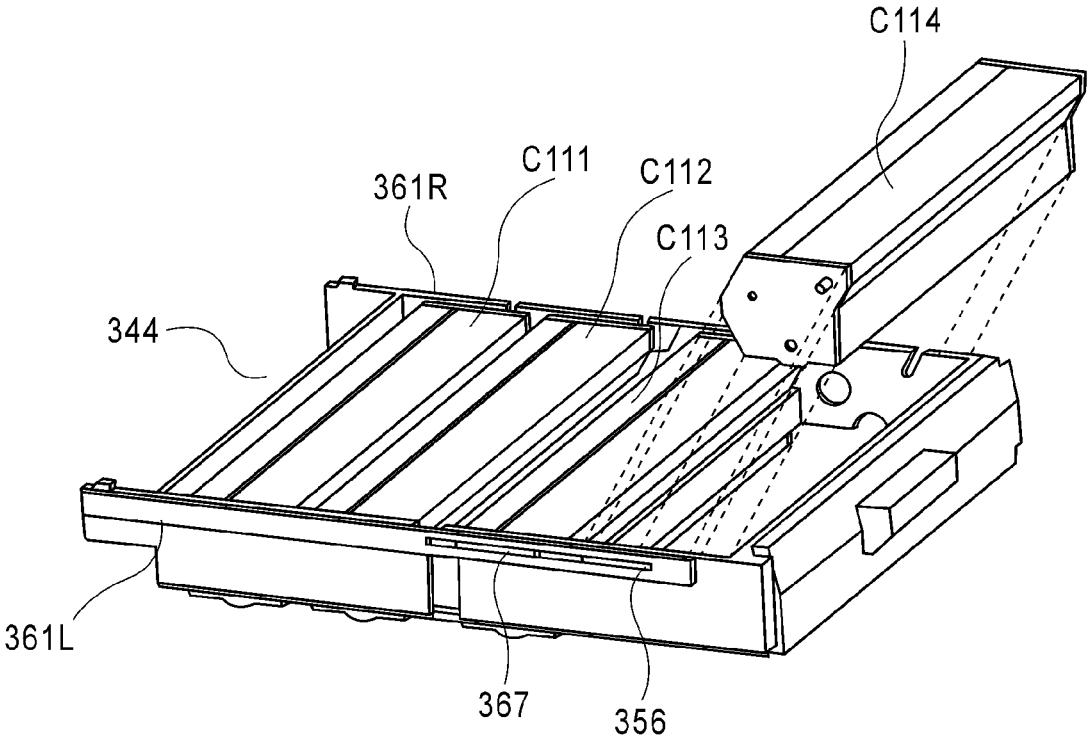
FIG. 19 is a perspective view of an outer appearance of the cartridge tray at an outside position.
Figure 20:
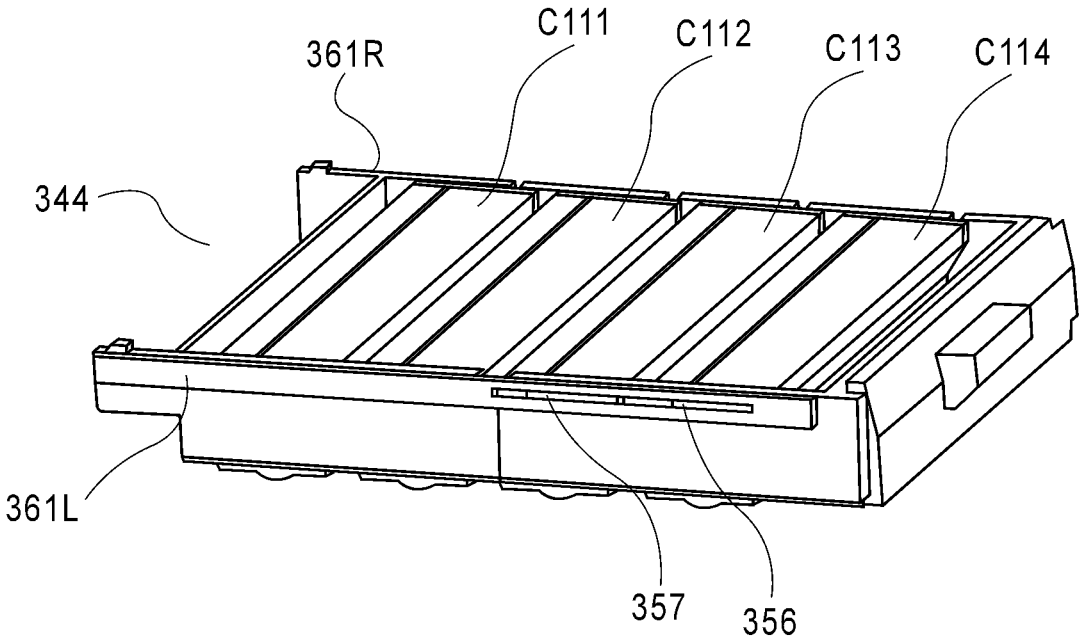
FIG. 20 is a perspective view of an outer appearance of the cartridge tray at an image forming position.
Figure 21:
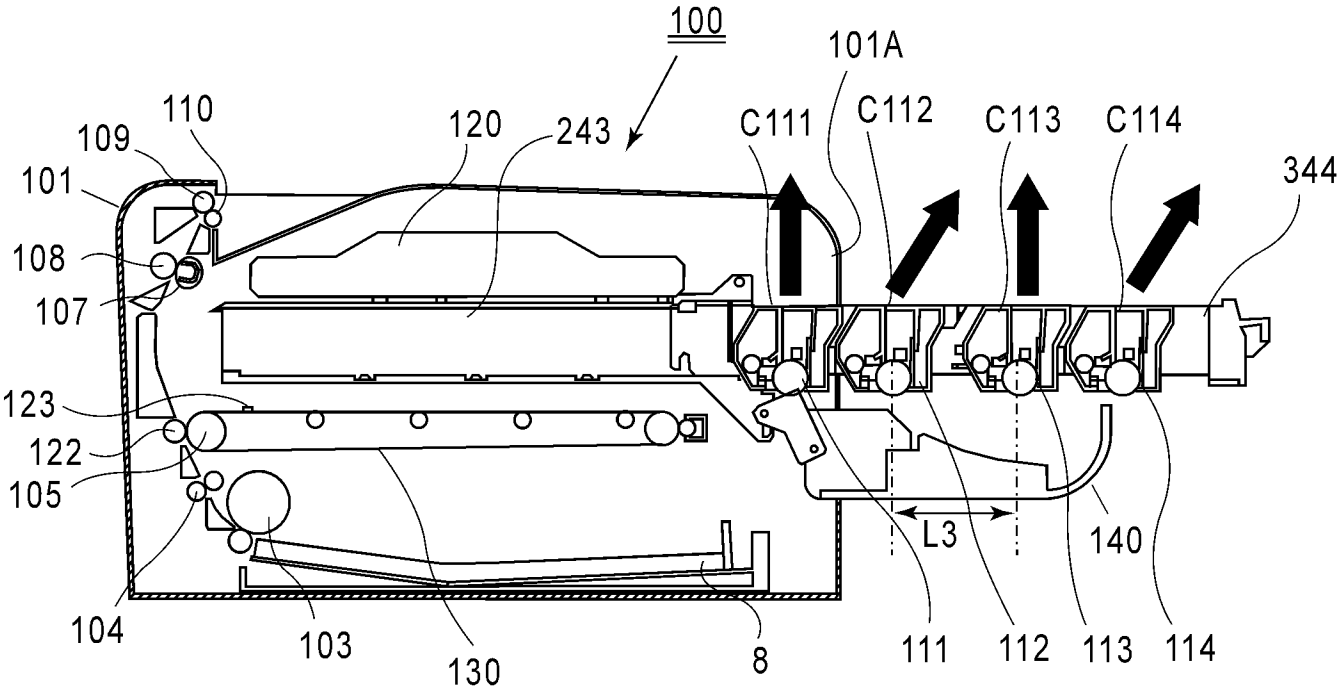
FIG. 21 is a longitudinal schematic side view of the image forming apparatus in a state in which the cartridge tray is pulled out.

FIG. 18 is a perspective view of an outer appearance of the cartridge tray 344 at an outside position. FIG. 19 is a perspective view of an outer appearance of the cartridge tray 344 at the outside position after pulling-out of the cartridge tray 344. FIG. 20 is a perspective view of an outer appearance of the cartridge tray 344 at an image forming position. FIG. 21 is a schematic sectional view of the image forming apparatus at the outside position after the cartridge tray 344 is pulled out.

The cartridge tray 344 is constituted by four mounting portions 344(1) and 344(2). The mounting portions 322(1) and 344(2) are surrounded and defined by a right frame portion 344R (driving side), a left frame portion 344L (non-driving side), a rear frame portion 344G and a front frame portion 344F. Further, the mounting portions 344(1) and 344(2) are partitioned into substantially equal two portions with respect to a front-rear direction by a partition plate 344H. Further, at left and right ends of the mounting portion 344(1), mounting portion holding members 361L and 361R for slidably holding the mounting portion 344(2) are provided (FIG. 19). The mounting portions 344(1) and 344(2) are portions (cartridge accommodating spaces, cartridge mounting portions) where the first and second cartridges C111 and C112 and the third and fourth cartridges C113 and C114 are to be inserted and supported, respectively. The cartridge tray 344 roughly supports the cartridges C111 and C112 and the cartridges C113 and C114 at the mounting portions 344(1) and 344(2), respectively.

A right frame portion 344R (driving side) is provided with holes 344*f* and 344*g* through which first and second drive output portions provided in the apparatus main assembly 101 side go in and out of the cartridge tray 344. Further, the right frame portion 244R is provided with engaging portions 345 and 346 with which the rotation preventing portions 157R of the cartridges C are to be engaged. Each of these engaging portions 345 and 346 is provided with an I-shaped groove including a cut-away portion with respect to the cartridge mounting and dismounting direction and the I-shaped groove is provided with respect to a direction corresponding to the cartridge direction as described later.

Further, supporting portions (which are not shown but have the substantially same shape as that for the left frame portion) engageable with mounting portion holding member engaging portions of the mounting portion holding member 361R are provided. Each of the mounting portion holding member engaging portions is provided with a groove with respect to the pulling-out direction, and the associated supporting portion engageable with the mounting portion holding member engaging portion is provided with a projection with respect to the pulling-out direction.

Further, the front (one) mounting portion 344(2) is provided with positioning portion 350, and the rear (the other) mounting portion 344(1) is provided with a guiding portion 353 engageable with the positioning portion 350 of the mounting portion 344(2). The positioning portion 350 has a round boss shape, and the guiding portion 353 engageable therewith is provided with a groove with respect to the pulling-out direction.

The left frame portion 344L (non-driving side) have many shapes similar to those for the right frame portion 344R (driving side), and is provided with engaging portions 345 and 346 engageable with the non-driving side rotation preventing portions 157L of the process cartridges C. Each of the engaging portions 345 and 346 is provided with an I-shaped groove with respect to the cartridge mounting and dismounting direction, and the I-shaped groove is provided with respect to a direction corresponding to the cartridge mounting and dismounting direction as described later.

Further, a supporting portion 356 engageable with a mounting portion holding member engaging portion 367 of the mounting portion holding member 361L is provided. The mounting portion holding member engaging portion 367 is provided with a groove with respect to the pulling-out direction, and the supporting portion 356 engageable with the mounting portion holding member engaging portion 367 is provided with a projection with respect to the pulling-out direction.

Further, the front mounting portion 344(2) is provided with a positioning portion 350 and the rear mounting portion 344(1) is provided with a guiding portion 353 engageable with the positioning portion 350 of the mounting portion 344(2). The positioning portion 350 has a round boss shape, and the guiding portion 353 engageable therewith is provided with a groove with respect to the pulling-out direction.

The process cartridges C111 and C113 are inserted into the corresponding mounting portions 344(1) and 344(2), respectively, from above in a drop-in manner. When the process cartridge C is gradually inserted, each of the driving side rotation preventing portion 157R and the non-driving side rotation preventing portion 157L is gradually engaged with an associated one of the engaging portions 345 and 347 provided in the mounting portions 344(1) and 344(2) sides (FIG. 19). Further, when the process cartridge C is moved downward so as to be accommodated in the mounting portions, lower surfaces of the rotation preventing portions 157R and 157L abut against the engaging portions 345 and 347 in the mounting portions 344(1) and 344(2) sides, thus being received (caught).

As a result, the process cartridges C are in a state in which the process cartridges are placed on and supported by the mounting portions 344(1) and 344(2). That is, the mounting portions 244 support the cartridges so as to be dismountable right above and support the cartridges by moving the cartridges toward right below.

The process cartridges C112 and C114 are inserted into the corresponding mounting portions 344(1) and 344(2), respectively, from above in an oblique drop-in manner so that a mounting locus of each of the cartridges C112 and C114 does not interfere with the adjacent cartridge C. When the process cartridge C is gradually inserted, each of the driving side rotation preventing portion 157R and the non-driving side rotation preventing portion 157L is gradually engaged with an associated one of the engaging portions 345 and 347 provided in the mounting portions 344(1) and 344(2) sides (FIG. 19). Further, when the process cartridge C is moved downward so as to be accommodated in the mounting portions, lower surfaces of the rotation preventing portions 157R and 157L abut against the engaging portions 345 and 347 in the mounting portions 344(1) and 344(2) sides, thus being received (caught).

As a result, the process cartridges C are in a state in which the process cartridges are placed on and supported by the mounting portions 344(1) and 344(2). That is, the mounting portions 244 support the cartridges so as to be dismountable obliquely above and support the cartridges by moving the cartridges toward obliquely below.

When the cartridge tray 344 is moved to the accommodating portion of the apparatus main assembly, in interrelation with the movement, the supporting portion 356 of the mounting portion 3244(2) are translated along the mounting portion holding members 361R and 361L. Further, the positioning portions 350 of the mounting portion 244(1) are translated along the corresponding guiding portions 353, respectively, thus abutting against corresponding abutting portions provided at ends of the guiding portions 353. As a result, the length of the cartridge tray 344 with respect to the pulling-out direction is shortened, and at the same time, the pitch between the photosensitive drums is narrowed (FIG. 20).

Further, when the cartridge tray 344 is pulled out from the apparatus main assembly, in interrelation with the movement, the supporting portion 356 of the mounting portion 344(2) are translated in the pulled-out direction along the mounting portion holding members 361R and 361L. Further, the positioning portions 350 of the mounting portion 344(1) are translated along the corresponding guiding portions 353, respectively, thus abutting against corresponding supporting portions provided at ends of the guiding portions 353, so that positioning is made. In this way, each of the mounting portions 344(1) and 344(2) of the cartridge tray 344 positions the cartridge C at a position where an adjacent process cartridge does not overlap with the cartridge C with respect to the up-down direction. As a result, the mounting portions 244(1)-244(4) support the respective process cartridges C so as to be dismountable above (FIG. 21).

In this way, the cartridge tray 344 is provided with the plurality of mounting portions, and in interrelation with the pulling-out operation of the tray 244, the mounting portions are translated to broaden (increase) at least one of the pitches each between the photosensitive drums. In this embodiment, the pitch between the second and third cartridges is increased to L3. Further, the mounting and dismounting directions of the adjacent cartridges are changed from each other. As a result, it is possible to ensure a mounting locus without causing interference between the adjacent cartridges with each other during mounting and dismounting of the cartridge.

Further, the cartridge C can be pulled out upward, so that usability is improved. Further, the number of expansion and contraction portions of the cartridge tray is decreased and limited, so that the structure is simplified, and thus the image forming apparatus can be further reduced in size and cost.

Incidentally, in Embodiment 3, the cartridge tray including the portion capable of being expanded and contracted between the second and third cartridges was described. However, a similar effect can be obtained even when the portion is capable of being expanded and contracted between other cartridges. In this case, there is a need to change the cartridge mounting and dismounting directions and to designate the order of mounting and dismounting of the cartridges.

Further, in Embodiment 3, although the description is made based on an ITB (intermediary transfer belt) type using the intermediary transfer belt, also in an image forming apparatus of an ETB (electrostatic transfer belt) type using an electrostatic conveying belt (FIG. 12), a similar effect can be obtained by employing a similar constitution.

<Embodiment 4>

Embodiment 4 of the present invention will be described with reference to FIGS. 22-31. An image forming apparatus 100 in this embodiment is similar to the image forming apparatus 100 in Embodiment 1 but is different from Embodiment 1 in method of increasing the pitch between the drums for mounting and dismounting the cartridges. In this embodiment, constituent elements similar to those in Embodiment 1 will be omitted from description by adding the same reference numerals or symbols. In this embodiment, first to fourth process cartridges C411, C412, C413 and C414, and a cartridge tray 444 are used.

(Mounting and Dismounting Method of Process Cartridge)

Figure 22:
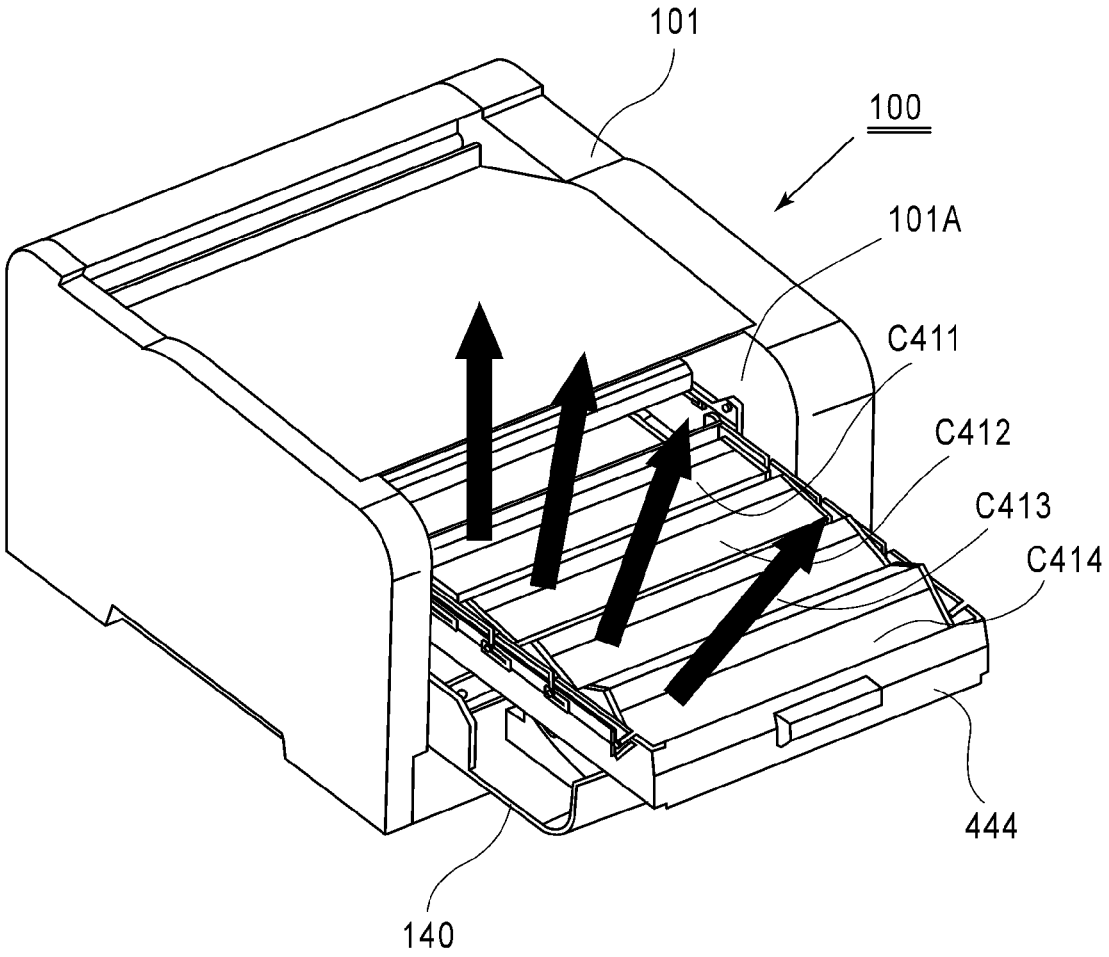
FIG. 22 is a perspective view of an outer appearance of an image forming apparatus in Embodiment 4 in a state in which a cartridge tray is pulled out.
Figure 23:
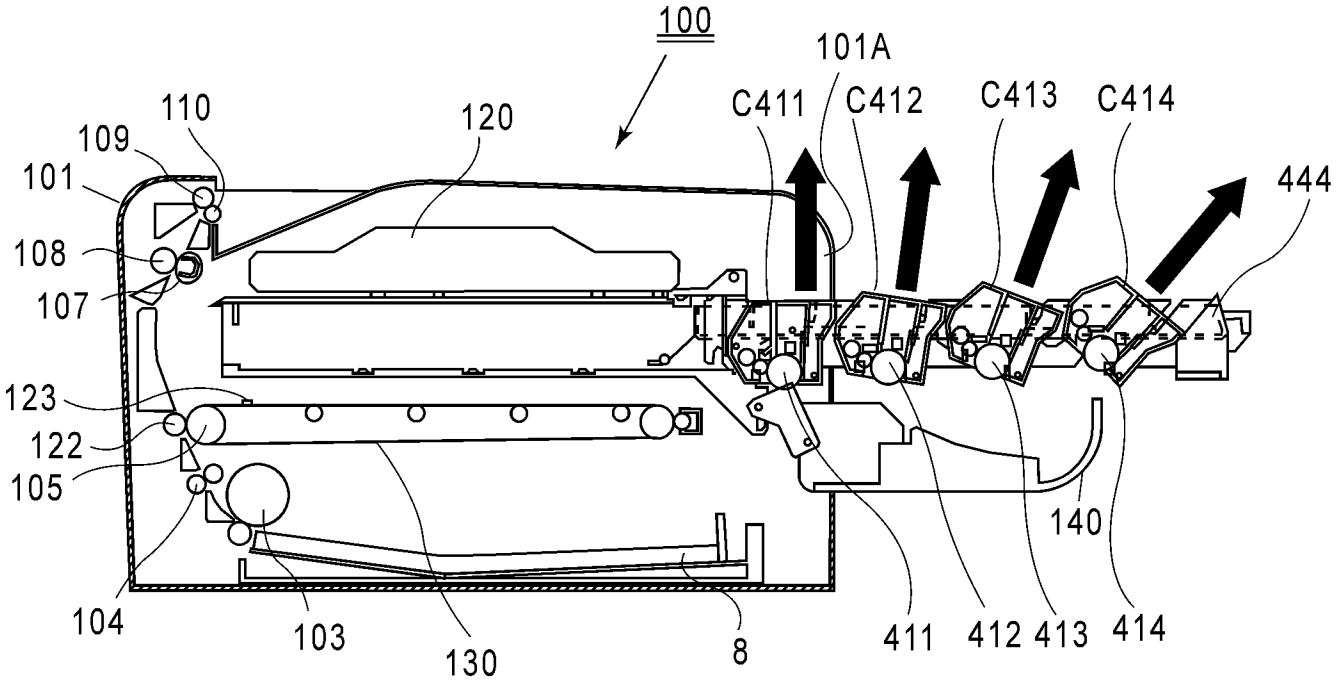
FIG. 23 is a longitudinal schematic side view of the image forming apparatus in the state in which the cartridge tray is pulled out.

An outline of a process cartridge mounting and dismounting method will be described with reference to FIGS. 22 and 23. FIGS. 22 and 23 are schematic views for illustrating exchange (replacement) of process cartridges, in which FIG. 22 is a perspective view of an outer appearance of the image forming apparatus 100 in a state in which the tray 444 is pulled out to an outside position, and FIG. 23 is a longitudinal schematic side view of the image forming apparatus 100 in the state.

As shown in FIGS. 22 and 23, when the cartridge tray 444 is pulled out from the apparatus main assembly 101, an upper surface of each of the process cartridges is exposed (opened). Further, in interrelation with the pulling-out operation of the cartridge tray 444, a pitch between adjacent two photosensitive drums of the respective process cartridges is increased. As a result, a mounting locus along which the process cartridges do not interfere with each other can be ensured, so that each of the process cartridges C411, C412, C413 and C414 is dismountable in an arrow direction. A method of changing the pitch between the photosensitive drums will be described later specifically. Further, when the process cartridges C411, C412, C413 and C414 are mounted in the apparatus main assembly 101, a reverse procedure is performed.

(Structure of Process Cartridge)

Figure 24:
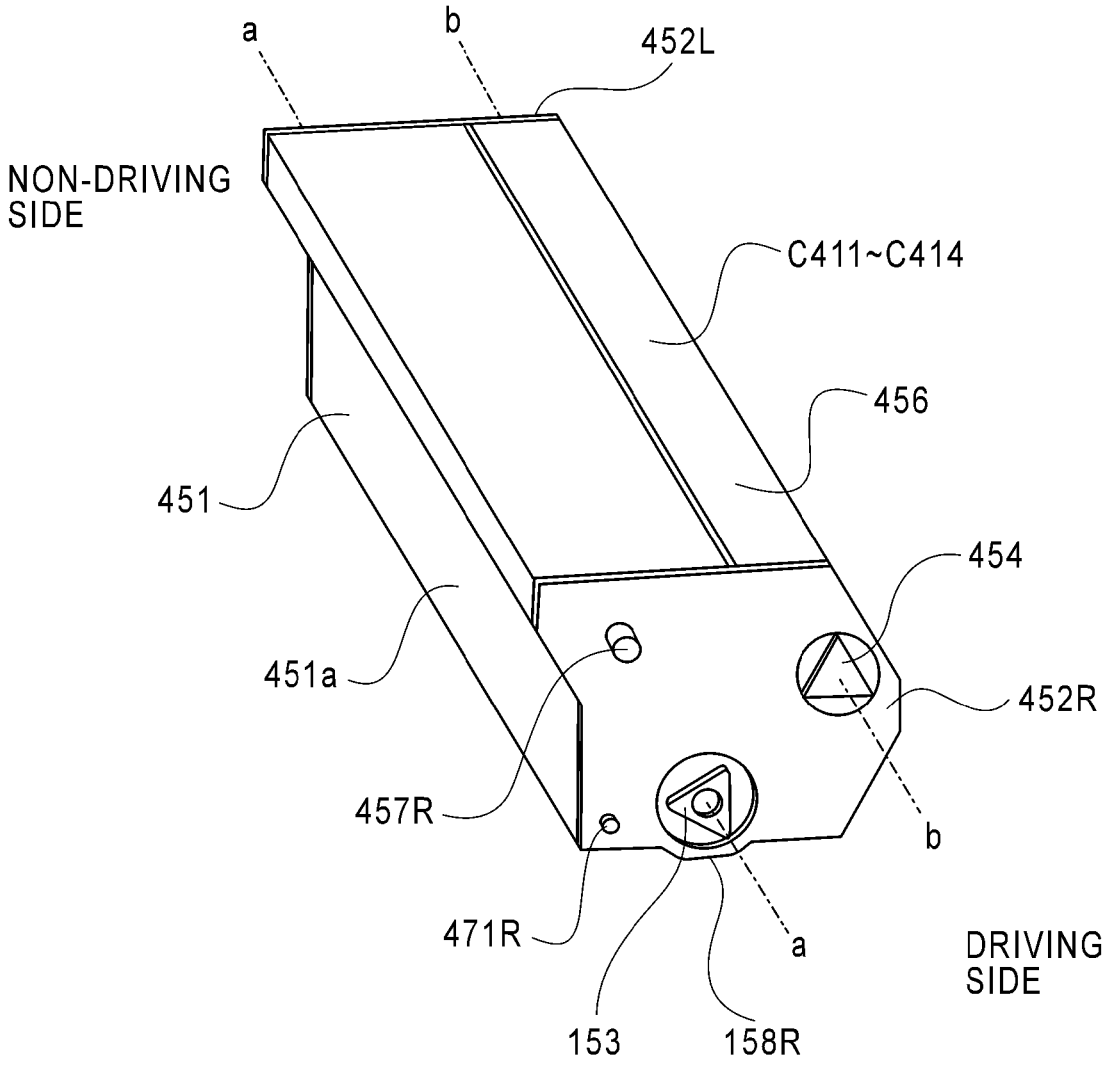
FIG. 24 is a perspective view of an outer appearance of a cartridge as seen from a driving side.
Figure 25:
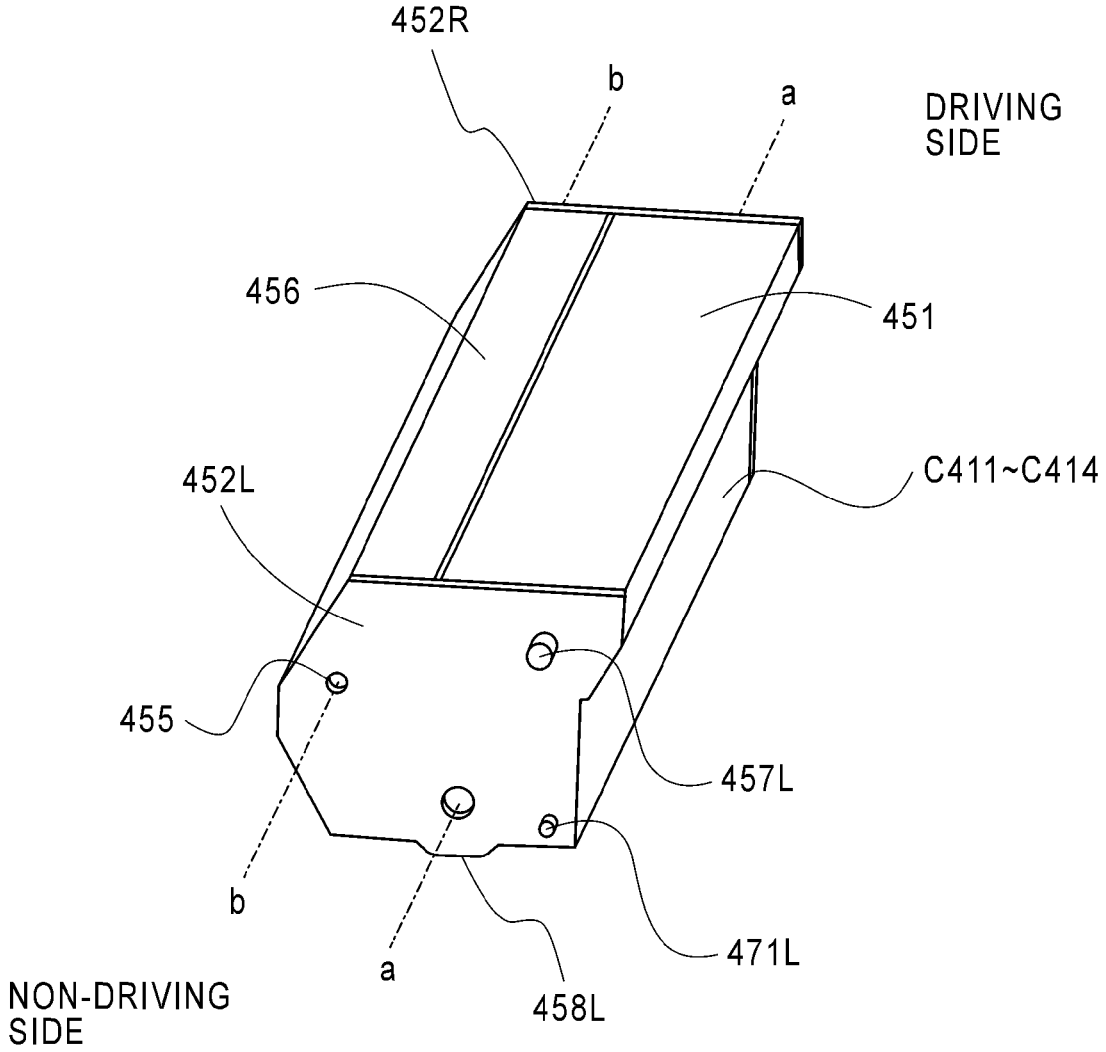
FIG. 25 is a perspective view of an outer appearance of the cartridge as seen from a non-driving side.

In this embodiment, the first to fourth process cartridges C411-C414 have the same structure. The structure of each process cartridge will be described with reference to FIGS. 24 and 25. FIGS. 24 and 25 are perspective views of the process cartridge C (C111-C114) as seen from a driving side and a non-driving side, respectively.

In addition to the structure of each of the process cartridges in Embodiments 1 to 3, rotation center shafts 471R and 471L are provided at side surface portions in the driving side and the non-driving side, respectively, and are engaged with engaging portions provided in the cartridge tray 444 side when the process cartridges are inserted into the cartridge tray 444.

Further, during positioning of the process cartridges relative to the apparatus main assembly 101, rotation preventing portions 457R and 457L are pressed (urged) by urging levers, described later, of the cartridge tray 444. As a result, the rotation preventing portions 457R and 457L are rotated about the rotation center shafts 471R and 471L to abut against abutting portions, thus being positioned. After the positioning, the rotation preventing portions 457R and 457L prevent the process cartridges from rotating when the rotation preventing portions 457R and 457L receive the rotational driving force from the apparatus main assembly 101.

(Structure of Cartridge Tray)

Figure 26:
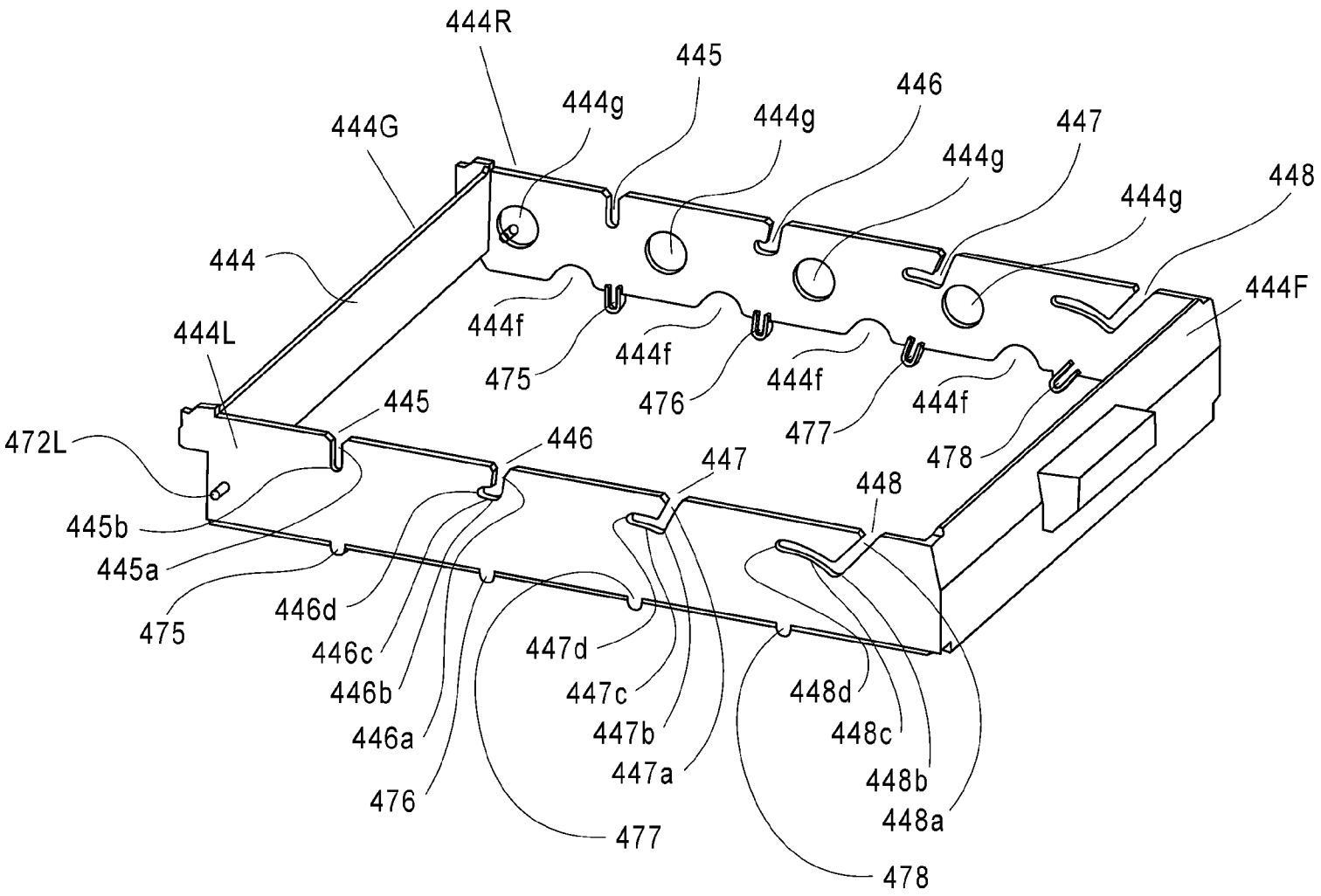
FIG. 26 is a perspective view of an outer appearance of the cartridge tray in Embodiment 4.
Figure 27A:
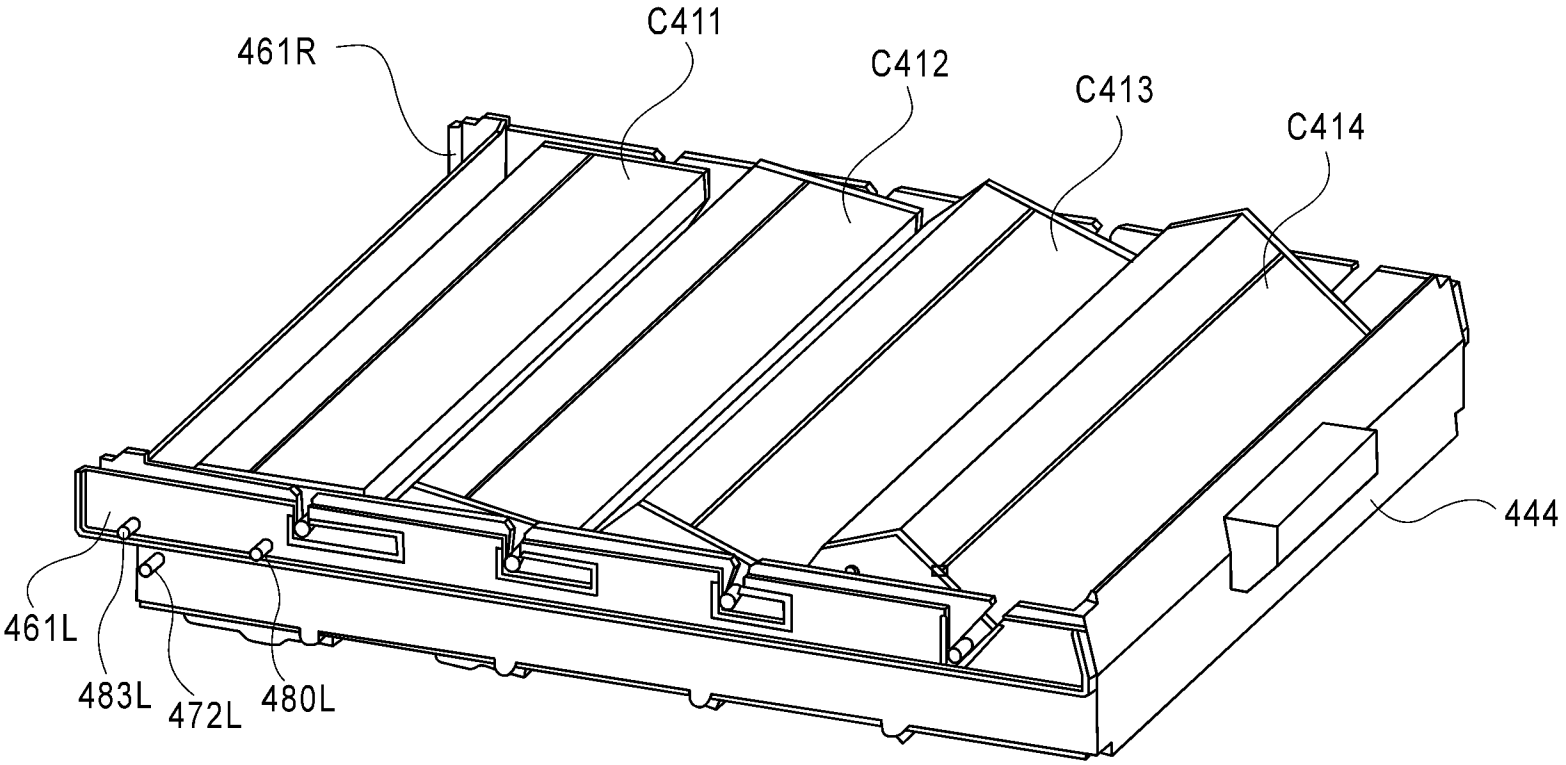
FIGS. 27A and 27B are a perspective view of an outer appearance and a side view, respectively, of the cartridge tray at an outside position.
Figure 27B:
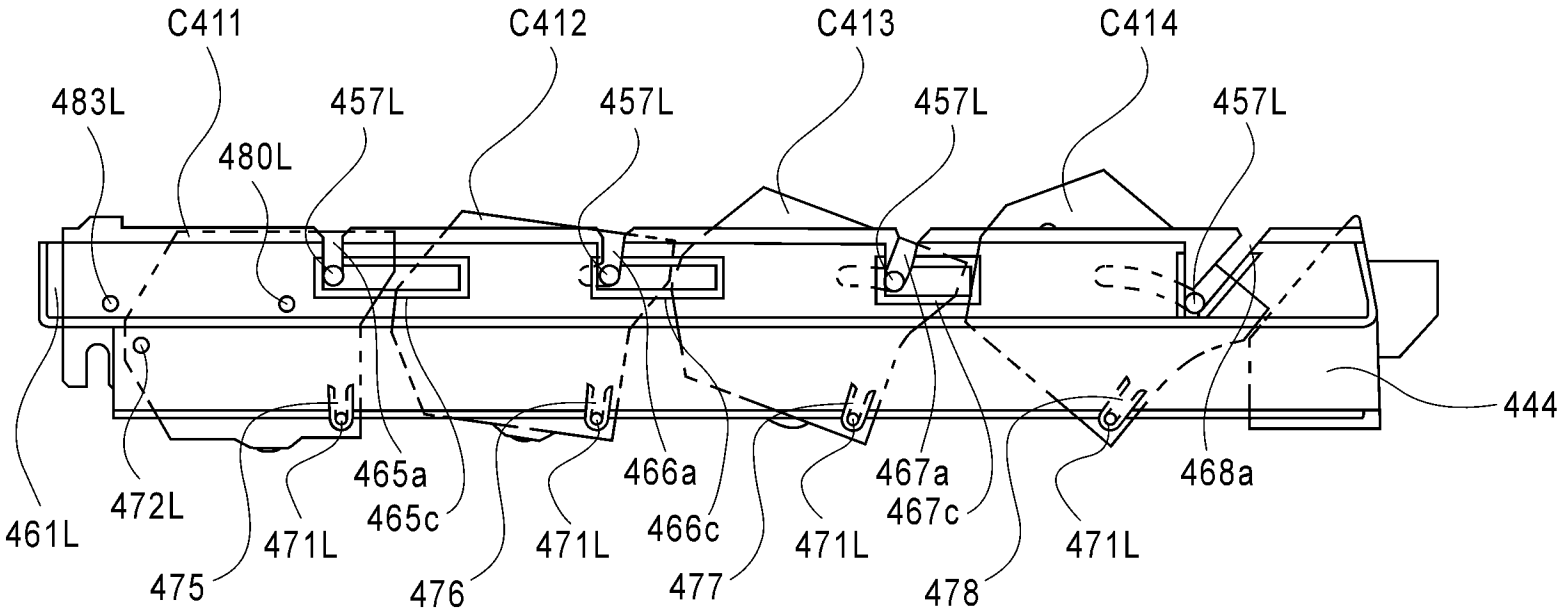
Figure 28A:
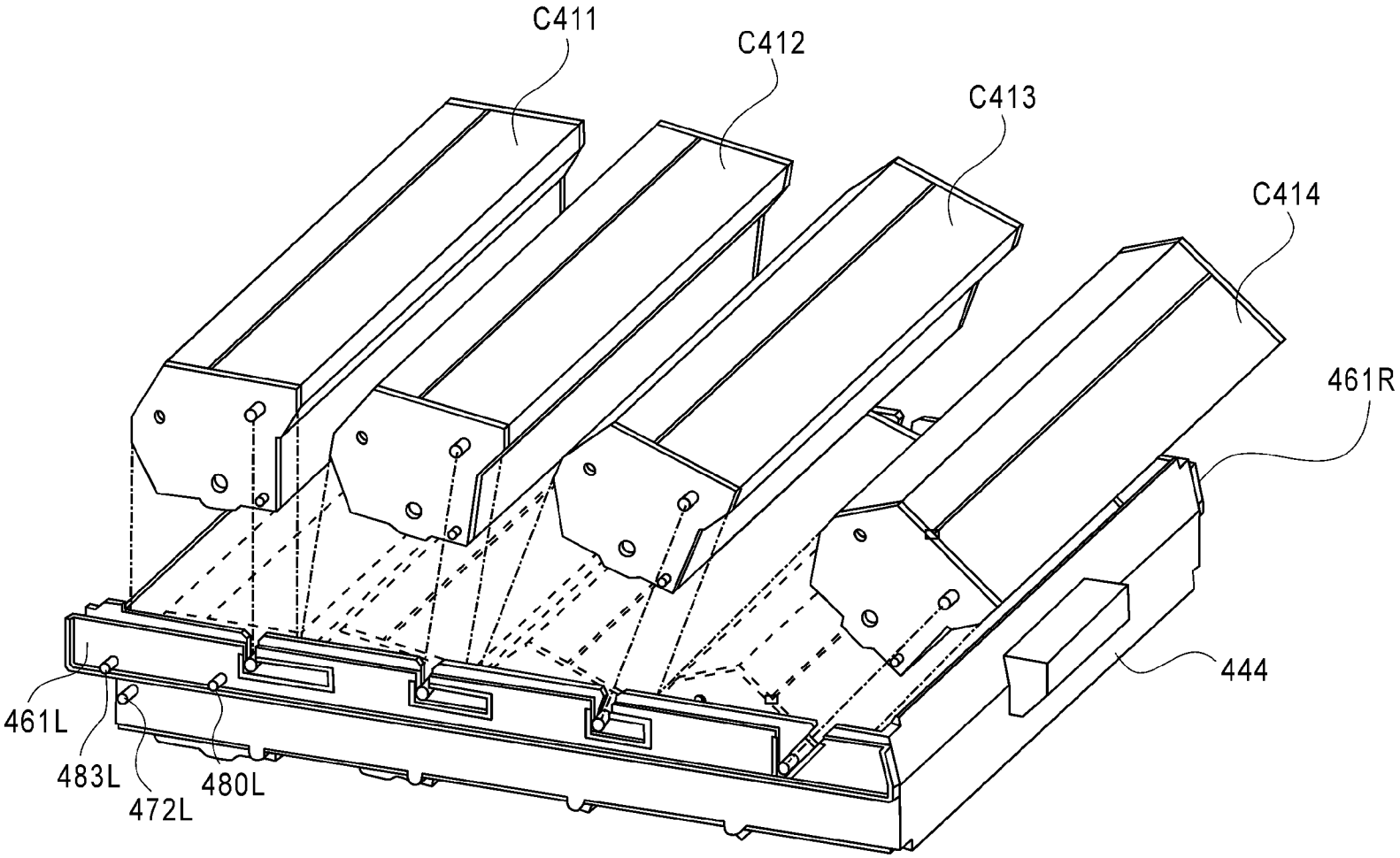
FIGS. 28A and 28B are a perspective view of an outer appearance and a side view, respectively, of the cartridge tray at the outside position.
Figure 28B:
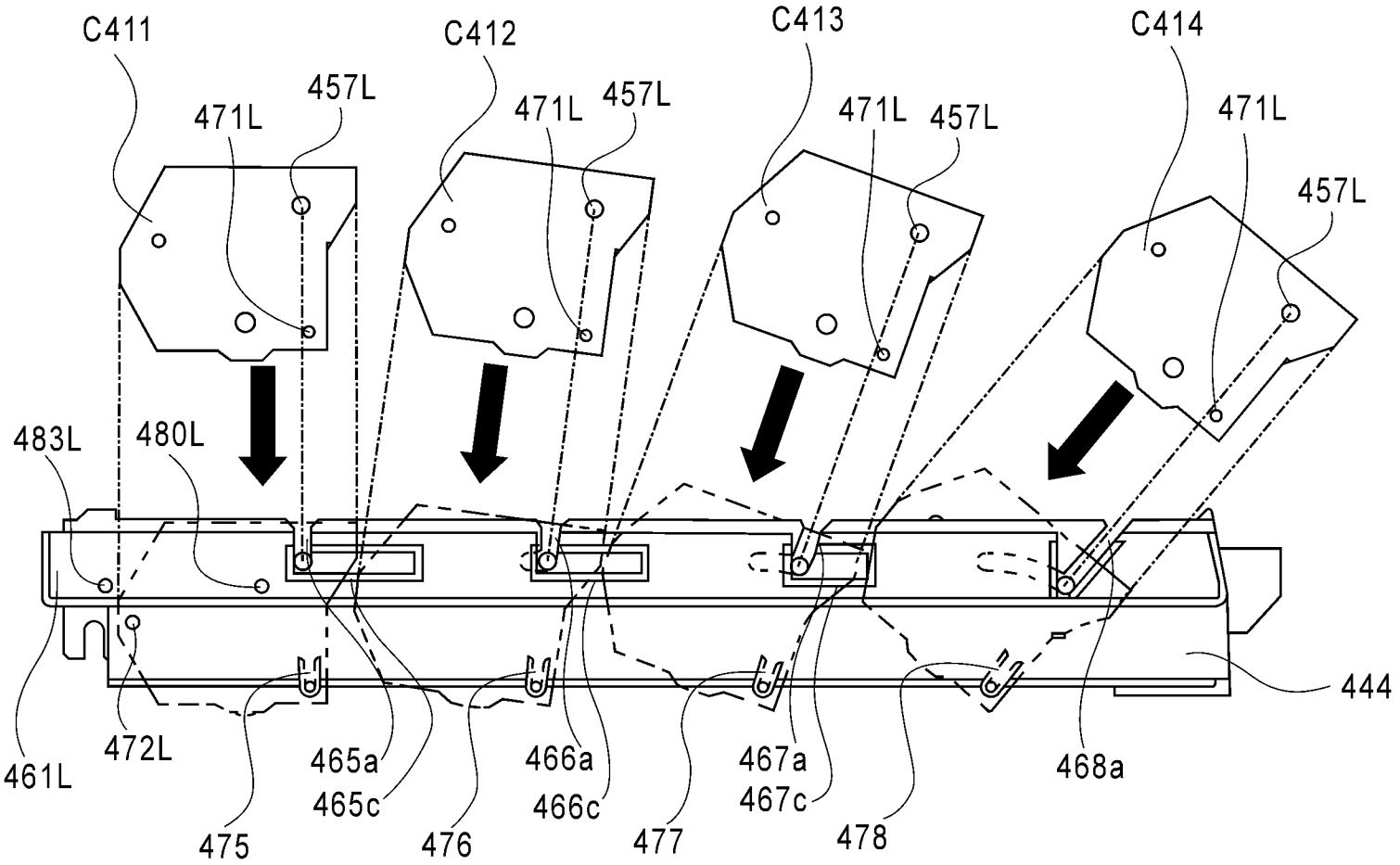
Figure 29A:
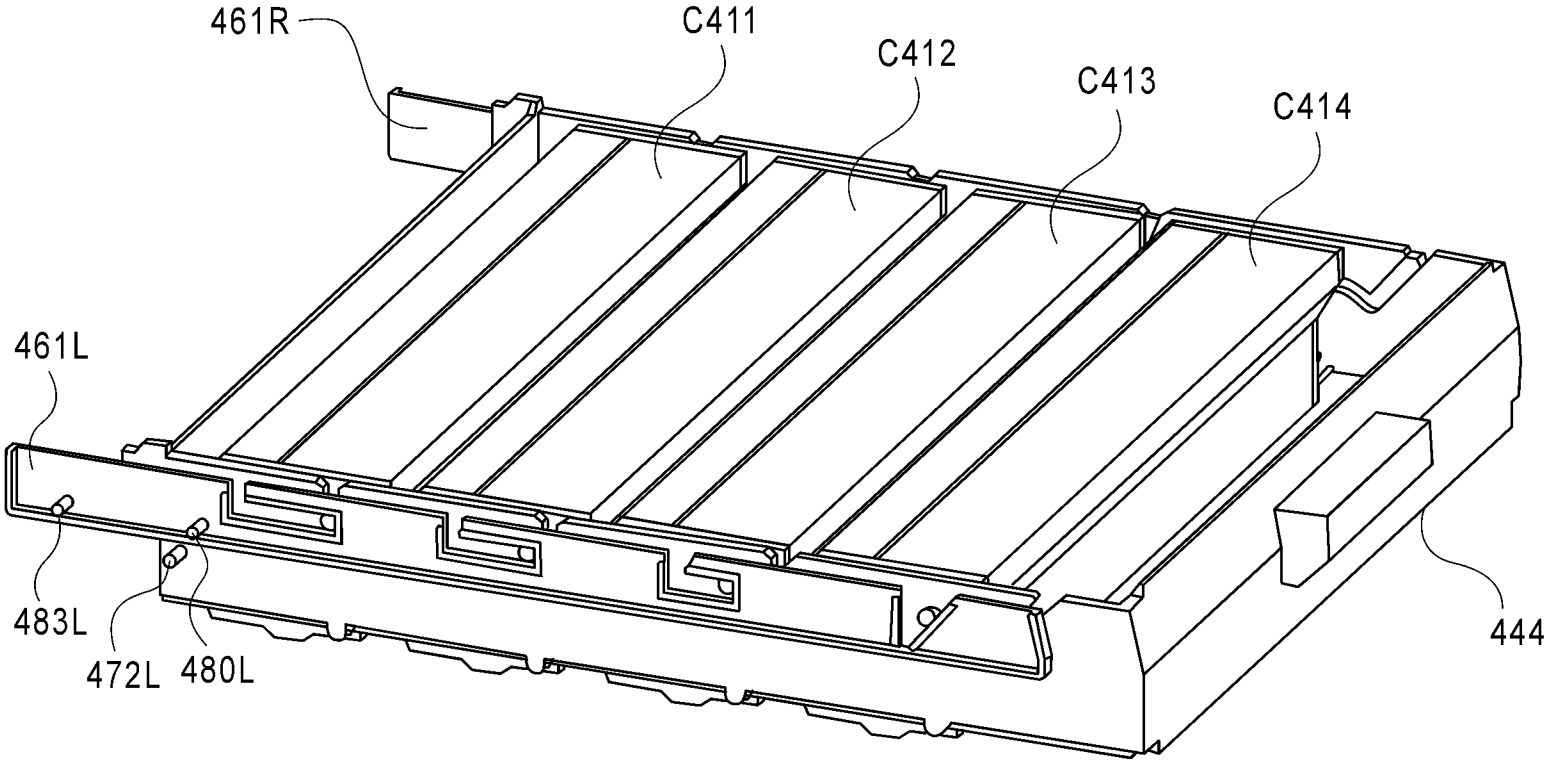
FIGS. 29A and 29B are a perspective view of an outer appearance and a side view, respectively, of the cartridge tray at an image forming position.
Figure 29B:
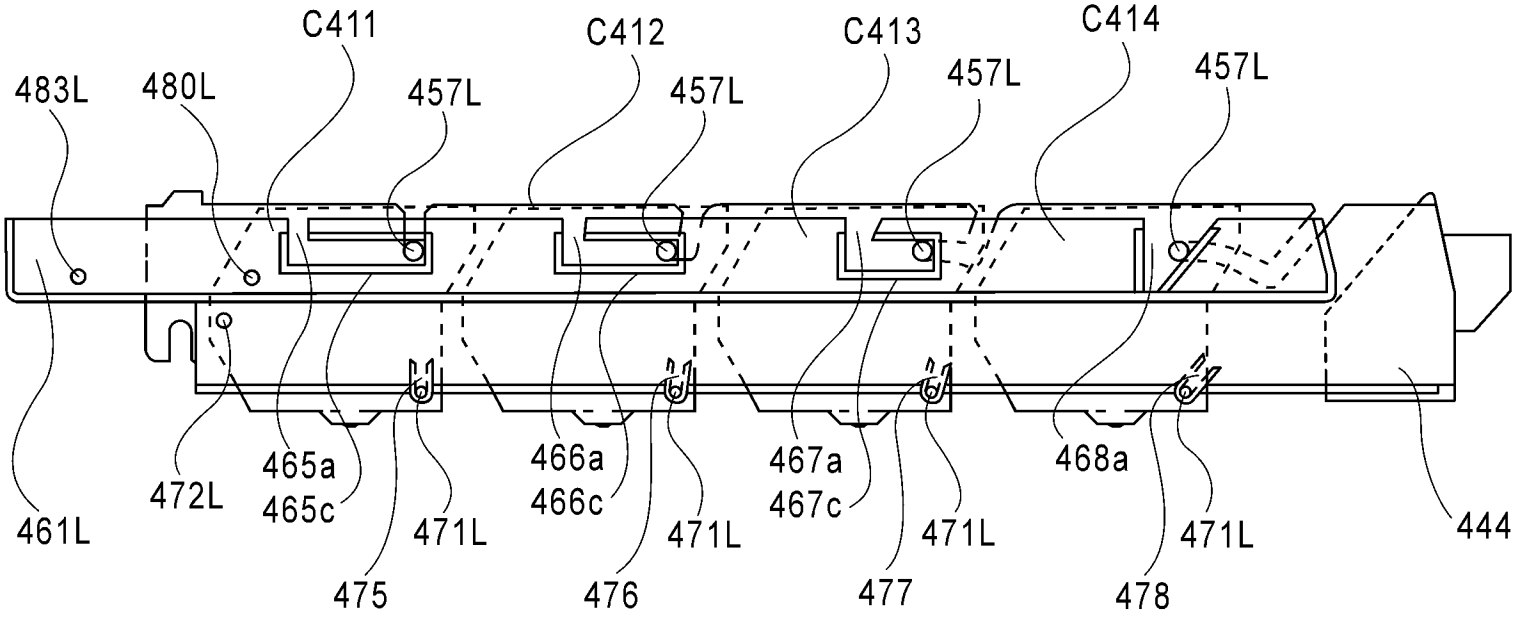

A structure of the cartridge tray 444 will be described with reference to FIGS. 23 and 26 to 29. FIG. 26 is a perspective view of an outer appearance of the cartridge tray 444. FIGS. 27A and 27B are a perspective view of an outer appearance and a side view, respectively, of the cartridge tray 444 at an outside position after pulling-out of the cartridge tray 444. FIGS. 28A and 28B are a perspective view of an outer appearance and a side view, respectively, of the cartridge tray 444 at the outside position during mounting and dismounting of the process cartridges. FIGS. 29A and 29B are a perspective view of an outer appearance and a side view, respectively, of the cartridge tray 444 during image formation.

With reference to FIG. 26, a structure of the cartridge tray 444 will be described. The cartridge tray 444 supports the process cartridges C411, C412, C413 and C414 to the extent that positions of the portions are roughly determined. A right frame portion 444R (driving side) is provided with holes 444*f* and 444*g* through which first and second drive output portions provided in the apparatus main assembly 101 side go in and out of the cartridge tray 444. Further, the right frame portion 444R is provided with engaging portions 445-448 with which the rotation preventing portions 457R are to be engaged, and is provided with rotation center shaft engaging portions 475-478 with which the rotation center shafts 471R are to be engaged.

Further, the left frame portion 444L (non-driving side) is provided with engaging portions 445-448 with which the rotation preventing portions 457L are to be engaged, and is provided with rotation center shaft engaging portions 475-478 with which the rotation center shafts 471L are to be engaged.

The engaging portions 445-448 will be described specifically. The engaging portions 445-448 are different in shape for the respective stations (image forming portions). The engaging portion 445 associated with the process cartridge C441 is provided with an I-shaped groove including a cut-away portion 445*a* and a lower supporting portion 445*b* with respect to a cartridge mounting and dismounting direction.

Further, the engaging portions 446-448 associated with the cartridges C412-C414, respectively, are provided with L-shaped grooves including cut-away portions 446*a*-448*a*, respectively, with respect to the cartridge mounting and dismounting direction and guiding portions 446*c*-448*c*, respectively, with respect to the pulling-out direction. The guiding portions 446*c*-448*c* extending in the pulling-out direction are different in length for the respective stations. Further, supporting portions (recessed portions) 446*b*-448*b* are provided at corners of the associated L-shaped grooves.

The above-described four cut-away portions are disposed at positions so that adjacent process cartridges do not overlap with each other with respect to the up-down direction as the mounting and dismounting direction. The shapes of the engaging portions 445-448 are the same between the driving side and the non-driving side.

(Mounting and Dismounting of Process Cartridge)

Mounting of the process cartridges into the cartridge tray 444 will be described with reference to FIGS. 26-29.

Each of the process cartridges C411, C412, C413 and C414 is inserted into the cartridge tray 444 from an arrow direction in a drop-in manner. When the process cartridge C is gradually inserted, the driving side rotation preventing portion 457R and the non-driving side rotation preventing portion 457L are engaged with the associated ones of the engaging portions 445-448 provided in the cartridge tray 444 side. Then, the rotation center shafts 471L and 471R are gradually engaged with the associated ones of the rotation center shaft engaging portions 475-478 (FIG. 28). Further, when the process cartridge is moved downward so as to be accommodated in the cartridge tray 444, the rotation preventing portions 457R and 457L abut against the associated ones of the supporting portions 445*b*-448*b* of the engaging portions, thus being positioned.

In this way, the cartridge tray 444 positions and supports the cartridge at a position where the adjacent process cartridge does not overlap with the cartridge with respect to the up-down direction (FIG. 27). As a result, as shown in FIG. 23, the cartridge tray 444 supports the respective process cartridges so as to be dismountable in the arrow directions.

When the cartridge tray 444 is moved to the accommodating position of the apparatus main assembly 101, in interrelation with the movement of the cartridge tray 444, the rotation preventing portions 457R and 457L are pushed by guiding rails 461R and 461L provided in the cartridge tray 444, and are moved along the guiding portions in the pulling-out direction. As a result, the pitch between the drums with respect to the process cartridges C411, C412, C413 and C414 is decreased (FIG. 29).

With reference to FIGS. 27 and 28, the guiding rail 461 will be described specifically, the guiding rail 461 is slidably held by the cartridge tray 444. Further, the frame 461 is provided with guiding rail engaging portions 465-468 each with which the associated rotation preventing portion 457 is engaged. The guiding rail engaging portions 465-468 are different in shape for the respective stations.

The guiding rail engaging portion 468 associated with the process cartridge C414 is provided with a V-shaped groove including a cut-away portion 468*a* with respect to the cartridge mounting and dismounting direction.

Further, the engaging portions 465-467 associated with the cartridges C411 and C413, respectively, are provided with L-shaped grooves including cut-away portions 465*a* and 467*a*, respectively, with respect to the cartridge mounting and dismounting direction and guiding portions 465*c*-467*c*, respectively, with respect to the pulling-out direction. The guiding portions 465*c*-467*c* extending in the pulling-out direction are different in length for the respective stations. The above-described three cut-away portions are disposed at positions so that adjacent process cartridges do not overlap with each other with respect to the mounting and dismounting direction. The shapes of the guiding rails are the same between the driving side guiding rail and the non-driving side guiding rail.

With reference to FIG. 30, an operation for moving the process cartridges C411, C412, C413 and C414 to an inside position of the apparatus main assembly by the guiding rails 461 will be described.

Figure 30A:
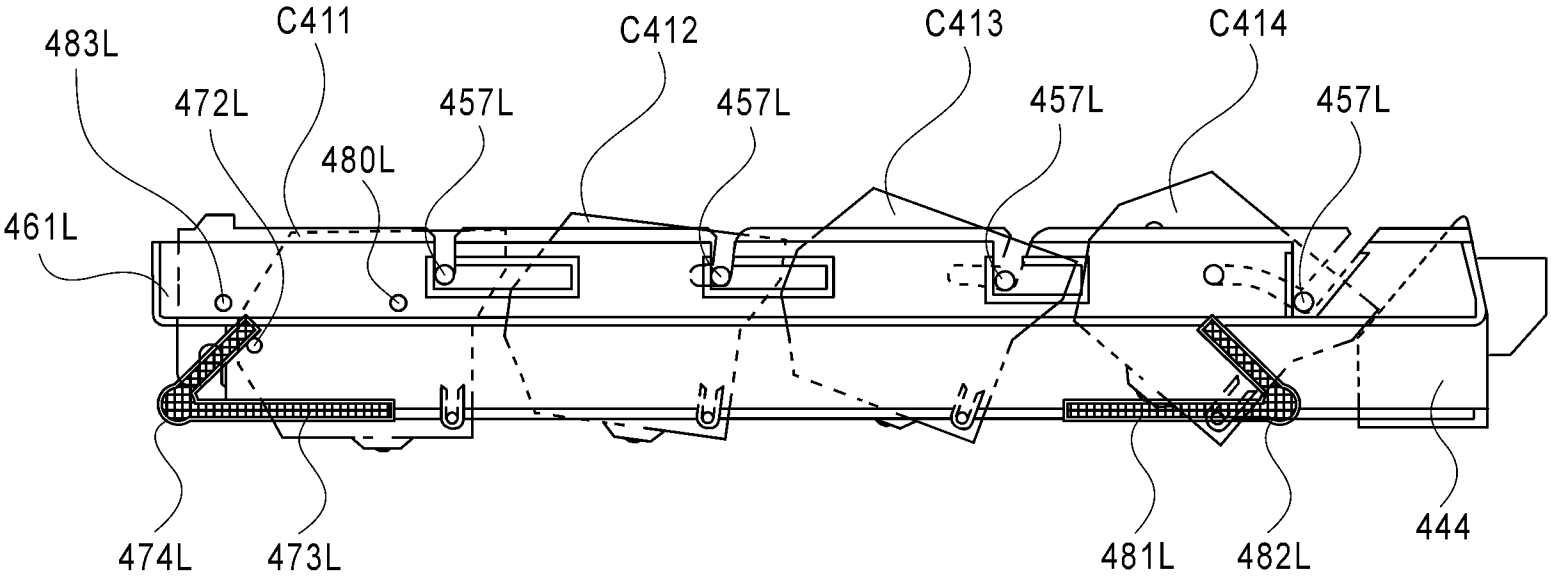
FIGS. 30A, 30B and 30C are side views for illustrating an operation for moving the cartridge tray to an inside position.
Figure 30B:
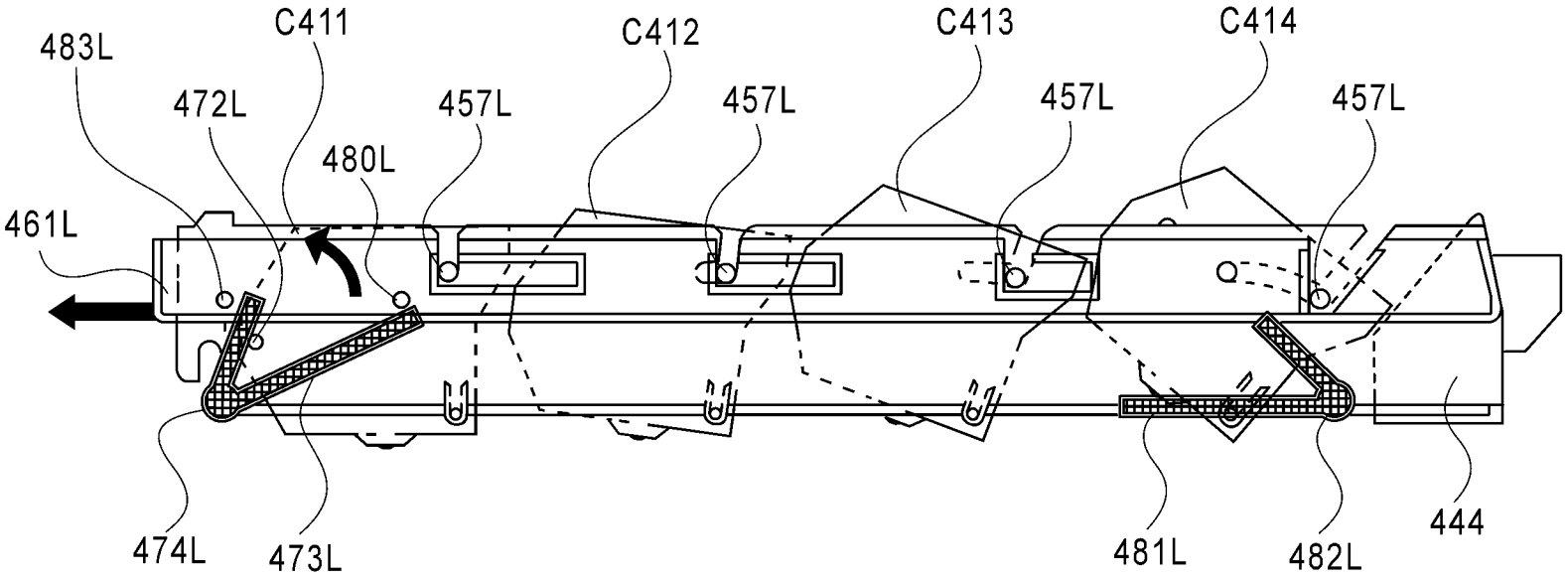

When the cartridge tray 444 is moved toward the accommodating portion, as the inside position, of the apparatus main assembly, an abutting portion 472L provided in the cartridge tray 444 contacts a guiding rail urging member 473L, and the guiding rail urging member 473L rotates about a rotation center 474L (FIG. 30A). When the cartridge tray 444 is further moved toward the inside of the apparatus main assembly, the rotated guiding rail urging member 473L contacts an abutting portion 480L of the guiding rail 461 to start further pushing of the guiding rail 461 into the inside of the apparatus main assembly in an arrow direction (FIG. 30B).

Figure 30C:
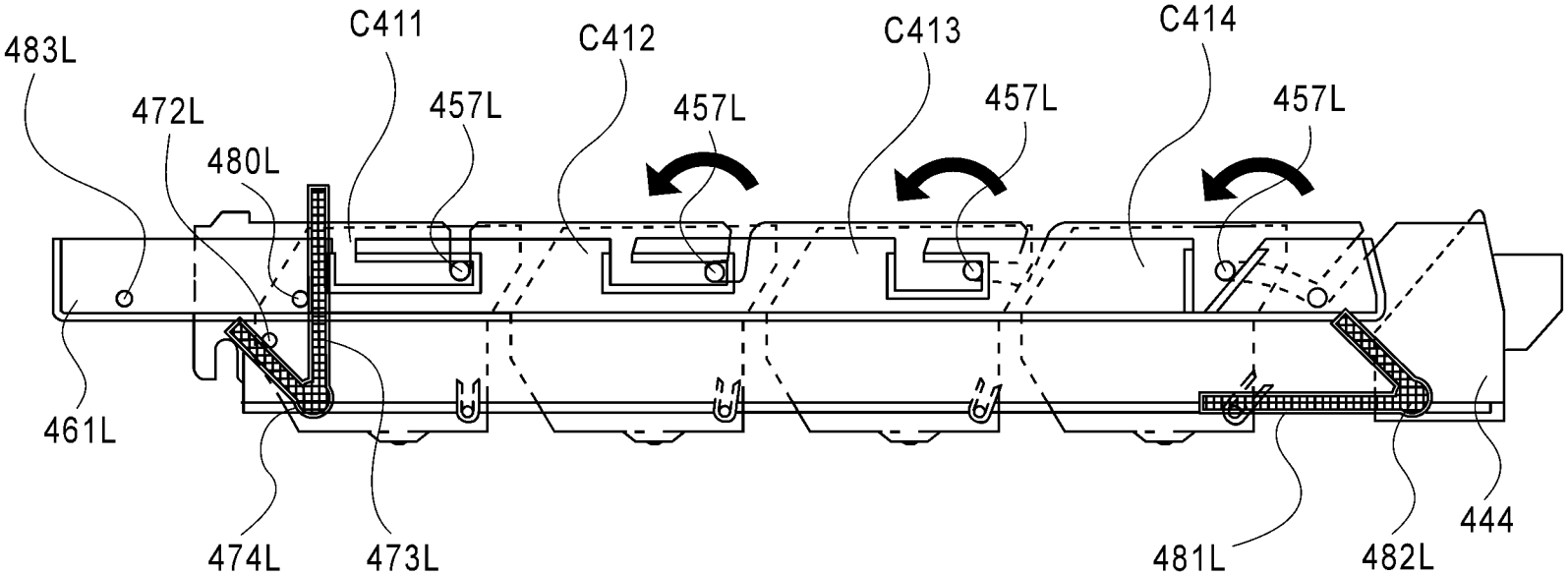

As a result, the guiding rail engaging portions 465-468 start pushing of the rotation preventing portions 457 to rotate the process cartridges C412-C414 in arrow directions, thus decreasing the pitches each between the associated drums (FIG. 30C).

With reference to FIG. 31, an operation for moving the process cartridges C411, C412, C413 and C414 to the outside position of the apparatus main assembly by the guiding rails 461 will be described.

Figure 31A:
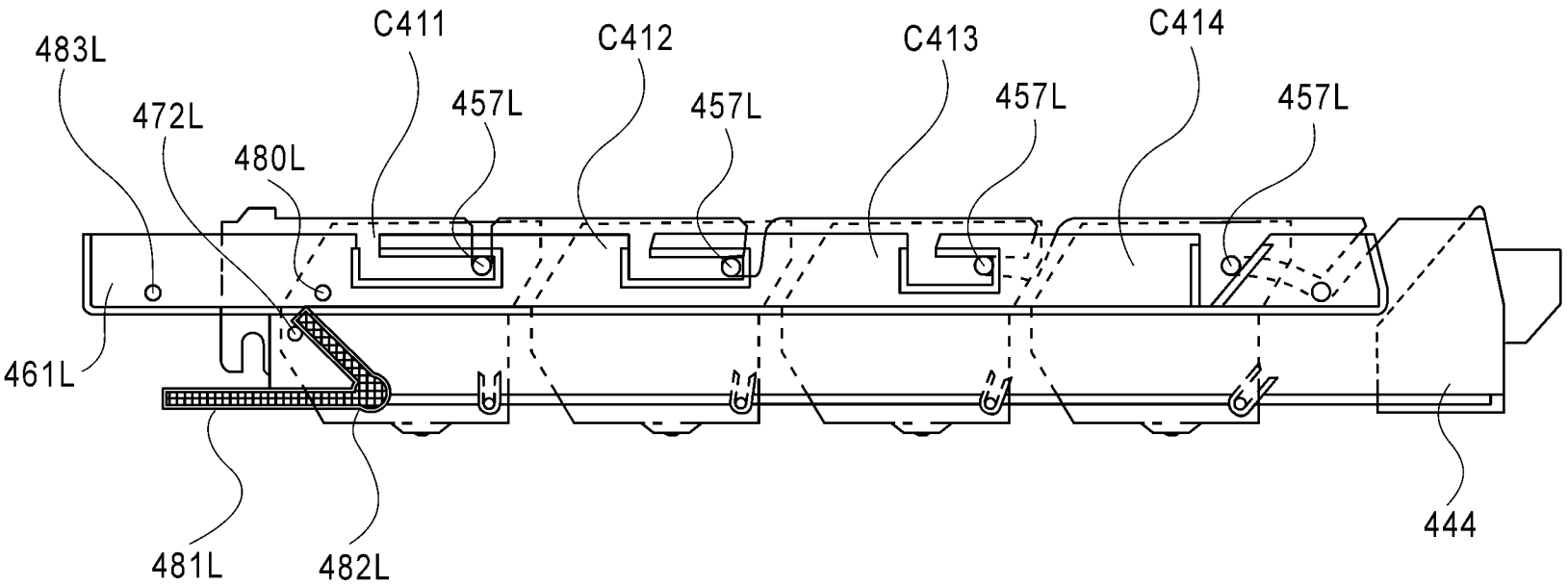
FIGS. 31A, 31B and 31C are side views for illustrating an operation for moving the cartridge tray to the outside position.
Figure 31B:
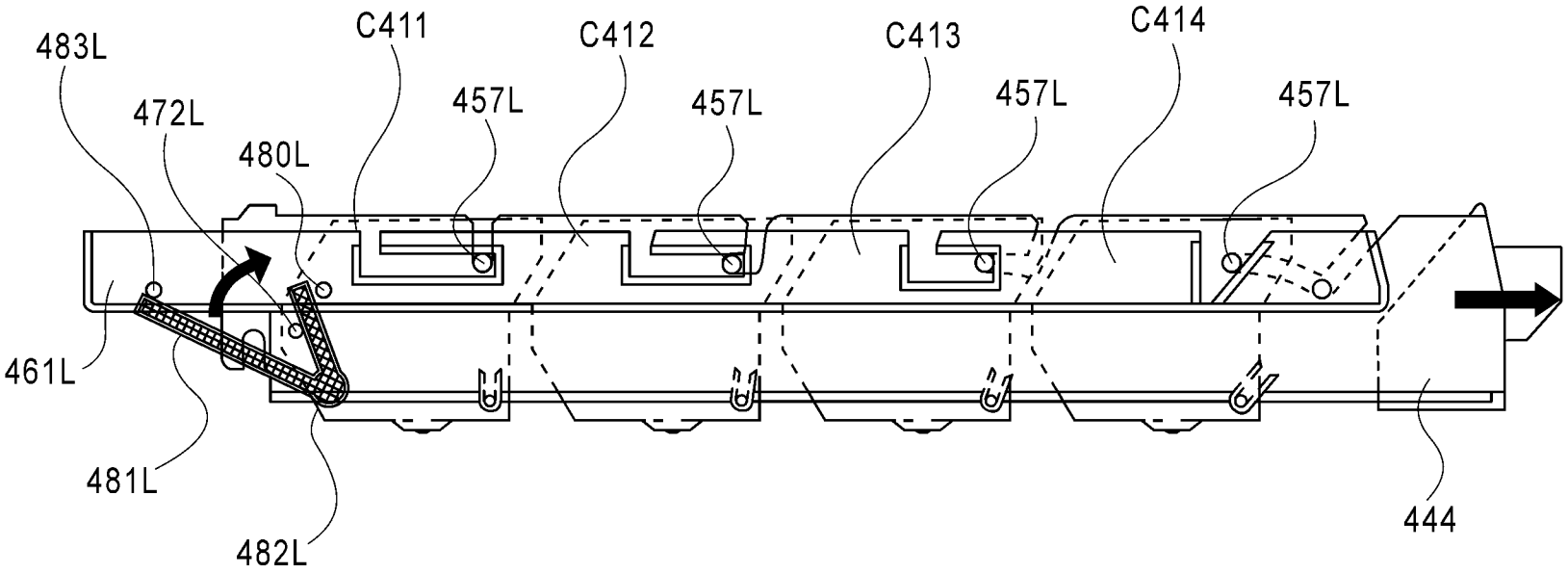

When the cartridge tray 444 is moved toward the accommodating portion, as the outside position, of the apparatus main assembly, an abutting portion 472L provided in the cartridge tray 444 contacts a guiding rail urging member 481L, and the guiding rail urging member 481L rotates about a rotation center 482L (FIG. 31A). When the cartridge tray 444 is further moved toward the outside of the apparatus main assembly, the rotated guiding rail urging member 481L contacts an abutting portion 483L of the guiding rail 461 to start further pushing of the guiding rail 461 to the outside of the apparatus main assembly in an arrow direction (FIG. 31B).

Figure 31C:
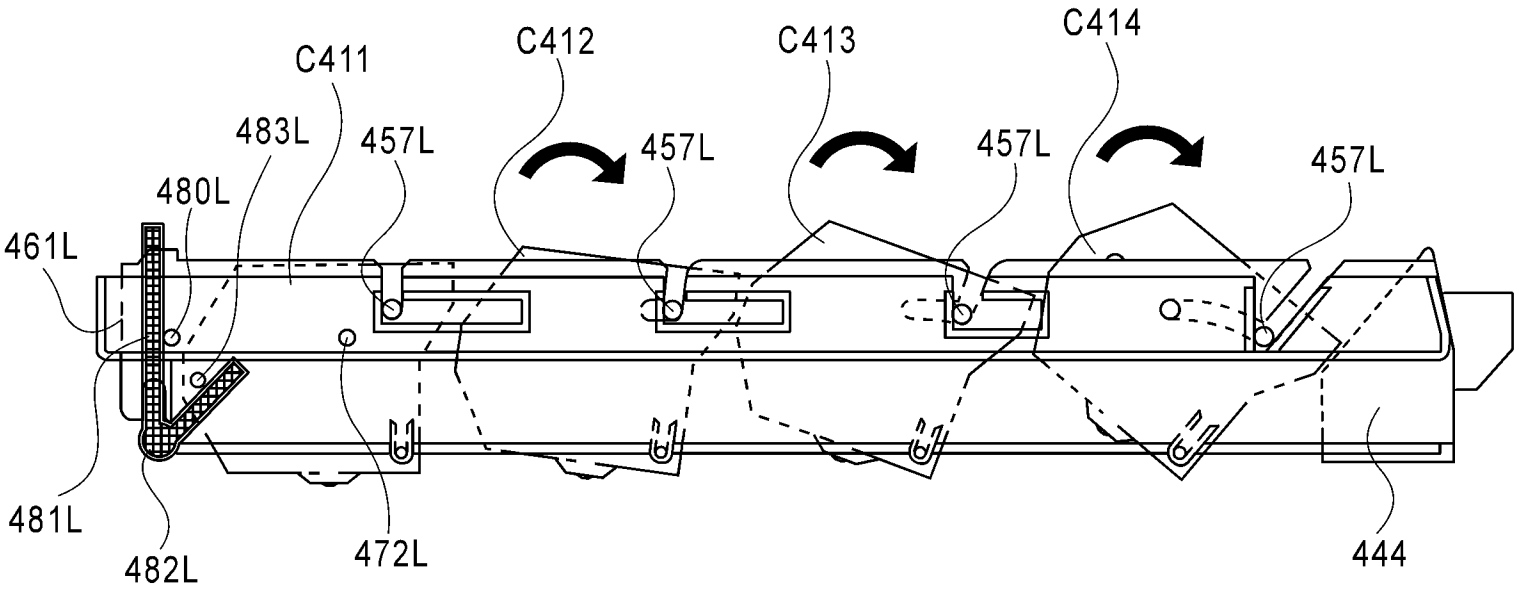

As a result, the guiding rail engaging portions 465-468 start pushing of the rotation preventing portions 457 to rotate the process cartridges C412-C414 in arrow directions, thus increasing the pitches each between the associated drums (FIG. 31C).

In this way, the cartridge tray 444 is provided with the engaging portions, and in interrelation with the pulling-out operation of the tray 444, a pitch between the process cartridges and the pitch between the photosensitive drums are broadened (increased). As a result, it is possible to ensure a mounting locus without causing interference between the adjacent process cartridges with each other during mounting and dismounting of the process cartridge. Further, the process cartridge can be pulled out (dismounted) in arrow directions of FIGS. 22 and 23, so that usability is improved. Further, during the mounting of the cartridge into the apparatus main assembly, the pitch between the photosensitive drums is narrowed (decreased), and therefore FPOT can be shortened.

Further, in Embodiment 4, although the description is made based on an ITB (intermediary transfer belt) type using the intermediary transfer belt, also in an image forming apparatus of an ETB (electrostatic transfer belt) type using an electrostatic conveying belt (FIG. 12), a similar effect can be obtained by employing a similar constitution.

<Embodiment 5>

Embodiment 5 of the present invention will be described with reference to FIGS. 32-39. An image forming apparatus 100 in this embodiment is similar to the image forming apparatus 100 in Embodiment 4, and constituent elements similar to those in Embodiment 1 will be omitted from description by adding the same reference numerals or symbols. In this embodiment, first to fourth process cartridges C511, C512, C513 and C514, and a cartridge tray 544 are used.

(Mounting and Dismounting Method of Process Cartridge)

Figure 32:
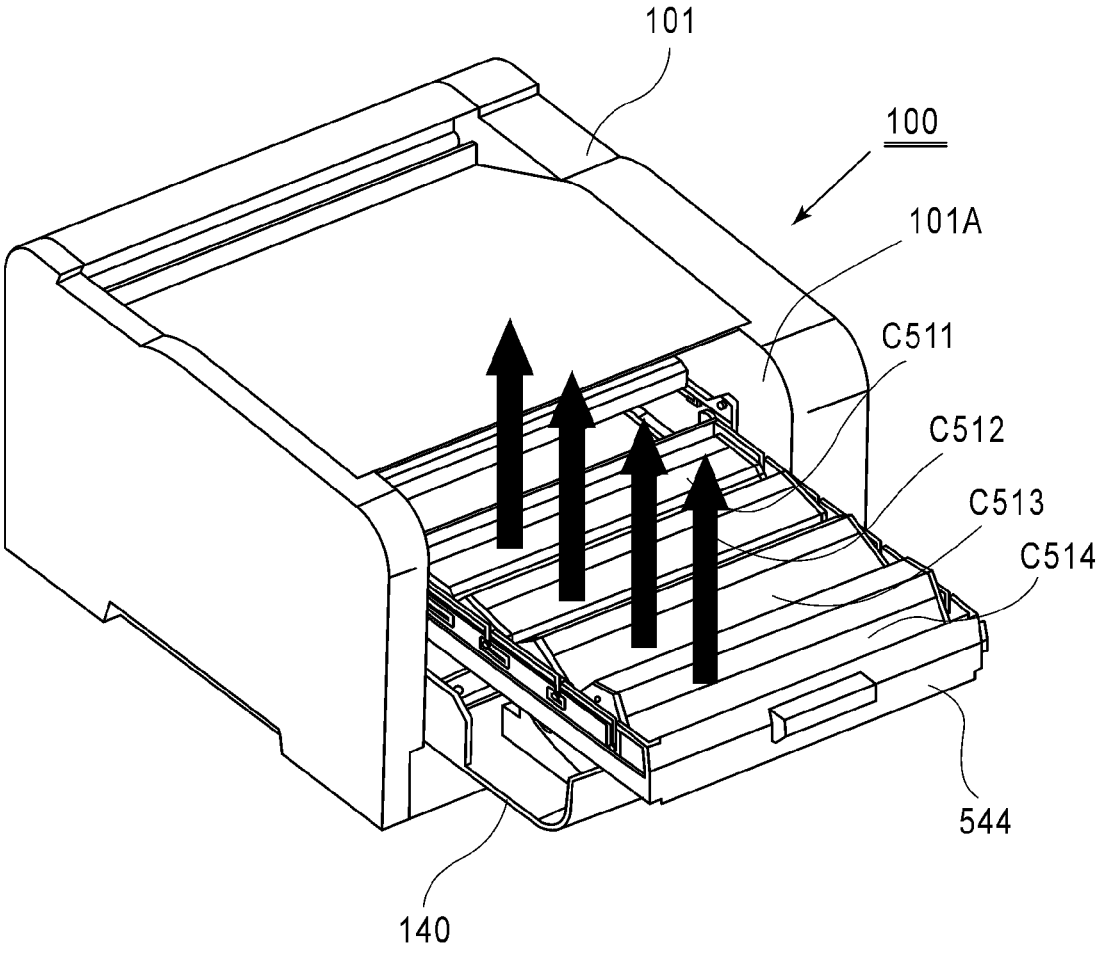
FIG. 32 is a perspective view of an outer appearance of an image forming apparatus in Embodiment 5 in a state in which a cartridge tray is pulled out.
Figure 33:
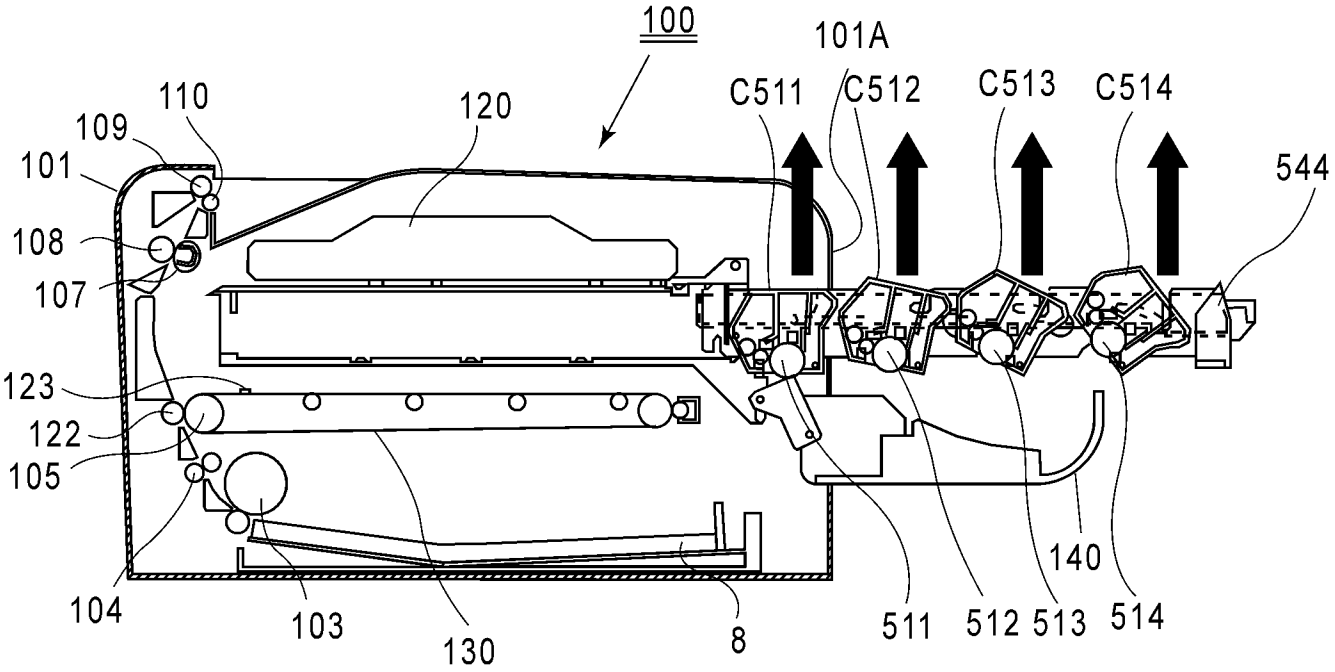
FIG. 33 is a longitudinal schematic side view of the image forming apparatus in the state in which the cartridge tray is pulled out.

An outline of a process cartridge mounting and dismounting method will be described with reference to FIGS. 32 and 33. FIGS. 32 and 33 are schematic views for illustrating exchange (replacement) of process cartridges, in which FIG. 32 is a perspective view of an outer appearance of the image forming apparatus 100 in a state in which the tray 544 is pulled out to an outside position, and FIG. 33 is a longitudinal schematic side view of the image forming apparatus 100 in the state.

As shown in FIGS. 32 and 33, when the cartridge tray 544 is pulled out from the apparatus main assembly 101, an upper surface of each of the process cartridges is exposed (opened). Further, in interrelation with the pulling-out operation of the cartridge tray 544, a pitch between adjacent two photosensitive drums of the respective process cartridges is increased. As a result, a mounting locus along which the process cartridges do not interfere with each other can be ensured, so that each of the process cartridges C511, C512, C513 and C514 is dismountable in an arrow direction. A method of changing the pitch between the photosensitive drums will be described later specifically. Further, when the process cartridges C511, C512, C513 and C514 are mounted in the apparatus main assembly 101, a reverse procedure is performed.

(Structure of Cartridge Tray)

Figure 34:
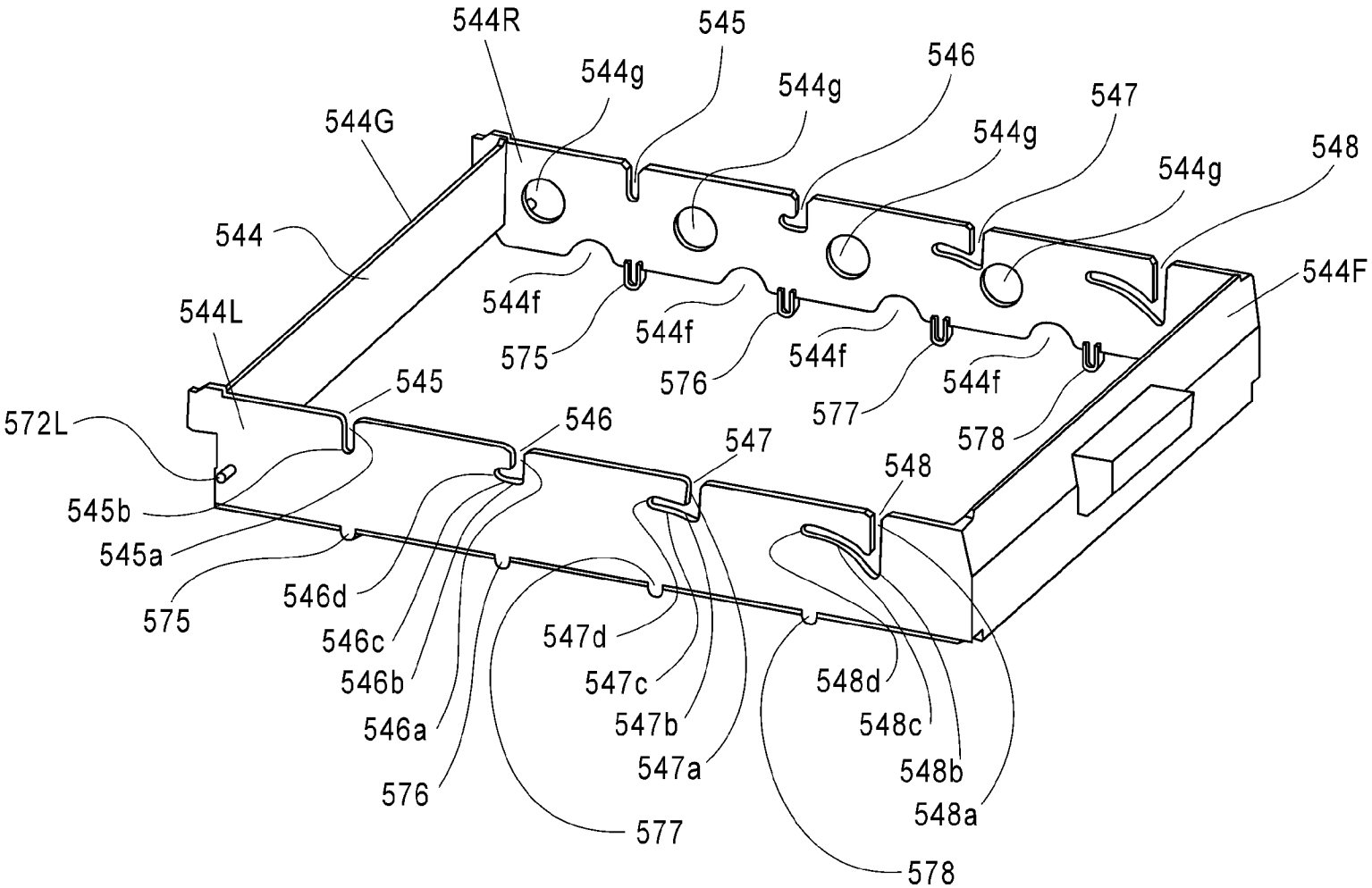
FIG. 34 is a perspective view of an outer appearance of the cartridge tray.
Figure 35A:
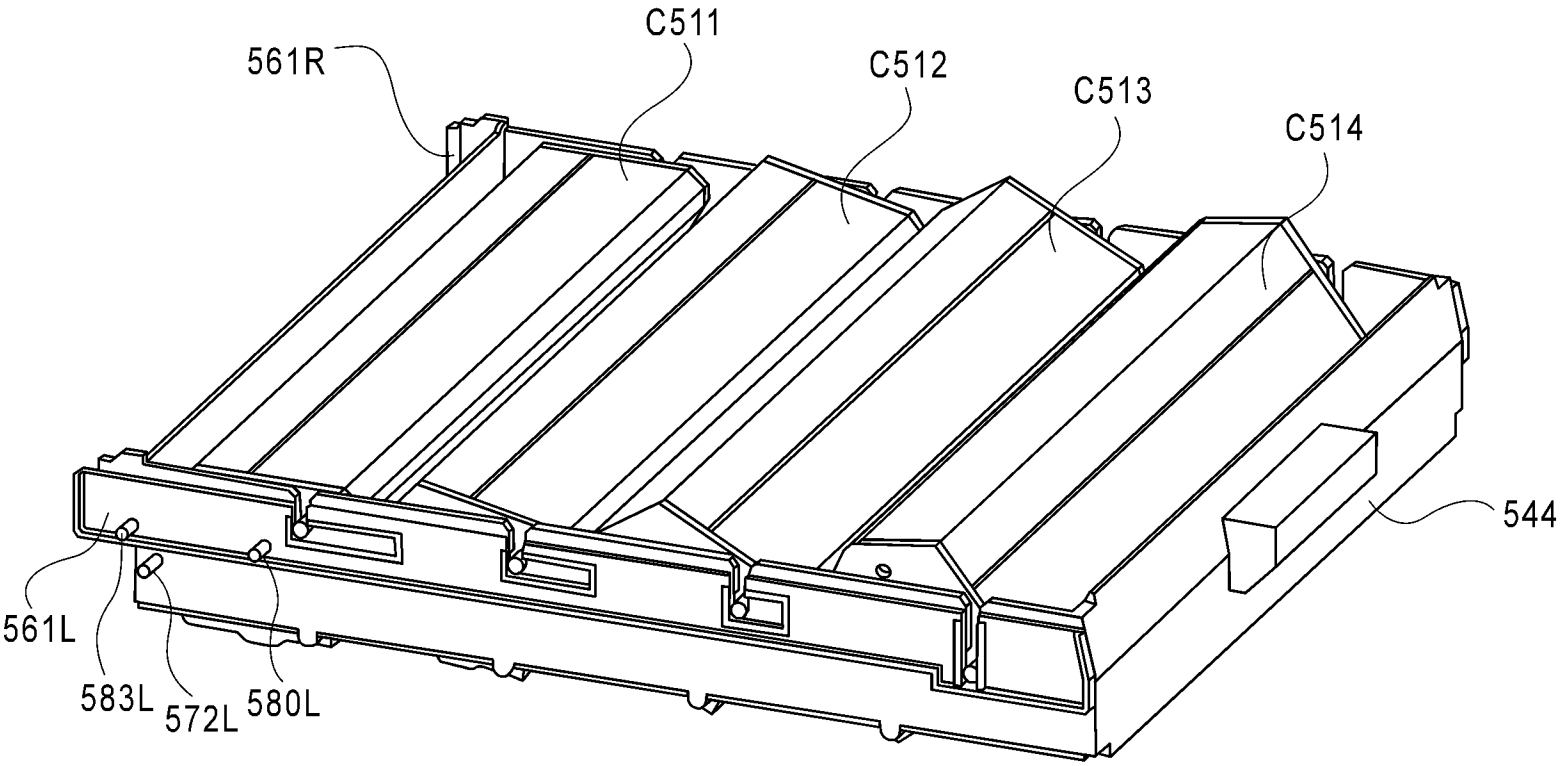
FIGS. 35A and 35B are a perspective view of an outer appearance and a side view, respectively, of the cartridge tray at an outside position.
Figure 35B:
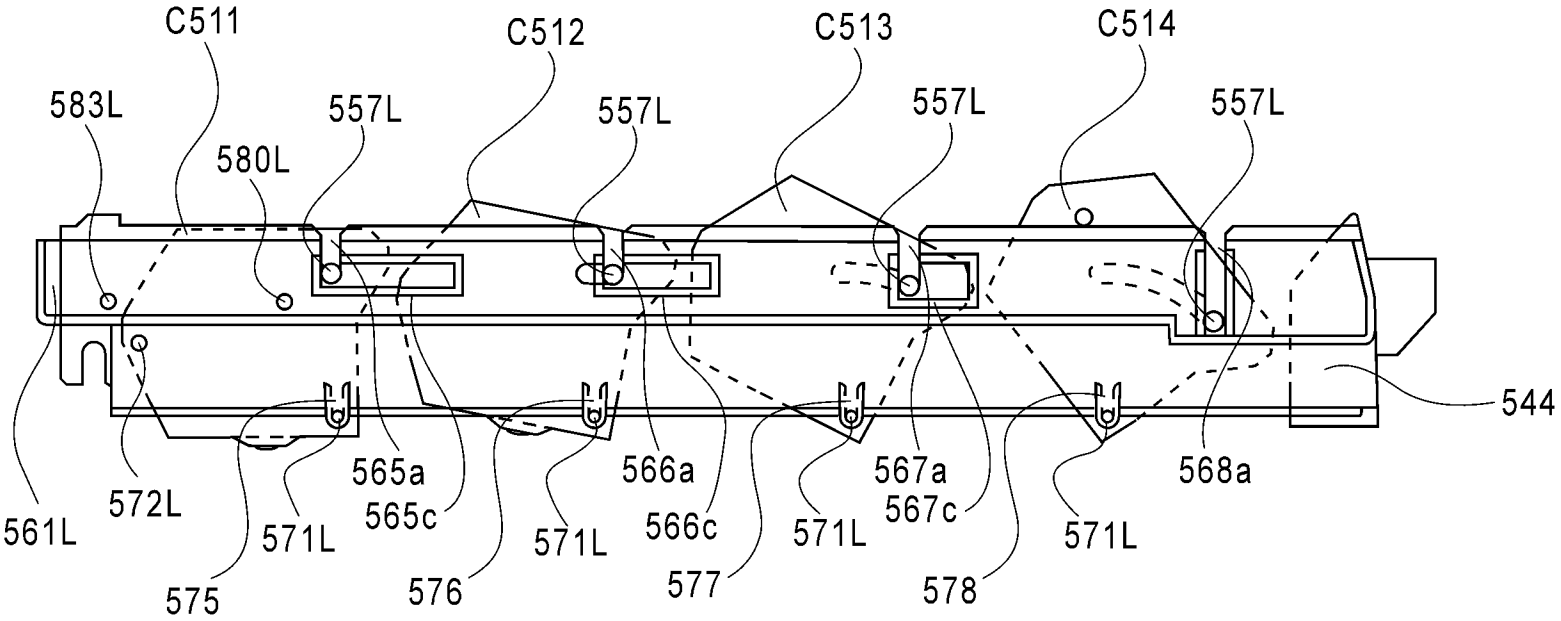
Figure 36A:
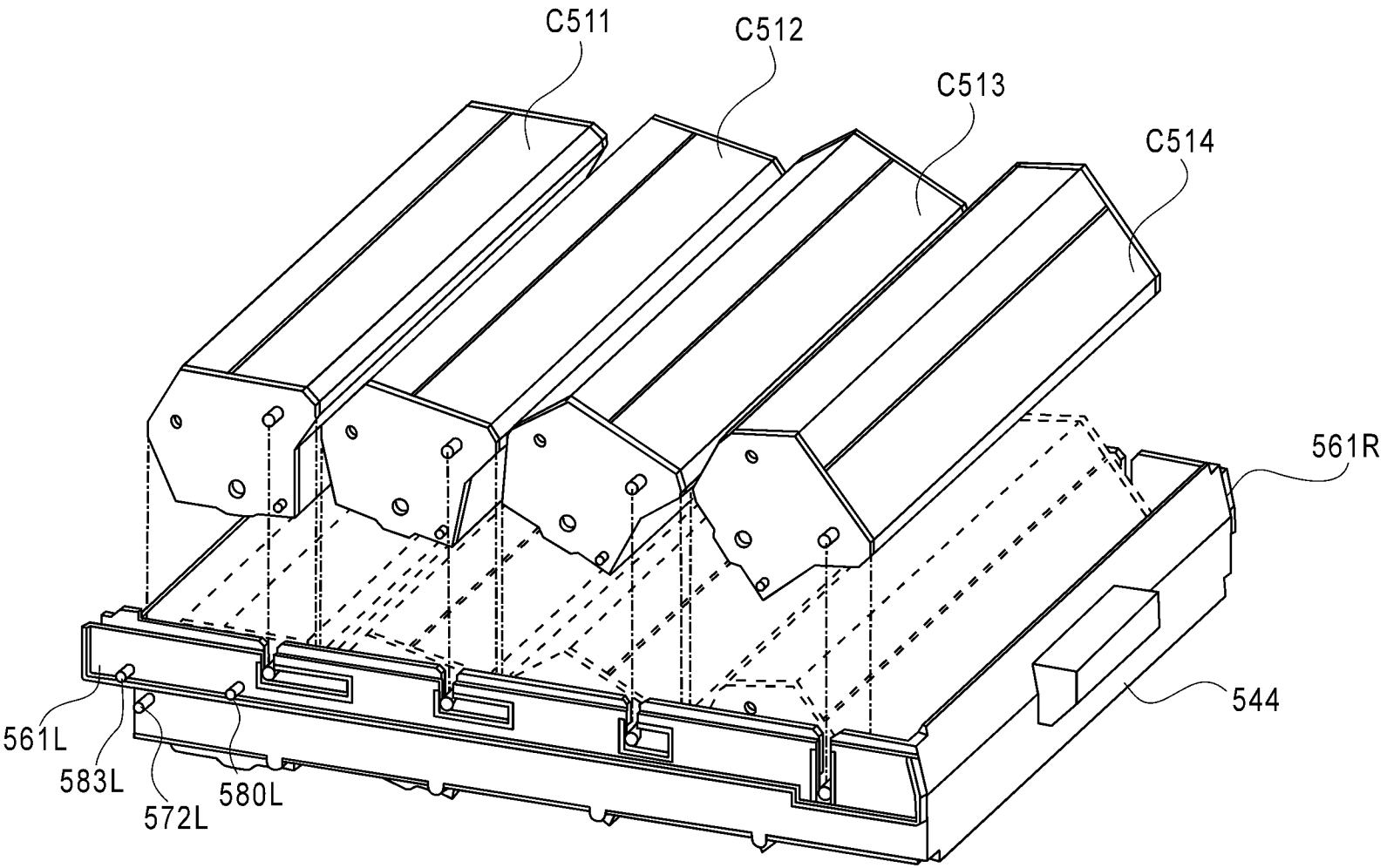
FIGS. 36A and 36B are a perspective view of an outer appearance and a side view, respectively, of the cartridge tray at the outside position.
Figure 36B:
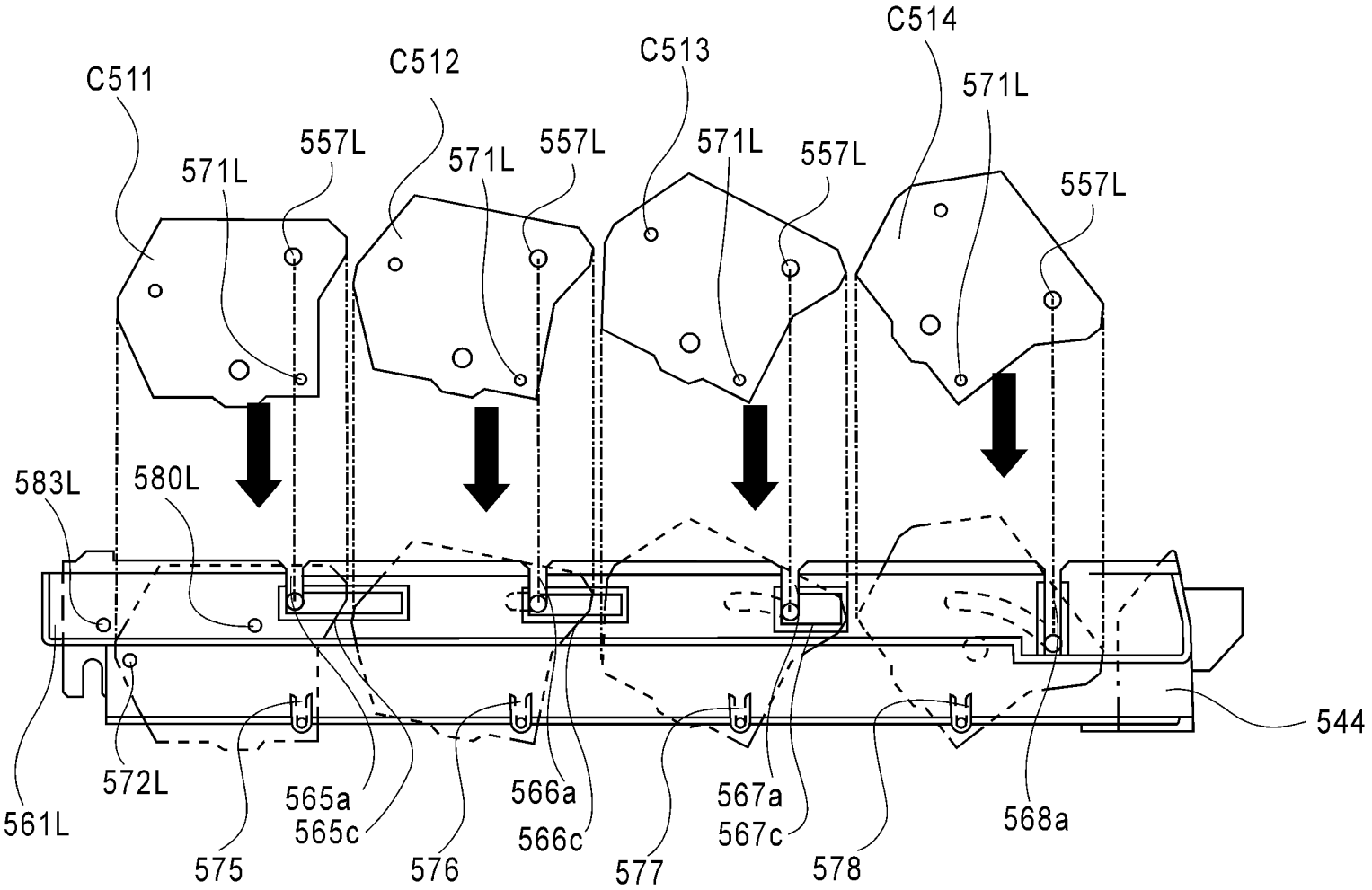
Figure 37A:
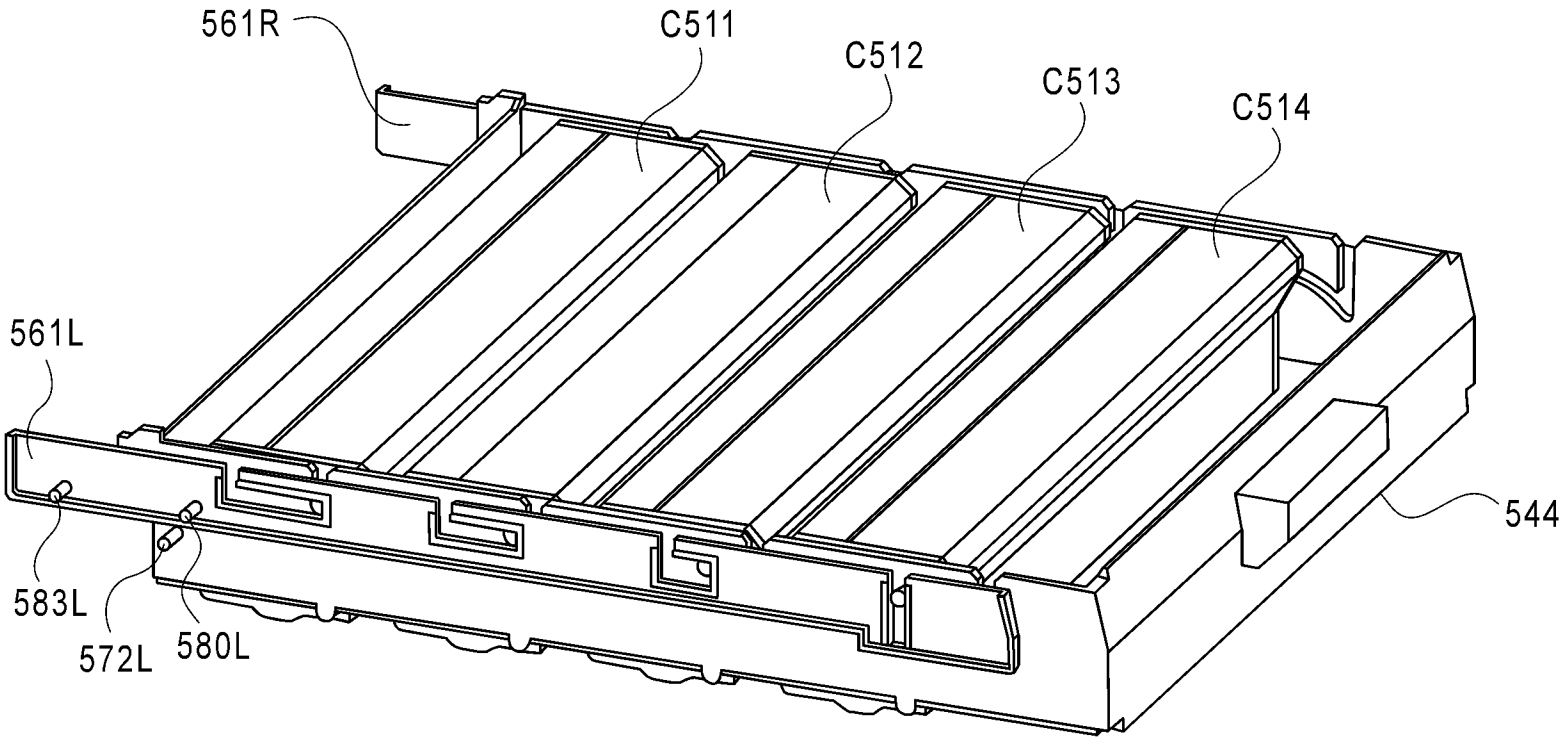
FIGS. 37A and 37B are a perspective view of an outer appearance and a side view, respectively, of the cartridge tray at an image forming position.
Figure 37B:
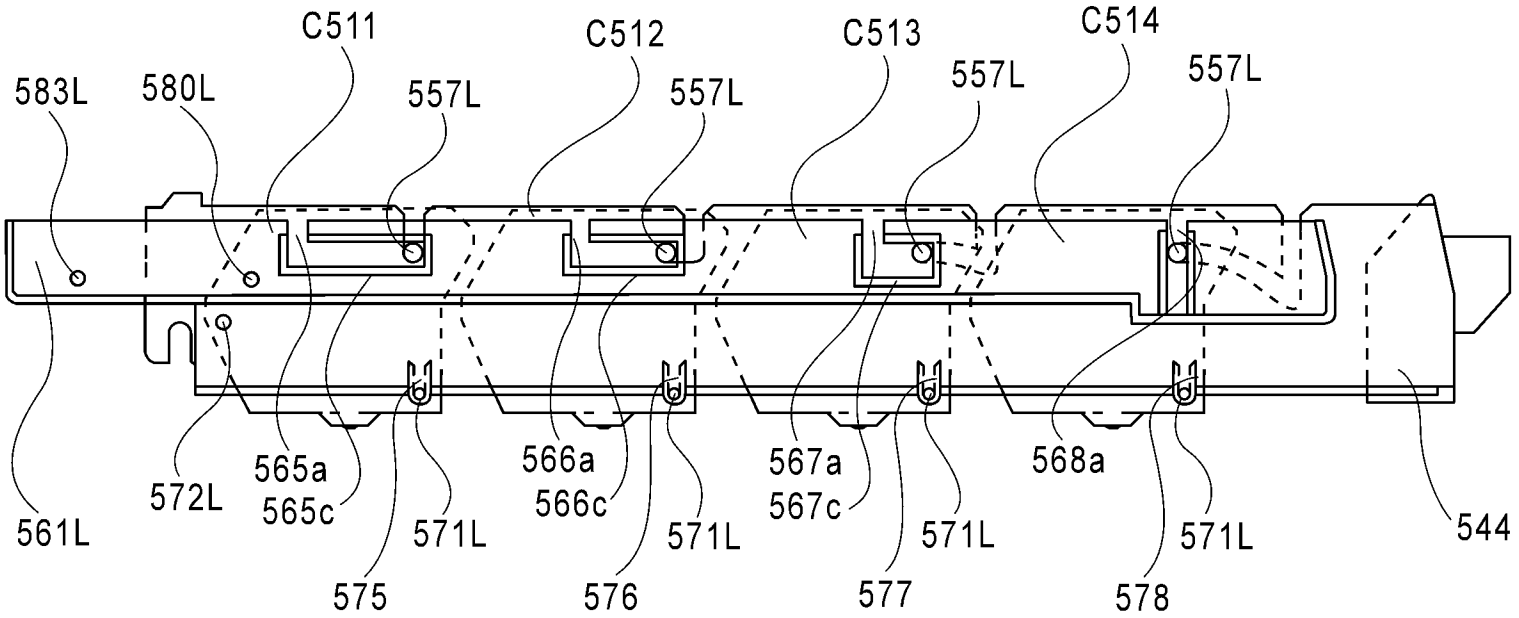

A structure of the cartridge tray 544 will be described with reference to FIGS. 33-37. FIG. 33 is a schematic sectional view of the image forming apparatus at the outside position after the cartridge tray 544 is pulled out. FIG. 34 is a perspective view of an outer appearance of the cartridge tray 544. FIGS. 35A and 35B are a perspective view of an outer appearance and a side view, respectively, of the cartridge tray 544 at an outside position after pulling-out. FIGS. 36A and 36B are a perspective view of an outer appearance and a side view, respectively, of the cartridge tray 544 during the pulling-out. FIGS. 37A and 37B are a perspective view of an outer appearance and a side view, respectively, of the cartridge tray 544 during image formation.

With reference to FIG. 34, a structure of the cartridge tray 544 will be described. The cartridge tray 544 supports the process cartridges C511, C512, C513 and C514 to the extent that positions of the portions are roughly determined. A right frame portion 544R (driving side) is provided with holes 544*f* and 544*g* through which first and second drive output portions provided in the apparatus main assembly 101 side go in and out of the cartridge tray 544. Further, the right frame portion 544R is provided with engaging portions 545-548 with which the rotation preventing portions 557R are to be engaged, and is provided with rotation center shaft engaging portions 575-578 with which the rotation center shafts 571R are to be engaged.

Further, the left frame portion 544L (non-driving side) is provided with engaging portions 545-548 with which the rotation preventing portions 557L are to be engaged, and is provided with rotation center shaft engaging portions 575-578 with which the rotation center shafts 571L are to be engaged.

The engaging portions 545-548 will be described specifically. The engaging portions 545-548 are different in shape for the respective stations (image forming portions). The engaging portion 545 associated with the process cartridge C541 is provided with an I-shaped groove including a cut-away portion 545*a* and a lower supporting portion 545*b* with respect to a cartridge mounting and dismounting direction.

Further, the engaging portions 546-548 associated with the cartridges C512-C514, respectively, are provided with L-shaped grooves including cut-away portions 546*a*-548*a*, respectively, with respect to the cartridge mounting and dismounting direction and guiding portions 546*c*-548*c*, respectively, with respect to the pulling-out direction. The guiding portions 546*c*-548*c* extending in the pulling-out direction are different in length for the respective stations. Further, supporting portions (recessed portions) 546*b*-548*b* are provided at corners of the associated L-shaped grooves.

The above-described four cut-away portions are disposed at positions so that adjacent process cartridges do not overlap with each other with respect to the up-down direction as the mounting and dismounting direction. The shapes of the engaging portions 545-548 are the same between the driving side and the non-driving side.

(Mounting and Dismounting of Process Cartridge)

Mounting of the process cartridges into the cartridge tray 544 will be described with reference to FIGS. 34-37.

Each of the process cartridges C511, C412, C513 and C514 is inserted into the cartridge tray 544 from an arrow direction in a drop-in manner. When the process cartridge C is gradually inserted, the driving side rotation preventing portion 557R and the non-driving side rotation preventing portion 557L are engaged with the associated ones of the engaging portions 545-548 provided in the cartridge tray 544 side. Then, the rotation center shafts 571L and 571R are gradually engaged with the associated ones of the rotation center shaft engaging portions 575-578 (FIG. 36). Further, when the process cartridge is moved downward so as to be accommodated in the cartridge tray 544, the rotation preventing portions 557R and 557L abut against the associated ones of the supporting portions 545*b*-548*b* of the engaging portions, thus being positioned.

In this way, the cartridge tray 544 positions and supports the cartridge at a position where the adjacent process cartridge does not overlap with the cartridge with respect to the up-down direction (FIG. 35). As a result, as shown in FIG. 33, the cartridge tray 544 supports the respective process cartridges so as to be dismountable in the arrow directions.

When the cartridge tray 444 is moved to the accommodating position of the apparatus main assembly 101, in interrelation with the movement of the cartridge tray 544, the rotation preventing portions 557R and 557L are pushed by guiding rails 561R and 561L provided in the cartridge tray 544, and are moved along the guiding portions in the pulling-out direction. As a result, the pitch between the drums with respect to the process cartridges C511, C512, C513 and C514 is decreased (FIG. 37).

With reference to FIGS. 35 and 36, the guiding rail 561 will be described specifically, the guiding rail 561 is slidably held by the cartridge tray 544. Further, the frame 561 is provided with guiding rail engaging portions 565-568 each with which the associated rotation preventing portion 557 is engaged. The guiding rail engaging portions 565-568 are different in shape for the respective stations.

The guiding rail engaging portion 568 associated with the process cartridge C514 is provided with an I-shaped groove including a cut-away portion 568*a* with respect to the cartridge mounting and dismounting direction.

Further, the engaging portions 565-567 associated with the cartridges C511 and C513, respectively, are provided with L-shaped grooves including cut-away portions 565*a* and 567*a*, respectively, with respect to the cartridge mounting and dismounting direction and guiding portions 565*c*-567*c*, respectively, with respect to the pulling-out direction. The guiding portions 565*c*-567*c* extending in the pulling-out direction are different in length for the respective stations. The above-described three cut-away portions are disposed at positions so that adjacent process cartridges do not overlap with each other with respect to the mounting and dismounting direction. The shapes of the guiding rails are the same between the driving side guiding rail and the non-driving side guiding rail.

With reference to FIG. 38, an operation for moving the process cartridges C511, C512, C513 and C514 to an inside position of the apparatus main assembly by the guiding rails 561 will be described.

Figure 38A:
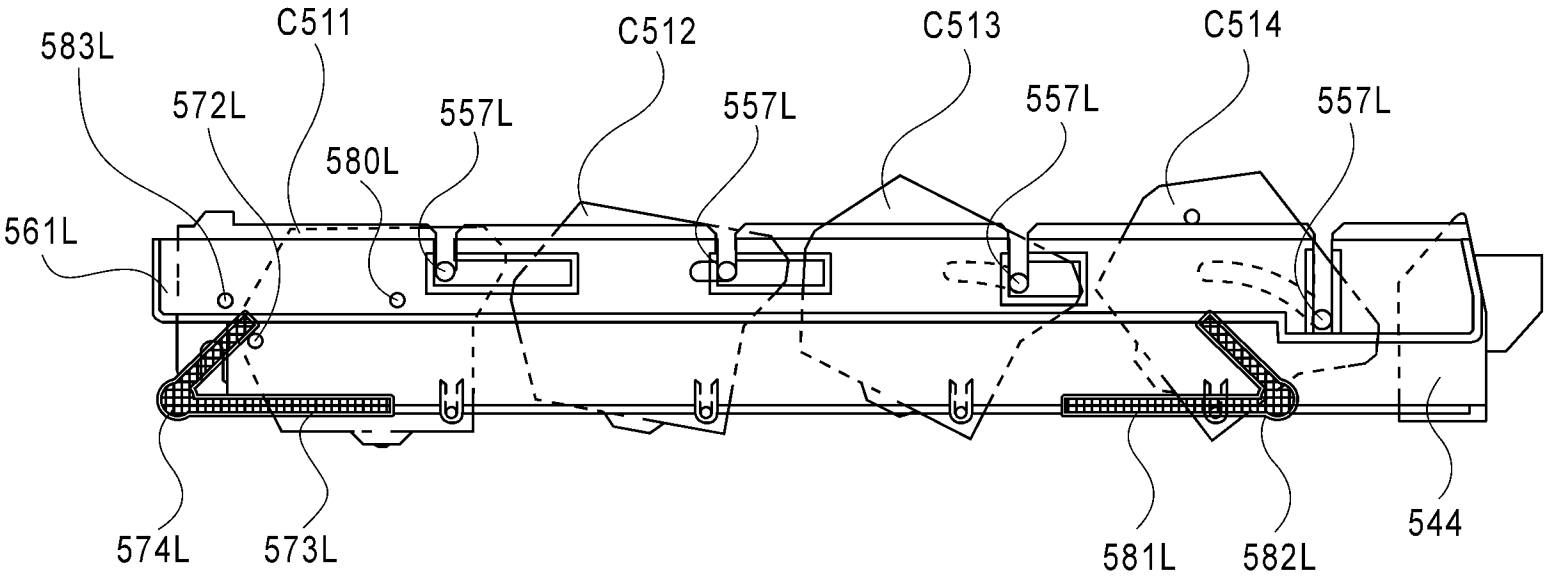
FIGS. 38A, 38B and 38C are side views for illustrating an operation for moving the cartridge tray to an inside position.
Figure 38B:
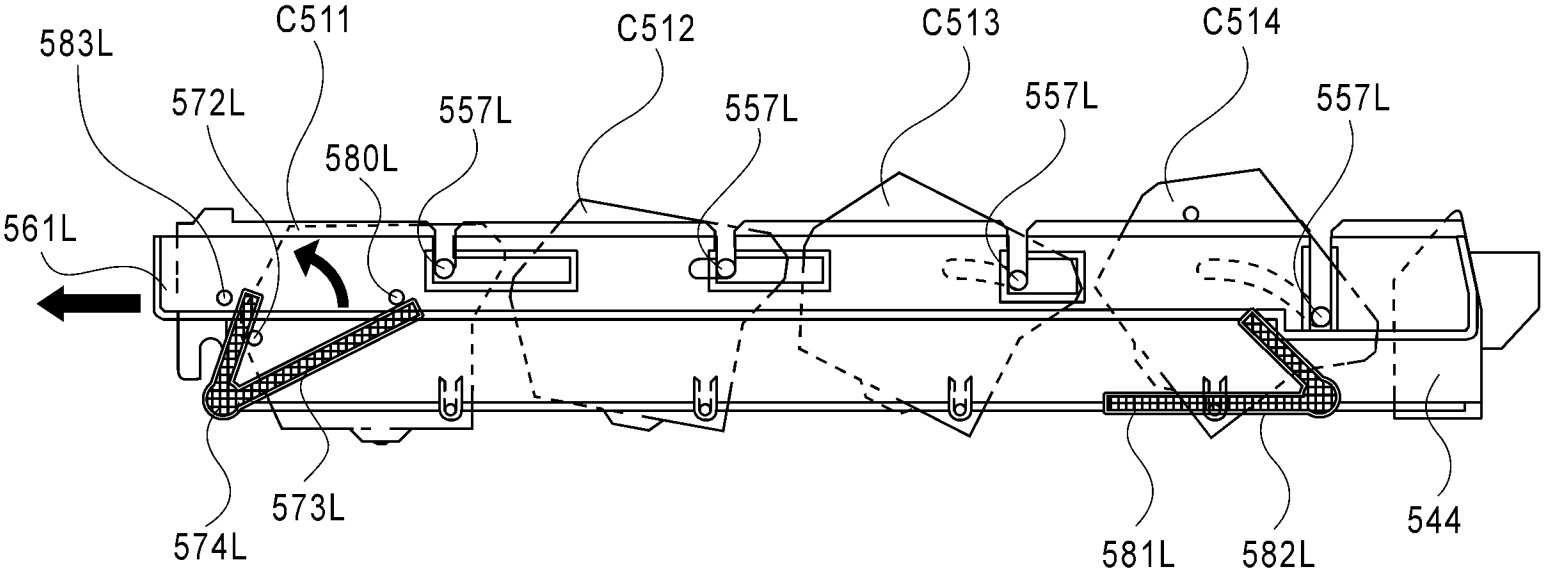

When the cartridge tray 544 is moved toward the accommodating portion, as the inside position, of the apparatus main assembly, an abutting portion 572L provided in the cartridge tray 544 contacts a guiding rail urging member 573L, and the guiding rail urging member 573L rotates about a rotation center 574L (FIG. 38A). When the cartridge tray 544 is further moved toward the inside of the apparatus main assembly, the rotated guiding rail urging member 573L contacts an abutting portion 580L of the guiding rail 561 to start further pushing of the guiding rail 561 into the inside of the apparatus main assembly in an arrow direction (FIG. 38B).

Figure 38C:
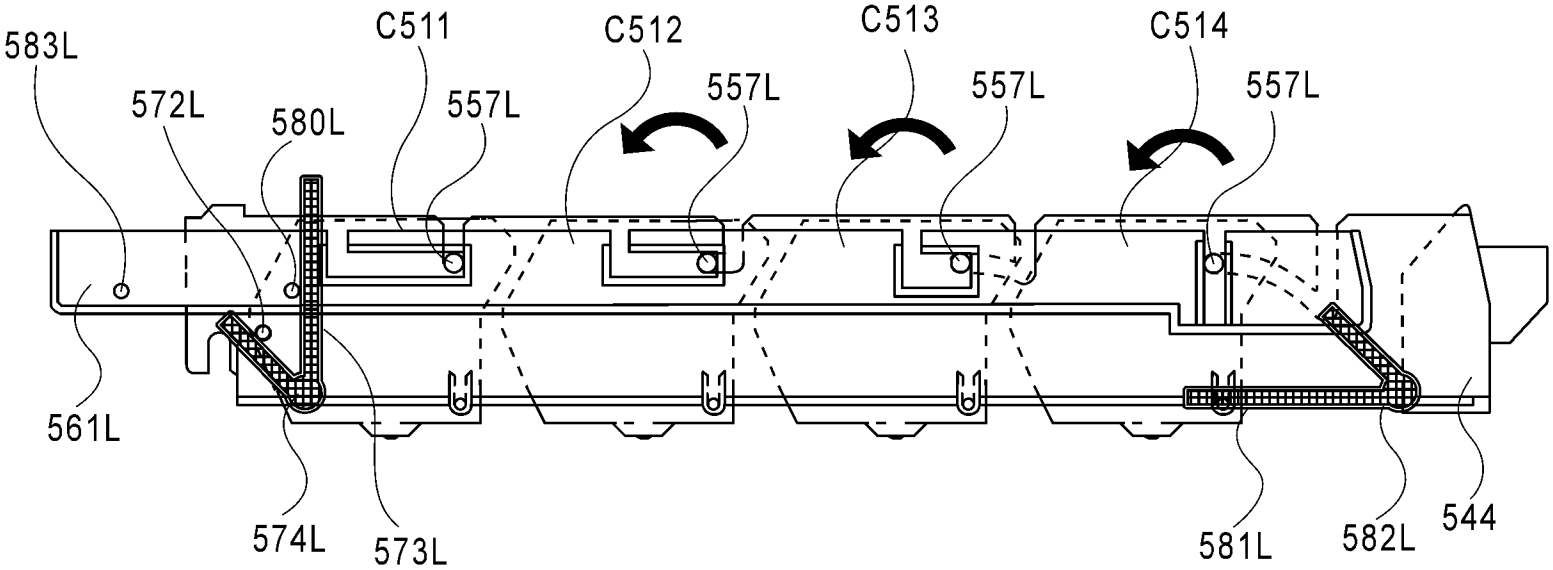

As a result, the guiding rail engaging portions 565-568 start pushing of the rotation preventing portions 557 to rotate the process cartridges C512-C514 in arrow directions, thus decreasing the pitches each between the associated drums (FIG. 38C).

With reference to FIG. 39, an operation for moving the process cartridges C511, C512, C513 and C514 to the outside position of the apparatus main assembly by the guiding rails 561 will be described.

Figure 39A:
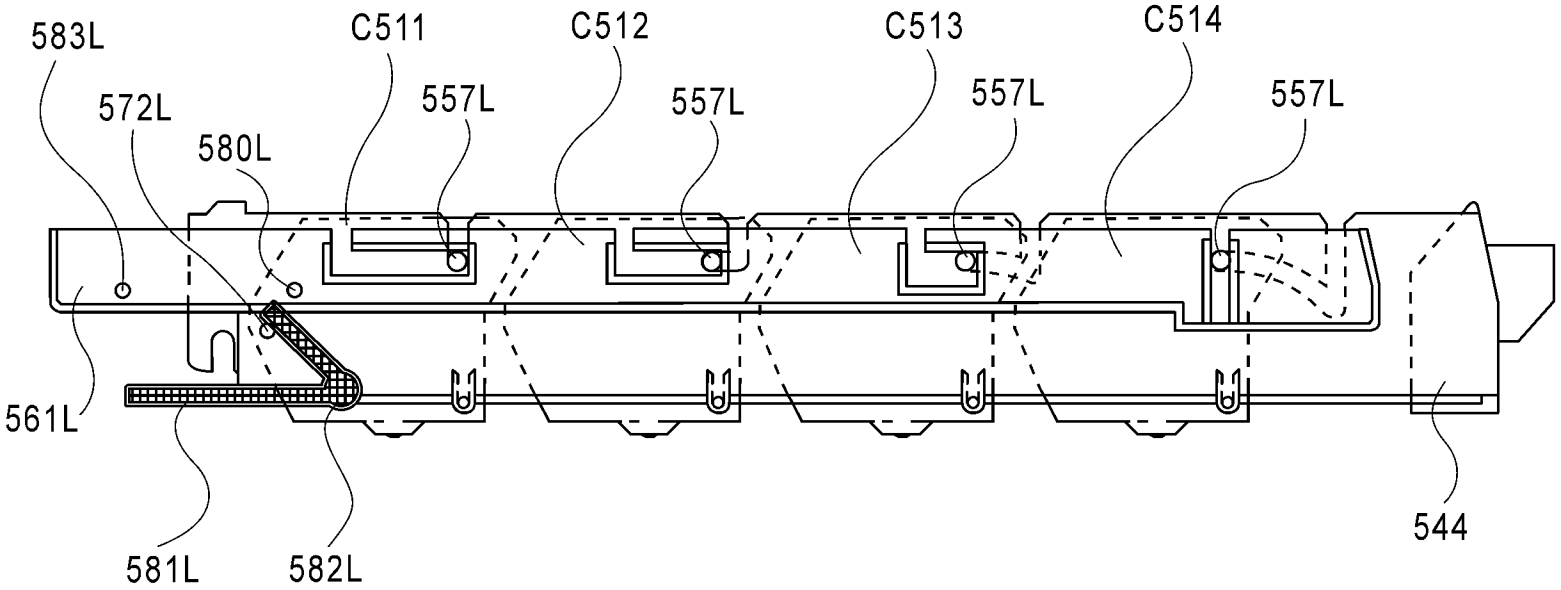
FIGS. 39A, 39B and 39C are side views for illustrating an operation for moving the cartridge tray to the outside position.
Figure 39B:
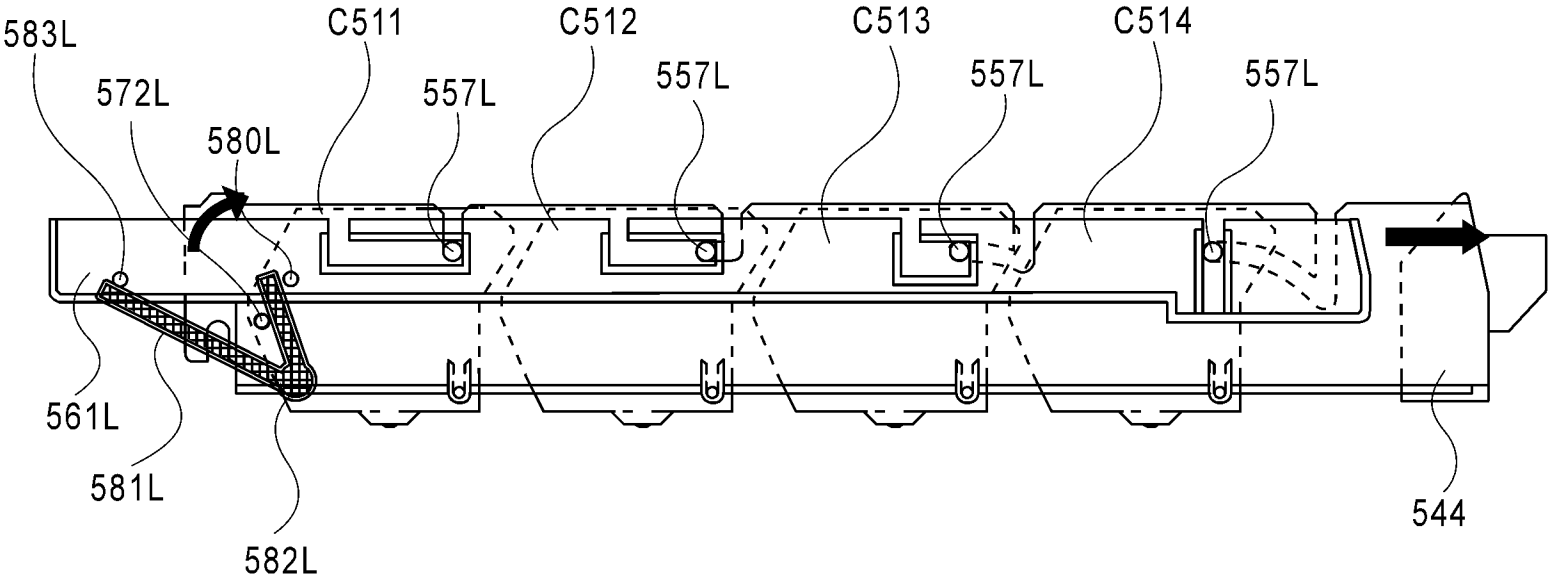

When the cartridge tray 544 is moved toward the accommodating portion, as the outside position, of the apparatus main assembly, an abutting portion 572L provided in the cartridge tray 544 contacts a guiding rail urging member 581L, and the guiding rail urging member 583L rotates about a rotation center 582L (FIG. 39A). When the cartridge tray 544 is further moved toward the outside of the apparatus main assembly, the rotated guiding rail urging member 581L contacts an abutting portion 583L of the guiding rail 561 to start further pushing of the guiding rail 561 to the outside of the apparatus main assembly in an arrow direction (FIG. 39B).

Figure 39C:
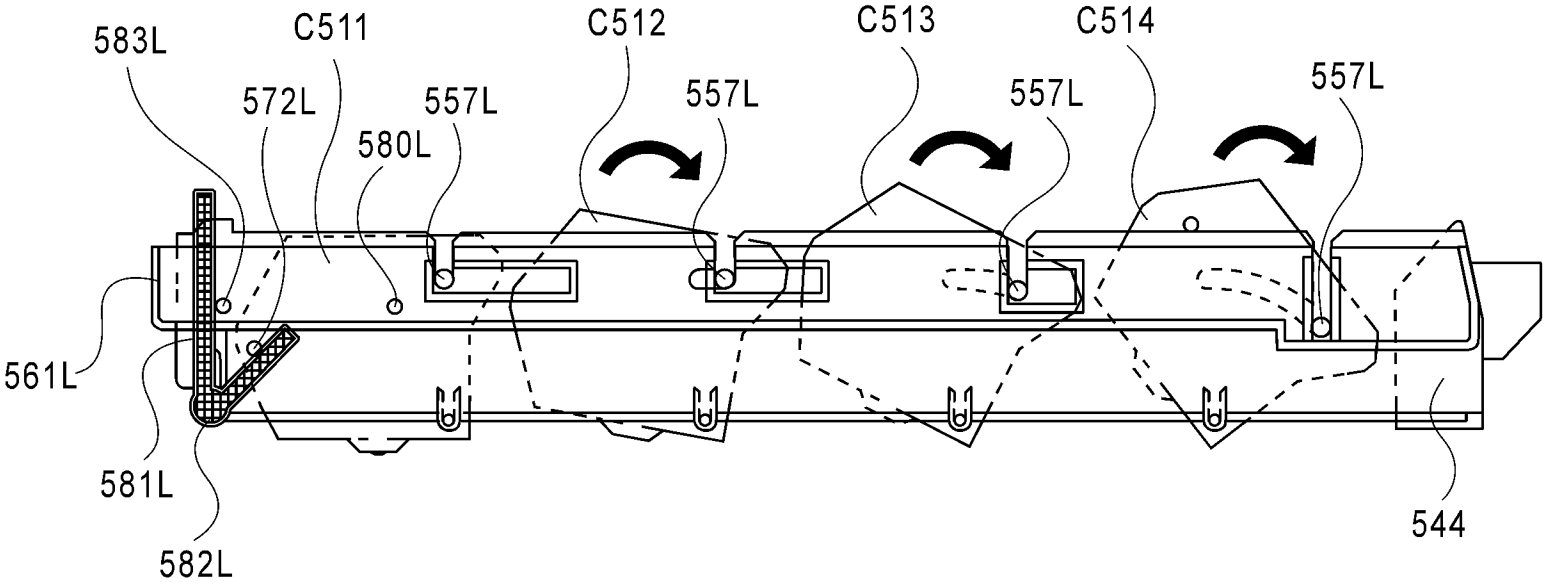

As a result, the guiding rail engaging portions 565-568 start pushing of the rotation preventing portions 557 to rotate the process cartridges C512-C514 in arrow directions, thus increasing the pitches each between the associated drums (FIG. 39C).

In this way, the cartridge tray 544 is provided with the engaging portions, and in interrelation with the pulling-out operation of the tray 544, a pitch between the process cartridges and the pitch between the photosensitive drums are broadened (increased). As a result, it is possible to ensure a mounting locus without causing interference between the adjacent process cartridges with each other during mounting and dismounting of the process cartridge. Further, the process cartridges C can be pulled out (dismounted) in the vertical direction of FIG. 36, and thus all the process cartridges C can be mounted and dismounted in the same direction. Further, during the mounting of the cartridges into the apparatus main assembly 101, the pitch between the photosensitive drums is narrowed (decreased), and therefore FPOT can be shortened.

Further, in Embodiment 5, although the description is made based on an ITB (intermediary transfer belt) type using the intermediary transfer belt, also in an image forming apparatus of an ETB (electrostatic transfer belt) type using an electrostatic conveying belt (FIG. 12), a similar effect can be obtained by employing a similar constitution.

<Embodiment 6>

Embodiment 6 of the present invention will be described with reference to FIGS. 40-47. An image forming apparatus 100 in this embodiment is similar to the image forming apparatus 100 in Embodiment 5, and constituent elements similar to those in Embodiment 1 will be omitted from description by adding the same reference numerals or symbols. In this embodiment, first to fourth process cartridges C611, C612, C613 and C614, and a cartridge tray 644 are used.

(Mounting and Dismounting Method of Process Cartridge)

Figure 40:
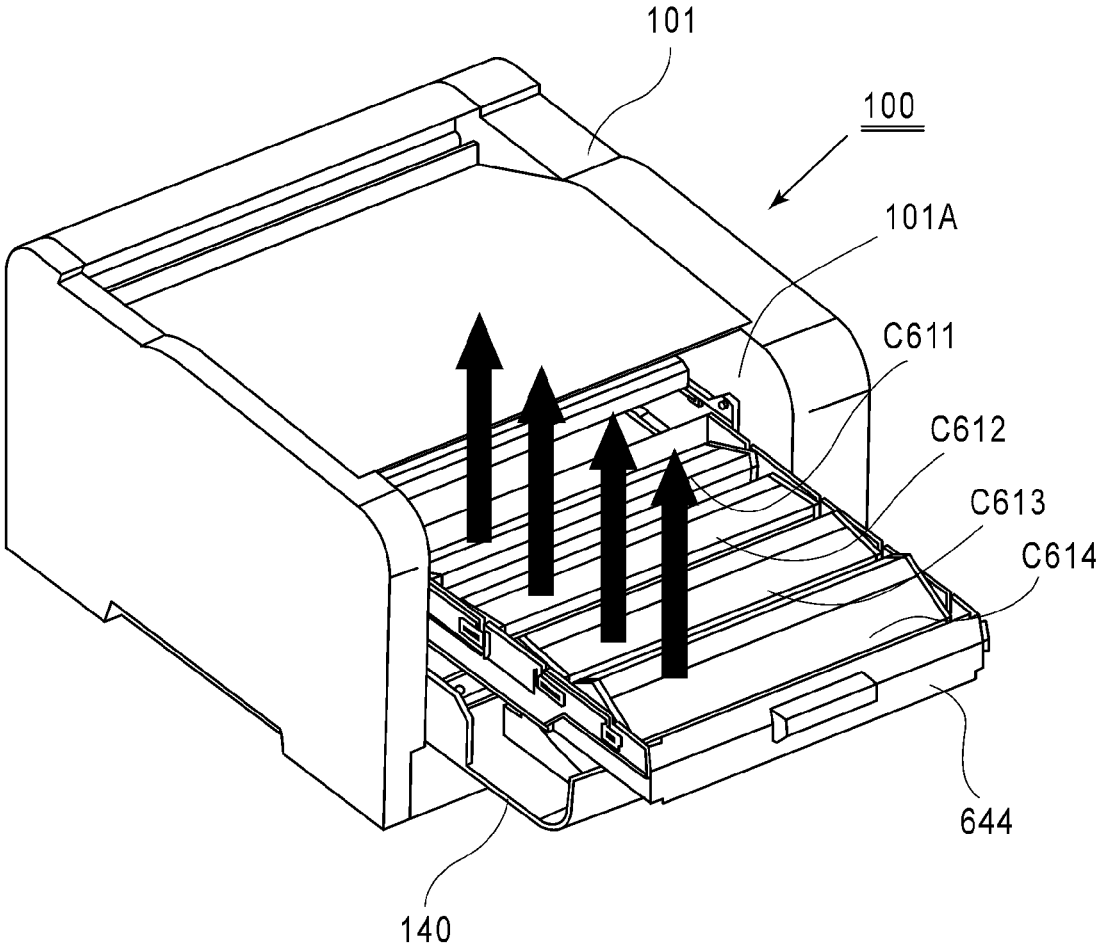
FIG. 40 is a perspective view of an outer appearance of an image forming apparatus in Embodiment 6 in a state in which a cartridge tray is pulled out.
Figure 41:
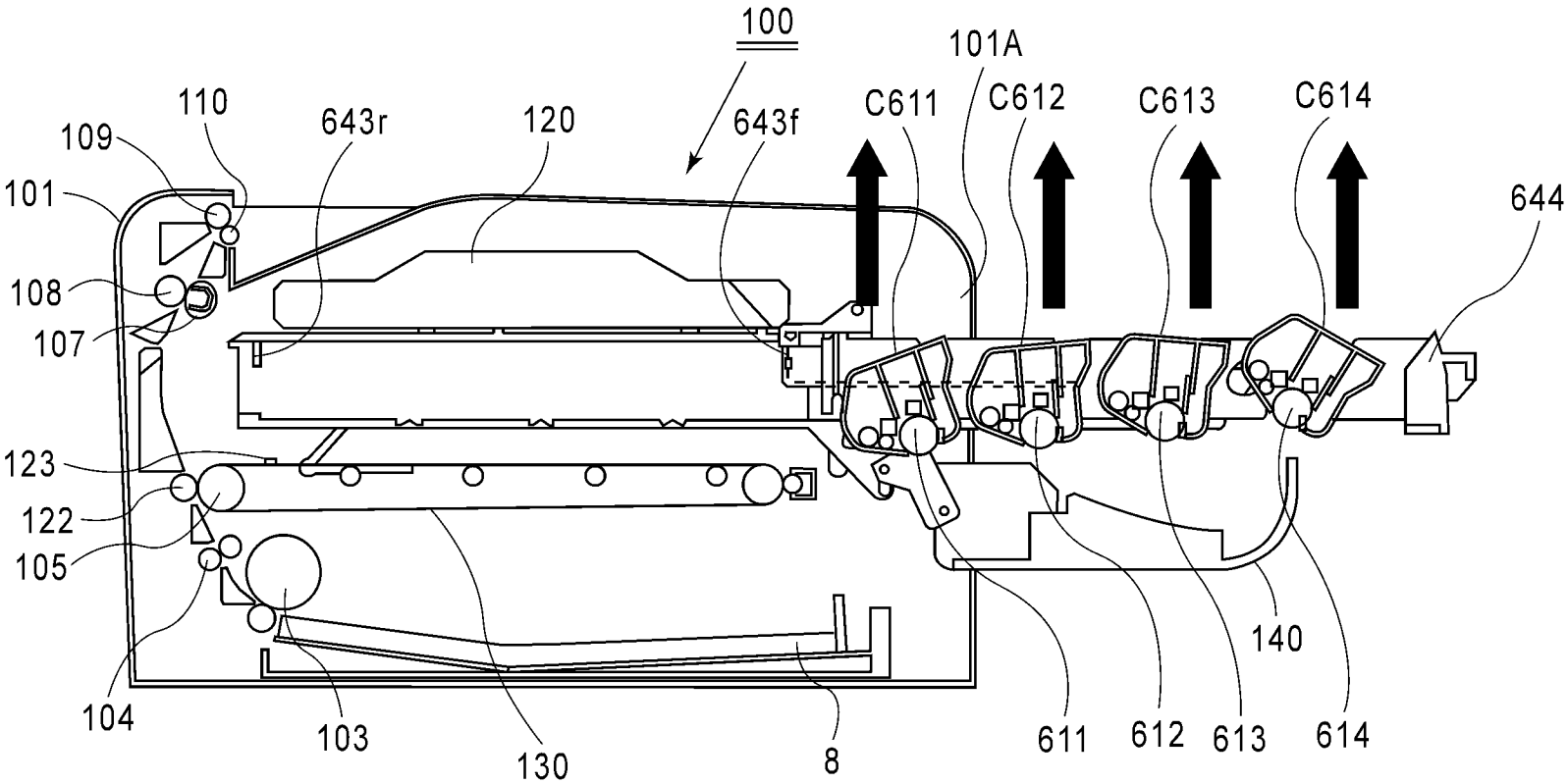
FIG. 41 is a longitudinal schematic side view of the image forming apparatus in the state in which the cartridge tray is pulled out.

An outline of a process cartridge mounting and dismounting method will be described with reference to FIGS. 40 and 41. FIGS. 40 and 41 are schematic views for illustrating exchange (replacement) of process cartridges, in which FIG. 40 is a perspective view of an outer appearance of the image forming apparatus 100 in a state in which the tray 644 is pulled out to an outside position, and FIG. 41 is a longitudinal schematic side view of the image forming apparatus 100 in the state.

As shown in FIGS. 40 and 41, when the cartridge tray 644 is pulled out from the apparatus main assembly 101, an upper surface of each of the process cartridges is exposed (opened). Further, in interrelation with the pulling-out operation of the cartridge tray 644, a pitch between adjacent two photosensitive drums of the respective process cartridges is increased. As a result, a mounting locus along which the process cartridges do not interfere with each other can be ensured, so that each of the process cartridges C611, C612, C613 and C614 is dismountable in an arrow direction. A method of changing the pitch between the photosensitive drums will be described later specifically. Further, when the process cartridges C611, C612, C613 and C614 are mounted in the apparatus main assembly 101, a reverse procedure is performed.

(Structure of Cartridge Tray)

Figure 42:
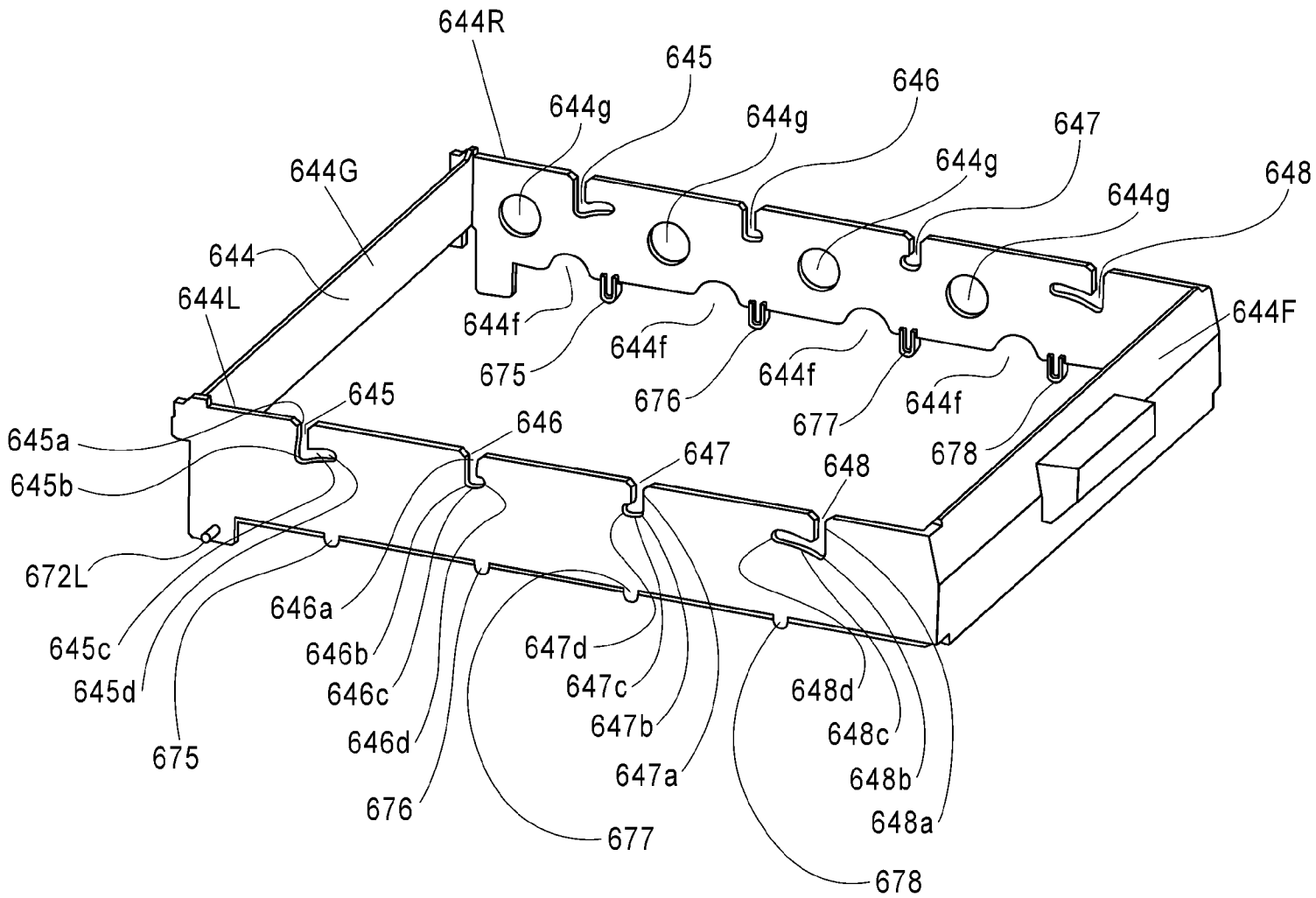
FIG. 42 is a perspective view of an outer appearance of the cartridge tray in Embodiment 6.
Figure 43A:
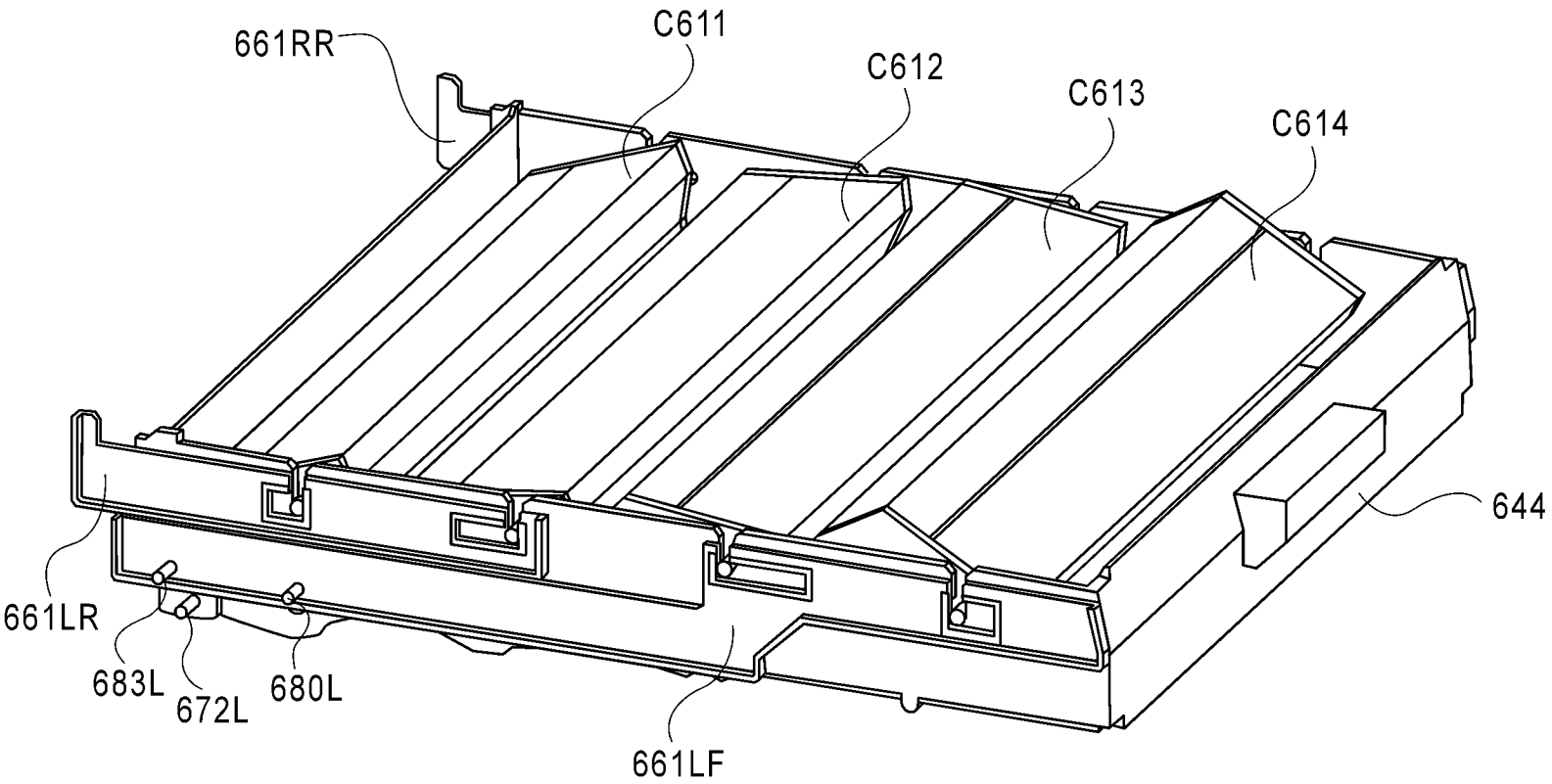
FIGS. 43A and 43B are a perspective view of an outer appearance and a side view, respectively, of the cartridge tray at an outside position.
Figure 43B:
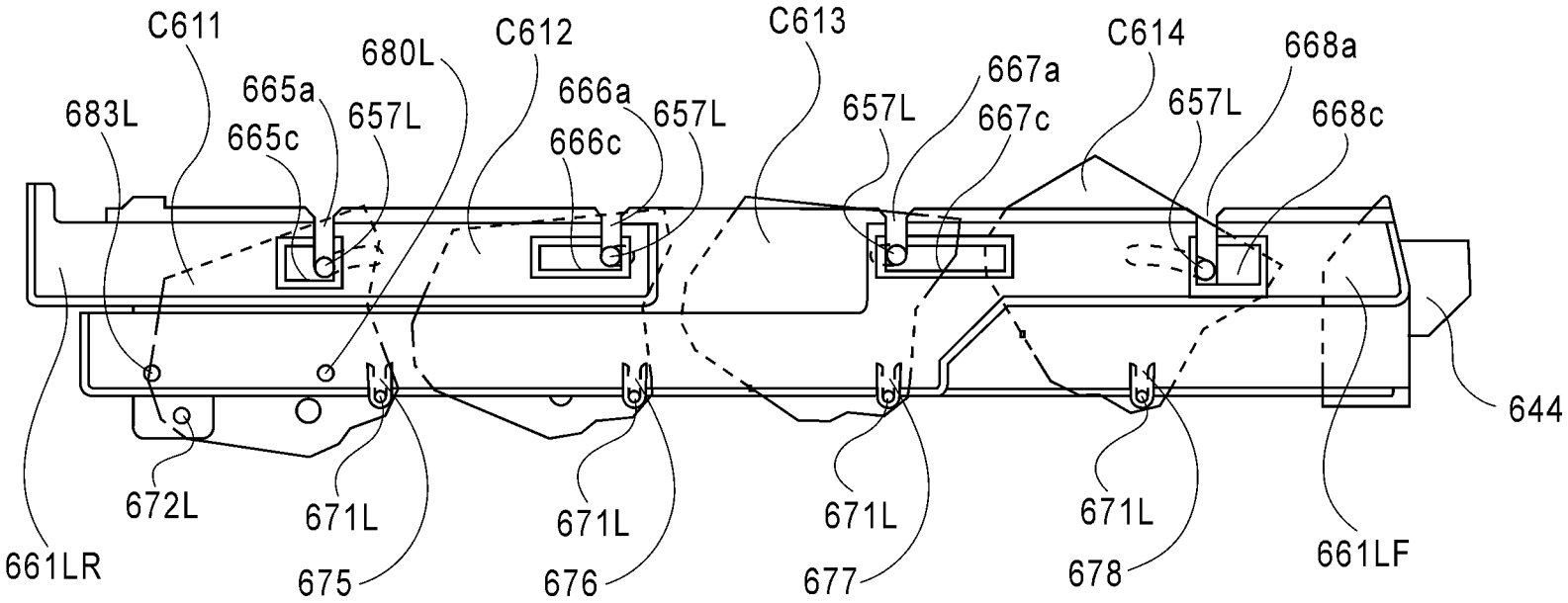
Figure 44A:
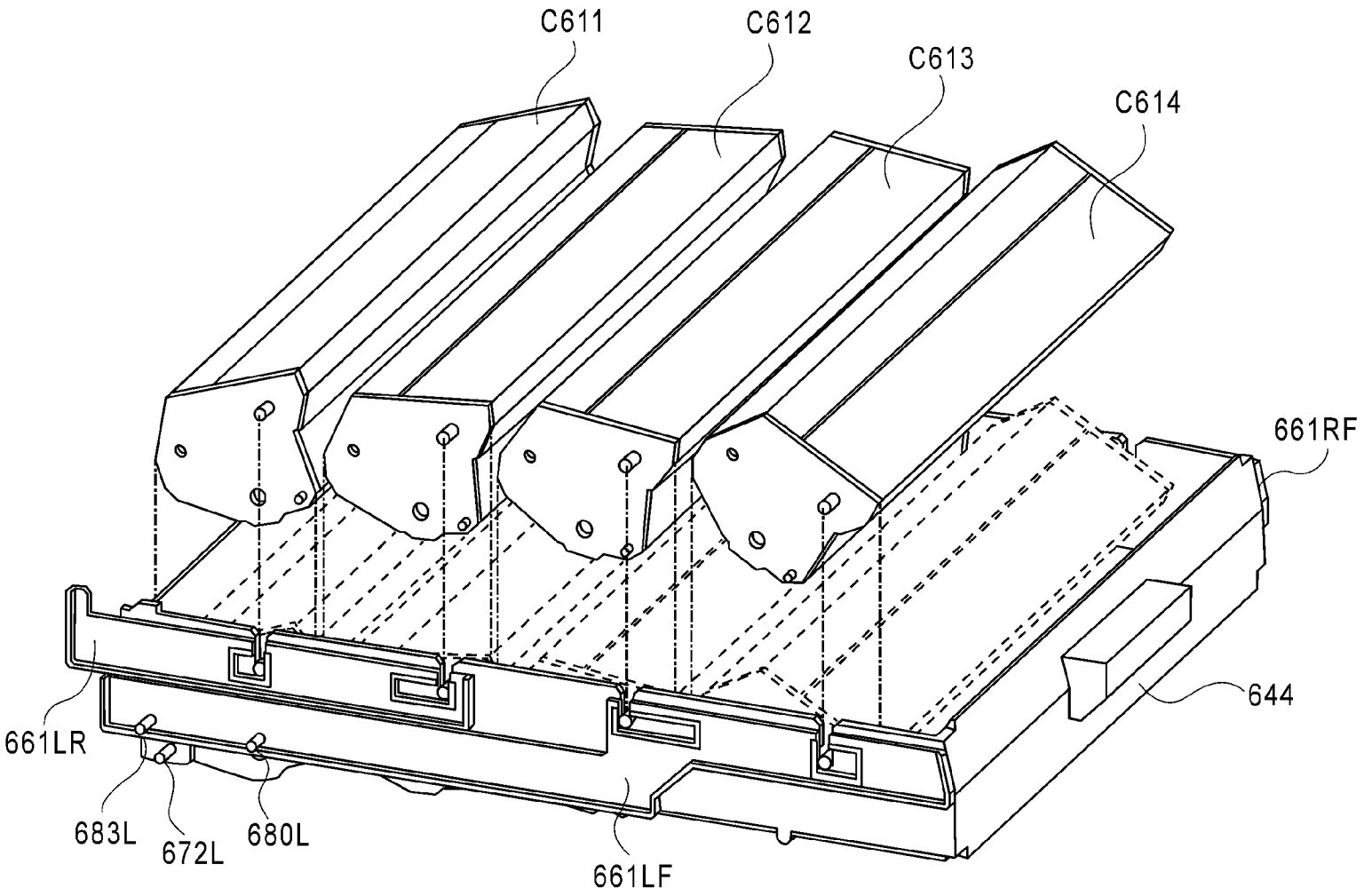
FIGS. 44A and 44B are a perspective view of an outer appearance and a side view, respectively, of the cartridge tray at the outside position.
Figure 44B:
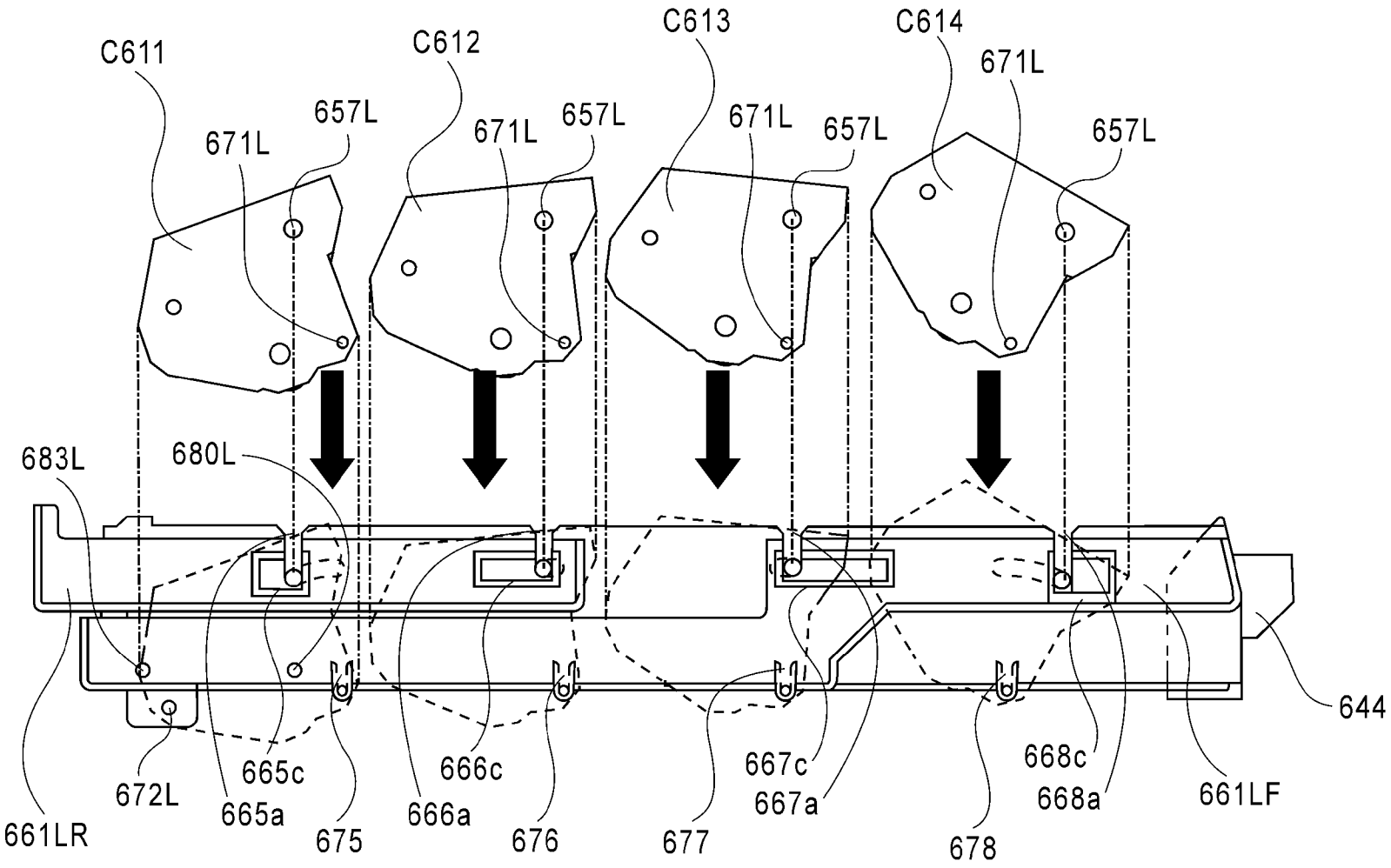
Figure 45A:
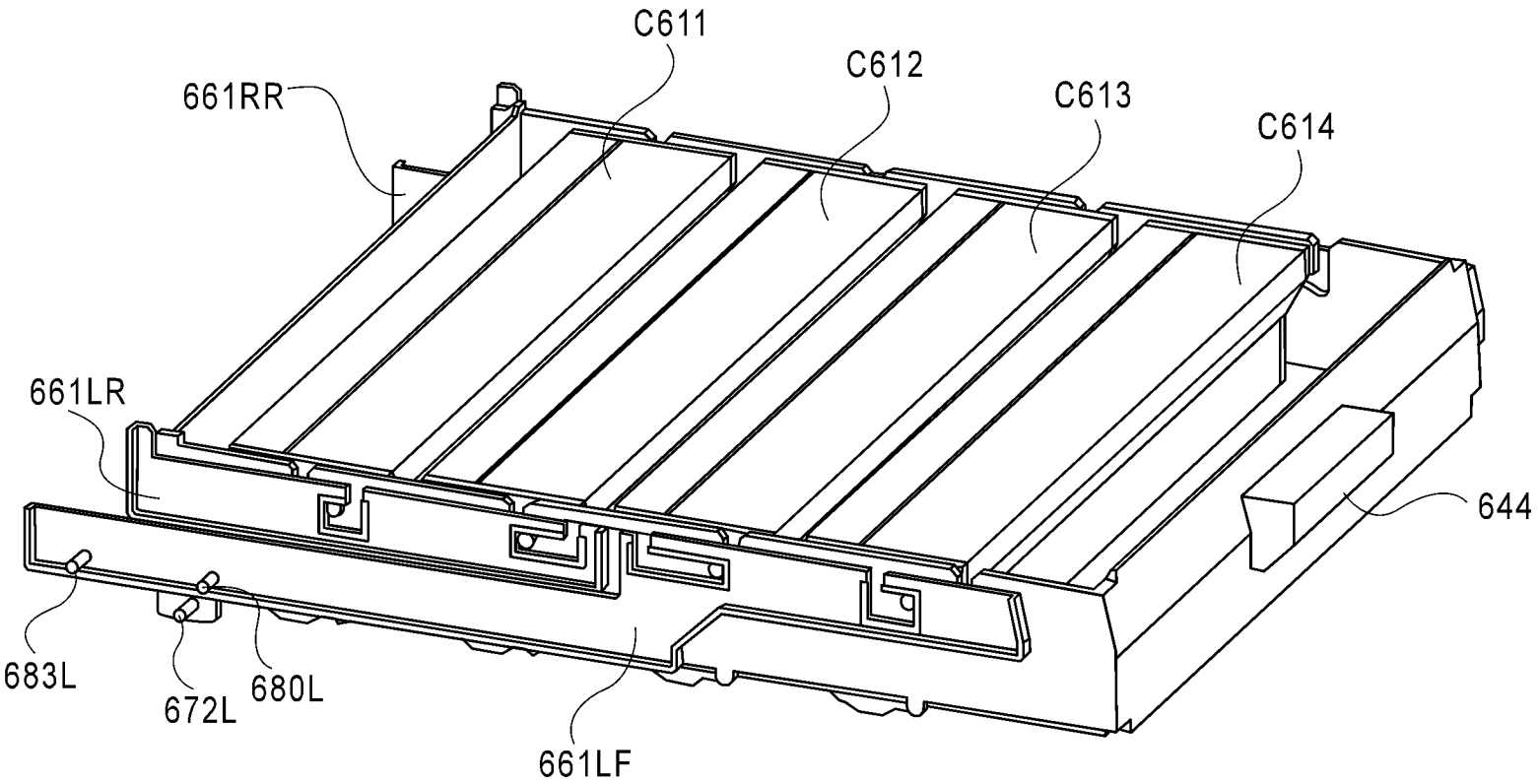
FIGS. 45A and 45B are a perspective view of an outer appearance and a side view, respectively, of the cartridge tray at an image forming position.
Figure 45B:
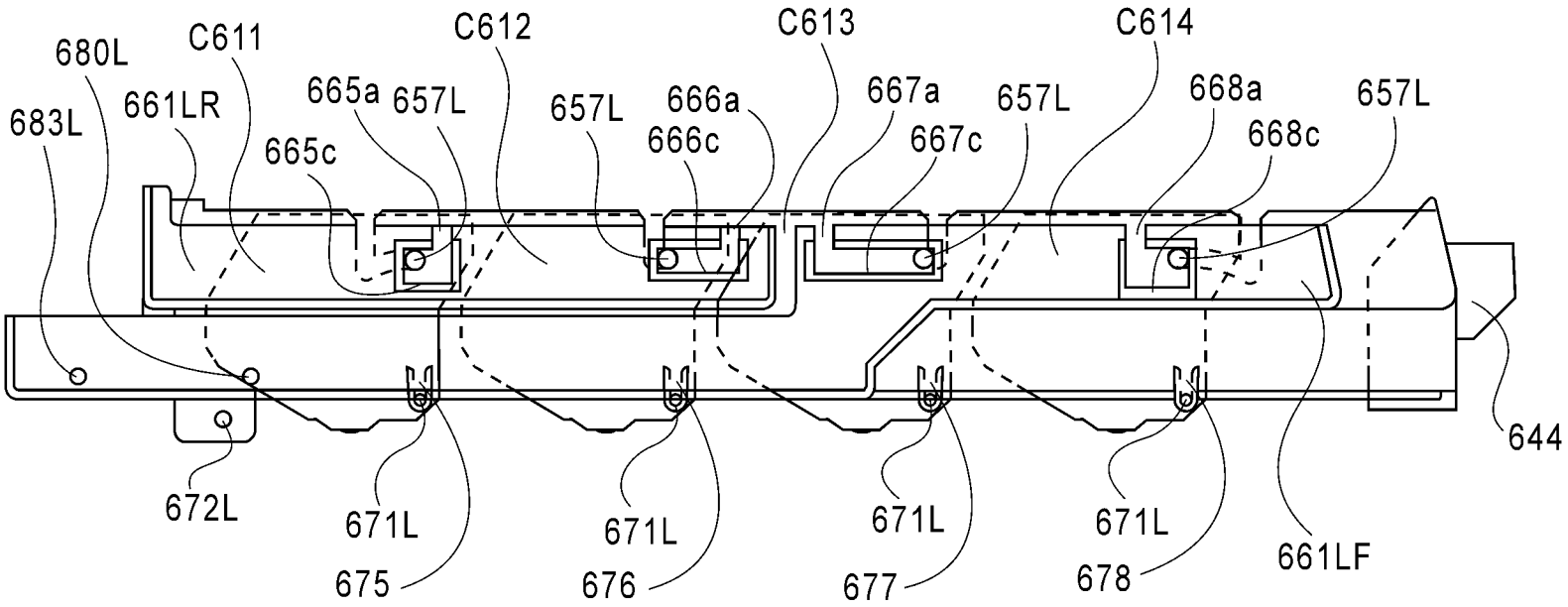

A structure of the cartridge tray 644 will be described with reference to FIGS. 41-45. FIG. 41 is a schematic sectional view of the image forming apparatus at the outside position after the cartridge tray 644 is pulled out. FIG. 42 is a perspective view of an outer appearance of the cartridge tray 644. FIGS. 43A and 43B are a perspective view of an outer appearance and a side view, respectively, of the cartridge tray 644 at an outside position after pulling-out. FIGS. 44A and 44B are a perspective view of an outer appearance and a side view, respectively, of the cartridge tray 644 at the outside position during the pulling-out. FIGS. 45A and 45B are a perspective view of an outer appearance and a side view, respectively, of the cartridge tray 644 during image formation.

With reference to FIG. 42, a structure of the cartridge tray 644 will be described. The cartridge tray 644 supports the process cartridges C611, C612, C613 and C614 to the extent that positions of the portions are roughly determined. A right frame portion 644R (driving side) is provided with holes 644*f* and 644*g* through which first and second drive output portions provided in the apparatus main assembly 101 side go in and out of the cartridge tray 644. Further, the right frame portion 644R is provided with engaging portions 645-648 with which the rotation preventing portions 657R are to be engaged, and is provided with rotation center shaft engaging portions 675-678 with which the rotation center shafts 671R are to be engaged.

Further, the left frame portion 644L (non-driving side) is provided with engaging portions 645-648 with which the rotation preventing portions 657L are to be engaged, and is provided with rotation center shaft engaging portions 675-678 with which the rotation center shafts 671L are to be engaged.

The engaging portions 645-648 will be described specifically. The engaging portions 645-648 are different in shape for the respective stations (image forming portions).

The engaging portions 645-648 associated with the cartridges C612-C614, respectively, are provided with L-shaped grooves including cut-away portions 645*a*-648*a*, respectively, with respect to the cartridge mounting and dismounting direction and guiding portions 645*c*-648*c*, respectively, with respect to the pulling-out direction. The guiding portions 645*c*-648*c* extending in the pulling-out direction are different in length for the respective stations. Further, supporting portions (recessed portions) 645*b*-648*b* are provided at corners of the associated L-shaped grooves.

The above-described four cut-away portions are disposed at positions so that adjacent process cartridges do not overlap with each other with respect to the up-down direction as the mounting and dismounting direction. The shapes of the engaging portions 645-648 are the same between the driving side and the non-driving side.

(Mounting and Dismounting of Process Cartridge)

Mounting of the process cartridges into the cartridge tray 644 will be described with reference to FIGS. 45-45.

Each of the process cartridges C611, C612, C613 and C614 is inserted into the cartridge tray 644 from an arrow direction in a drop-in manner. When the process cartridge C is gradually inserted, the driving side rotation preventing portion 657R and the non-driving side rotation preventing portion 657L are engaged with the associated ones of the engaging portions 645-648 provided in the cartridge tray 644 side. Then, the rotation center shafts 671L and 671R are gradually engaged with the associated ones of the rotation center shaft engaging portions 675-678 (FIG. 44). Further, when the process cartridge is moved downward so as to be accommodated in the cartridge tray 644, the rotation preventing portions 657R and 657L abut against the associated ones of the supporting portions 645*b*-648*b* of the engaging portions, thus being positioned.

In this way, the cartridge tray 644 positions and supports the cartridge at a position where the adjacent process cartridge does not overlap with the cartridge with respect to the up-down direction (FIG. 43). As a result, as shown in FIG. 41, the cartridge tray 644 supports the respective process cartridges so as to be dismountable in the arrow directions.

When the cartridge tray 644 is moved to the accommodating position of the apparatus main assembly 101, in interrelation with the movement of the cartridge tray 644, the rotation preventing portions 657R and 657L are pushed by guiding rails 661RF, 661RR, 661LF and 661LR provided in the cartridge tray 644, and are moved along the guiding portions in the pulling-out direction. As a result, the pitch between the drums with respect to the process cartridges C611, C612, C613 and C614 is decreased (FIG. 45).

With reference to FIGS. 43 and 44, the guiding rail 661 will be described specifically, the guiding rail 661 is slidably held by the cartridge tray 644. Further, the frame 661 is provided with guiding rail engaging portions 665-668 each with which the associated rotation preventing portion 657 is engaged. The guiding rail engaging portions 665-668 are different in shape for the respective stations.

Each of the guiding rail engaging portions 665-668 associated with the process cartridges C614 is provided with an L-shaped groove. The L-shaped grooves includes cut-away portions 665*a* and 668*a*, respectively, with respect to the cartridge mounting and dismounting direction and guiding portions 665*c*-668*c*, respectively, with respect to the pulling-out direction. The guiding portions 665*c*-668*c* extending in the pulling-out direction are different in length for the respective stations. The above-described four cut-away portions are disposed at positions so that adjacent process cartridges do not overlap with each other with respect to the mounting and dismounting direction. The shapes of the guiding rails are the same between the driving side guiding rail and the non-driving side guiding rail.

With reference to FIG. 46, an operation for moving the process cartridges C611, C612, C613 and C614 to an inside position of the apparatus main assembly by the guiding rails 661 will be described.

Figure 46A:
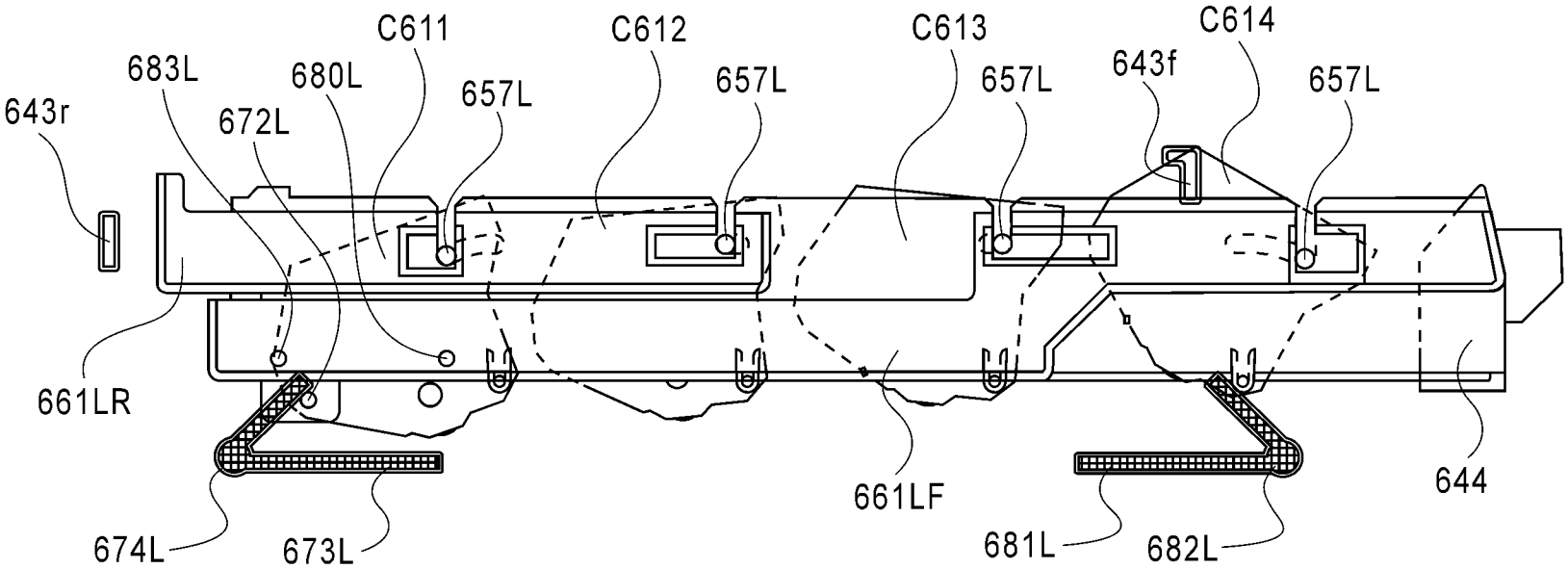
FIGS. 46A, 46B and 46C are side views for illustrating an operation for moving the cartridge tray to an inside position.

When the cartridge tray 644 is moved toward the accommodating portion, as the inside position, of the apparatus main assembly, an abutting portion 672L provided in the cartridge tray 644 contacts a guiding rail urging member 673L, and the guiding rail urging member 673L rotates about a rotation center 674L (FIG. 46A). When the cartridge tray 644 is further moved toward the inside of the apparatus main assembly, the rotated guiding rail urging member 673L contacts an abutting portion 680L of the guiding rail 661LF to start further pushing of the guiding rail 661LF into the inside of the apparatus main assembly in an arrow direction.

Figure 46B:
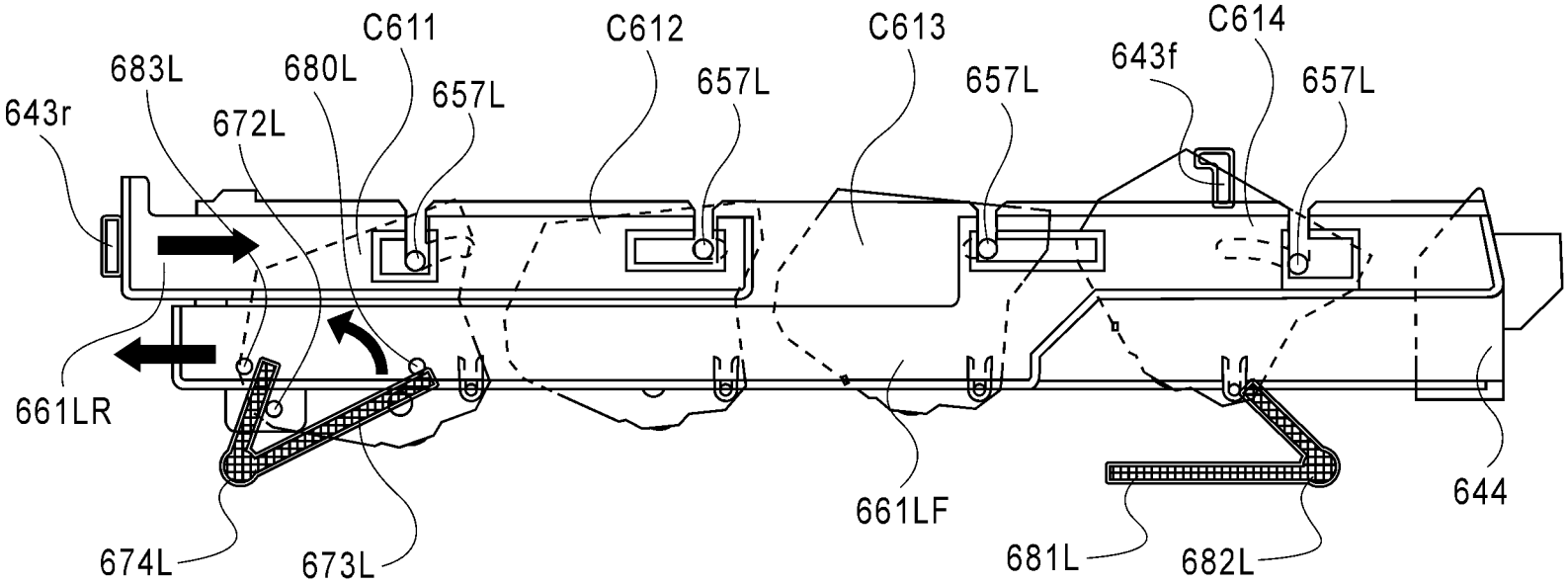

On the other hand, the guiding rail 661LR contacts a projection 643*r* of the tray holding member, and thus cannot be moved together with the cartridge tray 644 further toward the inside of the apparatus main assembly. For that reason, the process cartridges C611 and C612 receives reaction force from the guiding rail 661LR via the rotation preventing portion 657 in a direction opposite to the movement direction (FIG. 46B).

Figure 46C:
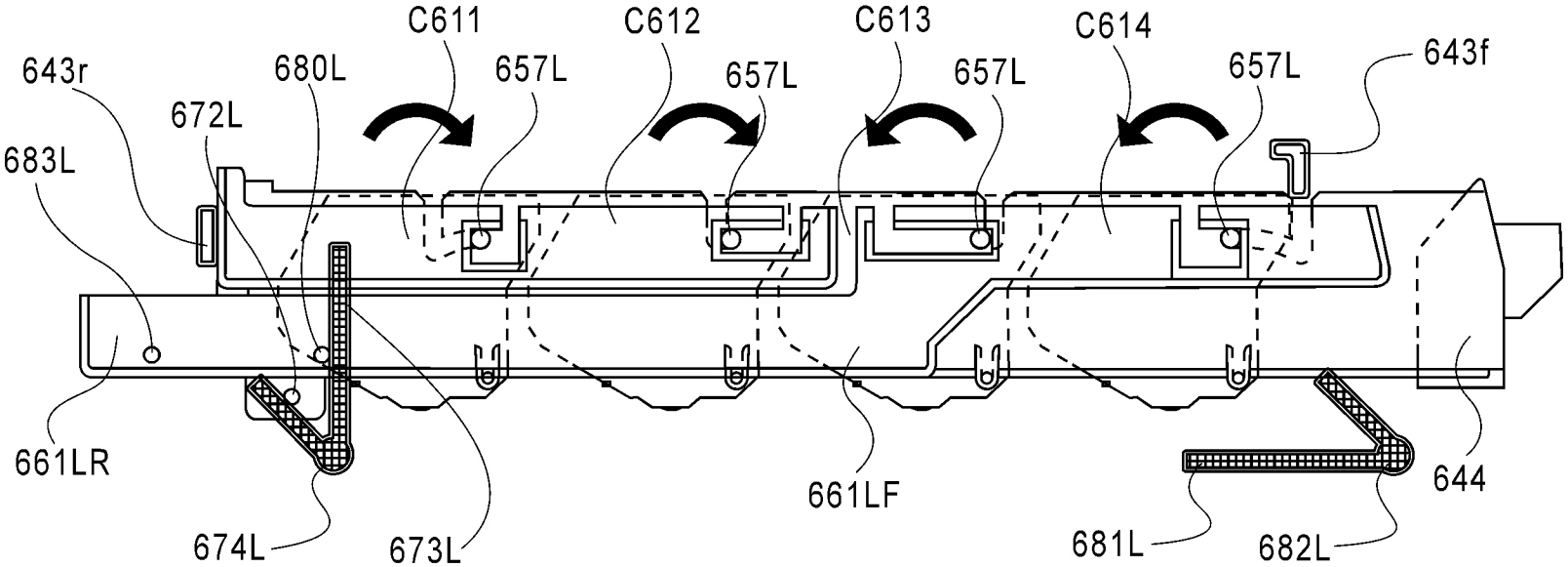

As a result, the guiding rail engaging portions 665-668 start pushing of the rotation preventing portions 657. Further, the process cartridges C611 and C612 are rotated in a direction opposite to the mounting direction of the cartridge tray 644, and the process cartridges C613 and C614 are rotated in the mounting direction of the cartridge tray 644, so that the pitches each between the associated drums are decreased (FIG. 46C).

With reference to FIG. 47, an operation for moving the process cartridges C611, C612, C613 and C614 to the outside position of the apparatus main assembly by the guiding rails 661 will be described.

Figure 47A:
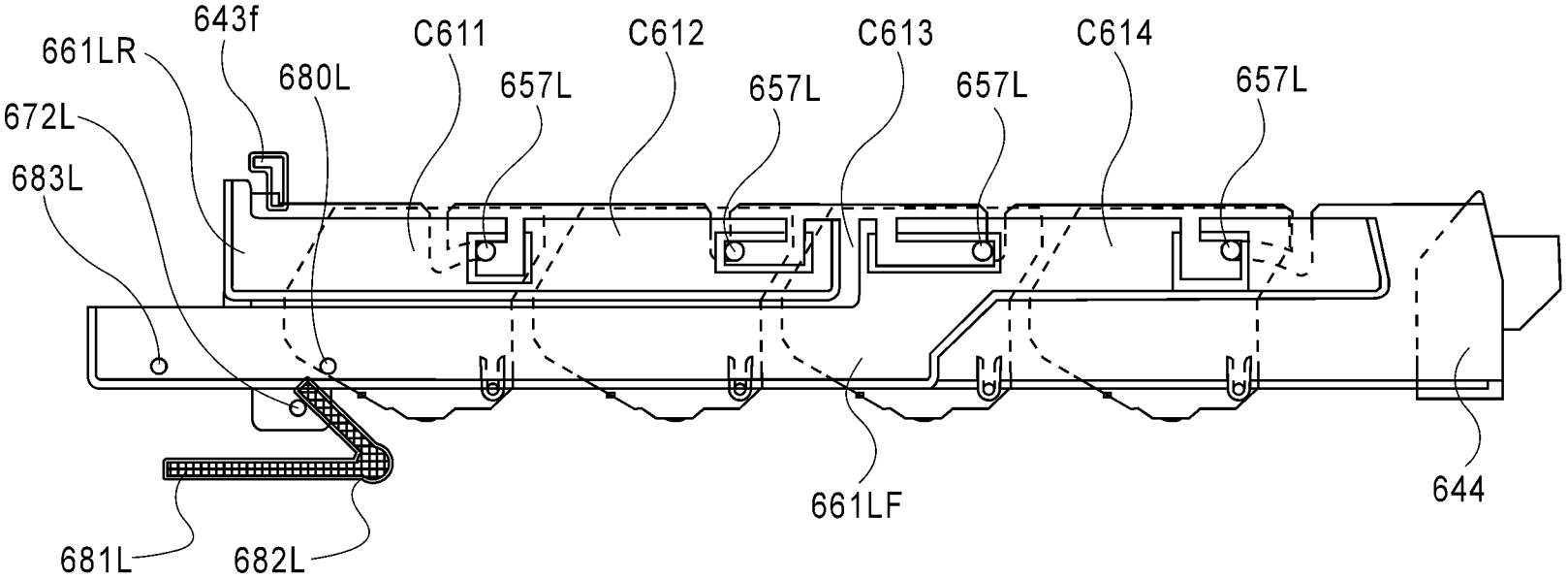
FIGS. 47A, 47B and 47C are side views for illustrating an operation for moving the cartridge tray to the outside position.

When the cartridge tray 644 is moved toward the accommodating portion, as the outside position, of the apparatus main assembly, an abutting portion 672L provided in the cartridge tray 644 contacts a guiding rail urging member 681L, and the guiding rail urging member 681L rotates about a rotation center 682L (FIG. 47A). When the cartridge tray 644 is further moved toward the outside of the apparatus main assembly, the rotated guiding rail urging member 681L contacts an abutting portion 683L of the guiding rail 661LF to start further pushing of the guiding rail 661LF to the outside of the apparatus main assembly in an arrow direction.

Figure 47B:
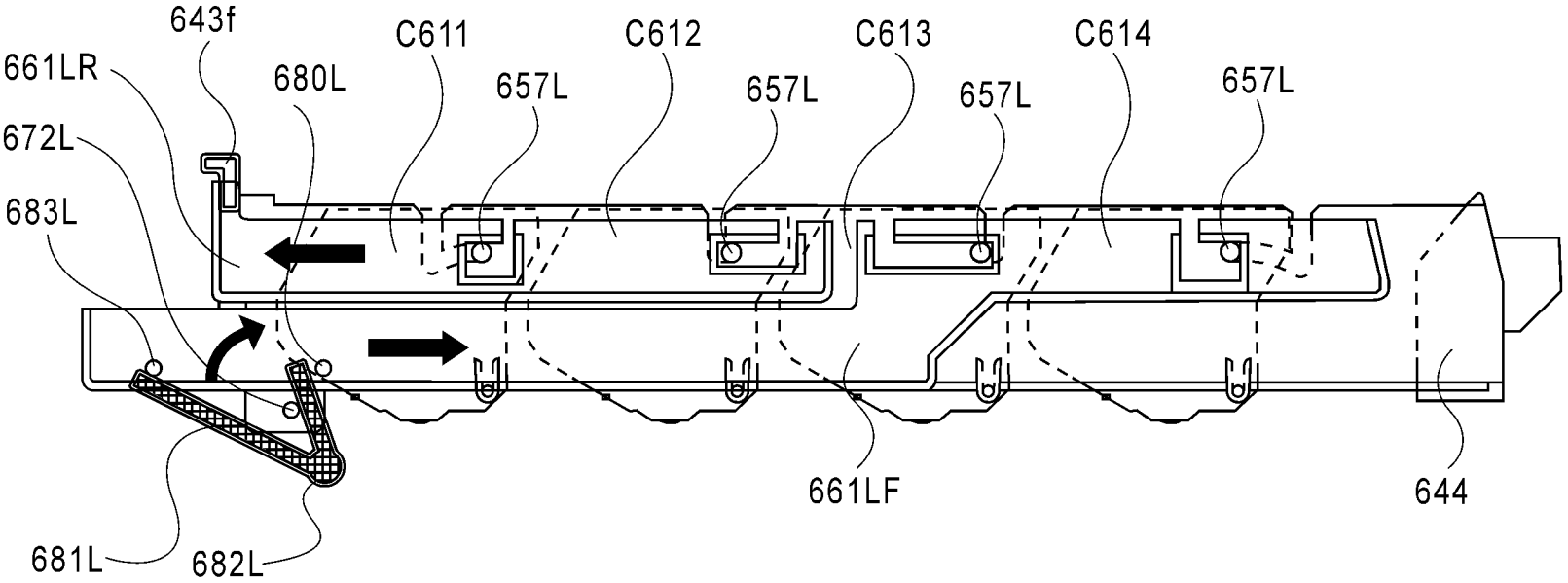

On the other hand, the guiding rail 661LR contacts a projection 643*f* of the tray holding member, and thus cannot be moved together with the cartridge tray 644 further toward the outside of the apparatus main assembly. For that reason, the process cartridges C611 and C612 receives reaction force from the guiding rail 661LR via the rotation preventing portion 657 in a direction opposite to the movement direction (FIG. 47B).

Figure 47C:
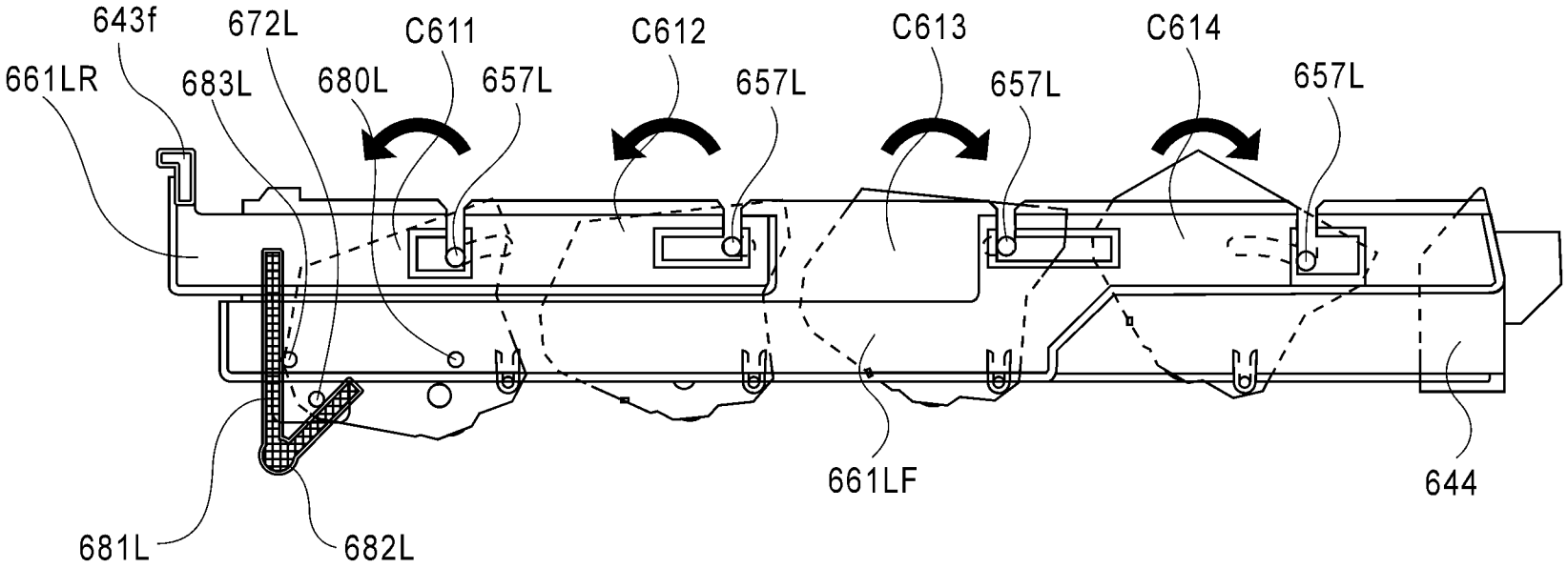

As a result, the guiding rail engaging portions 665-668 start pushing of the rotation preventing portions 657. Further, the process cartridges C611 and C612 are rotated in a direction opposite to the movement direction of the cartridge tray 644, and the process cartridges C613 and C614 are rotated in the movement direction of the cartridge tray 644, so that the pitches each between the associated drums are increased (FIG. 47C).

In this way, the cartridge tray 644 is provided with the engaging portions, and in interrelation with the pulling-out operation of the tray 644, the process cartridges C are rotated in the movement direction of the cartridge tray 644 and other process cartridges C are moved in the opposite direction. As a result, a pitch between the process cartridges and the pitch between the photosensitive drums can be broadened (increased).

Further, it is possible to ensure a mounting locus without causing interference between the adjacent process cartridges with each other during mounting and dismounting of the process cartridge. As a result, the process cartridge can be pulled out (dismounted) in the vertical direction of FIG. 44 and thus all the process cartridges can be mounted and dismounted in the same direction, so that usability is improved. Further, during the mounting of the cartridge into the apparatus main assembly, the pitch between the photosensitive drums is narrowed (decreased), and therefore FPOT can be shortened.

Further, in Embodiment 6, although the description is made based on an ITB (intermediary transfer belt) type using the intermediary transfer belt, also in an image forming apparatus of an ETB (electrostatic transfer belt) type using an electrostatic conveying belt (FIG. 12), a similar effect can be obtained by employing a similar constitution.

<Embodiment 7 >

Embodiment 7 of the present invention will be described with reference to FIGS. 48-52. An image forming apparatus 100 in this embodiment is similar to the image forming apparatus 100 in Embodiment 1, and constituent elements similar to those in Embodiment 1 will be omitted from description by adding the same reference numerals or symbols.

(Mounting and Dismounting Method of Process Cartridge)

Figure 48:
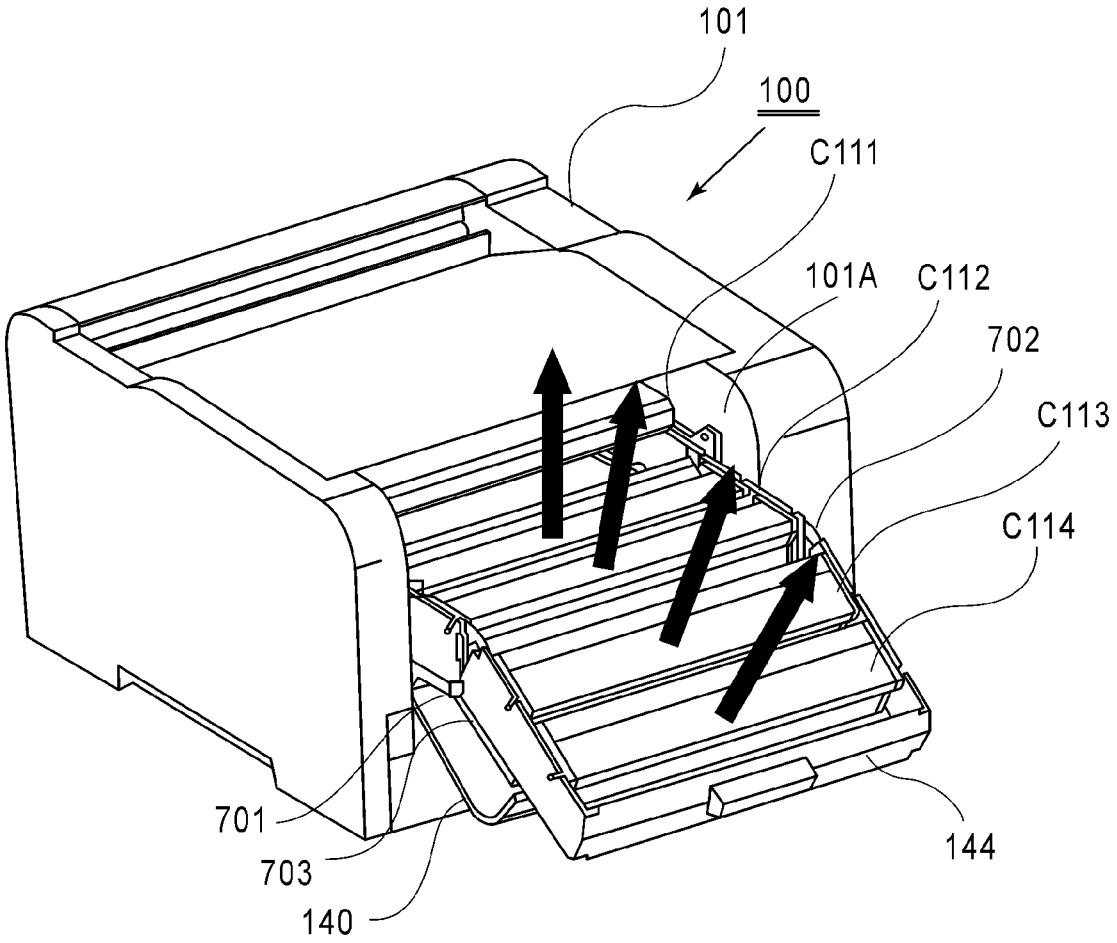
FIG. 48 is a perspective view of an outer appearance of an image forming apparatus in Embodiment 7 in a state in which a cartridge tray is pulled out.
Figure 49:
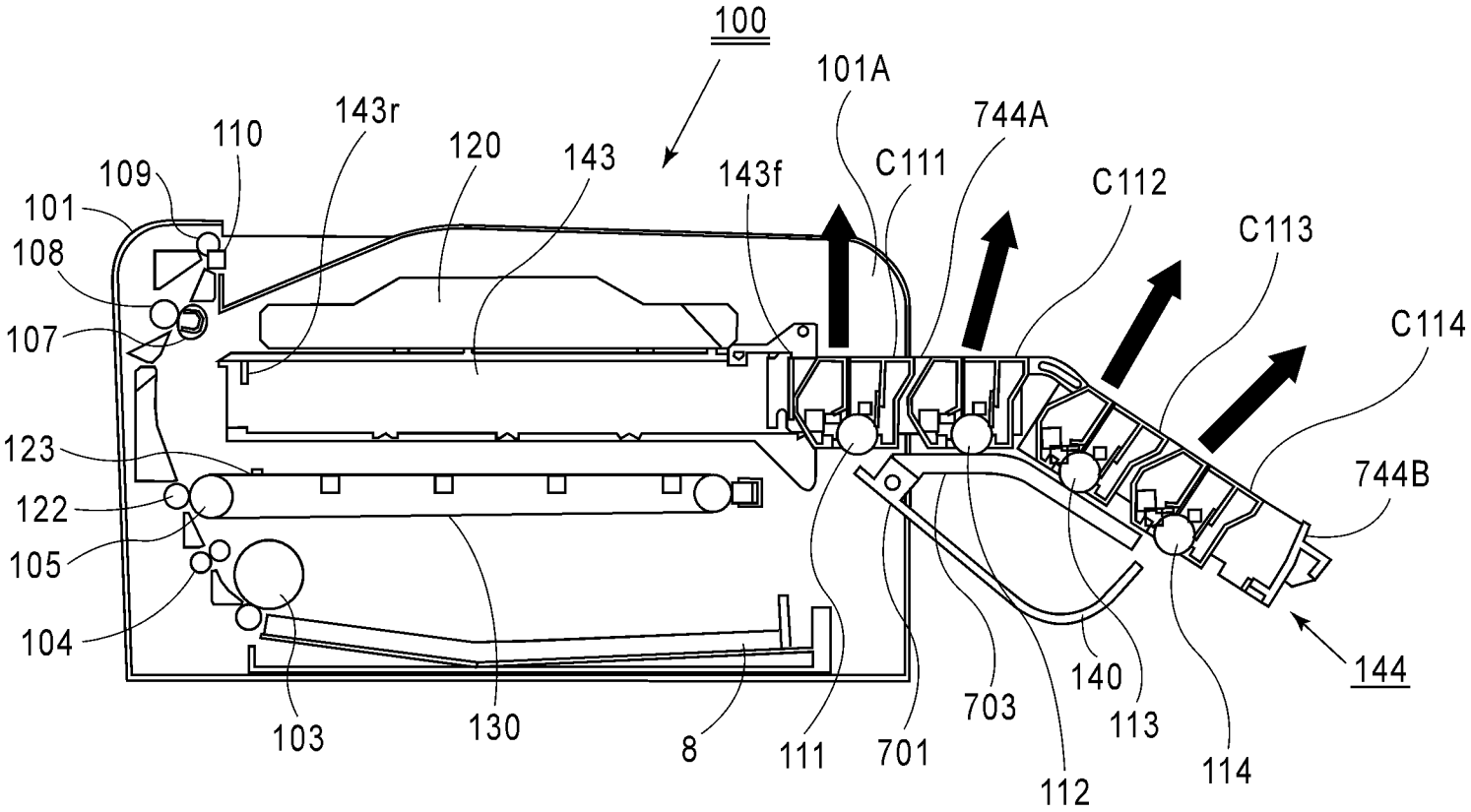
FIG. 49 is a longitudinal schematic side view of the image forming apparatus in the state in which the cartridge tray is pulled out.

An outline of a process cartridge mounting and dismounting method will be described with reference to FIGS. 48 and 49. FIG. 48 is a perspective view of an outer appearance of the image forming apparatus 100 in a state in which the cartridge tray 144 is pulled out from the apparatus main assembly 101, of the cartridge door 140 is open, to the outside position through the opening 101A. FIG. 49 is a longitudinal schematic side view of the image forming apparatus 100 in the state.

The cartridge tray 144 pulled out to the outside position (in the front direction) is bent at a bending portion 701, and is held by a link mechanism 702 and a link rail 703. As shown in FIGS. 48 and 49, when the cartridge tray 144 is pulled out from the apparatus main assembly 101, the upper surfaces of the process cartridges are exposed (opened). Further, in interrelation with the pulling-out operation, the cartridge tray 144 is bent, so that a mounting direction of the cartridges C113 and C114 held by a front cartridge tray 744B is inclined relative to the cartridges C111 and C112 held by a rear cartridge tray 744A.

As a result, a mounting locus along which the process cartridges do not interfere with each other can be ensured, so that each of the process cartridges C111, C112, C113 and C114 is dismountable in an arrow direction. A constitution in which the cartridge tray 144 is bent and a mounting mechanism for preventing the mutual interference between the process cartridges will be described later.

(Structure of Cartridge Tray)

Figure 50:
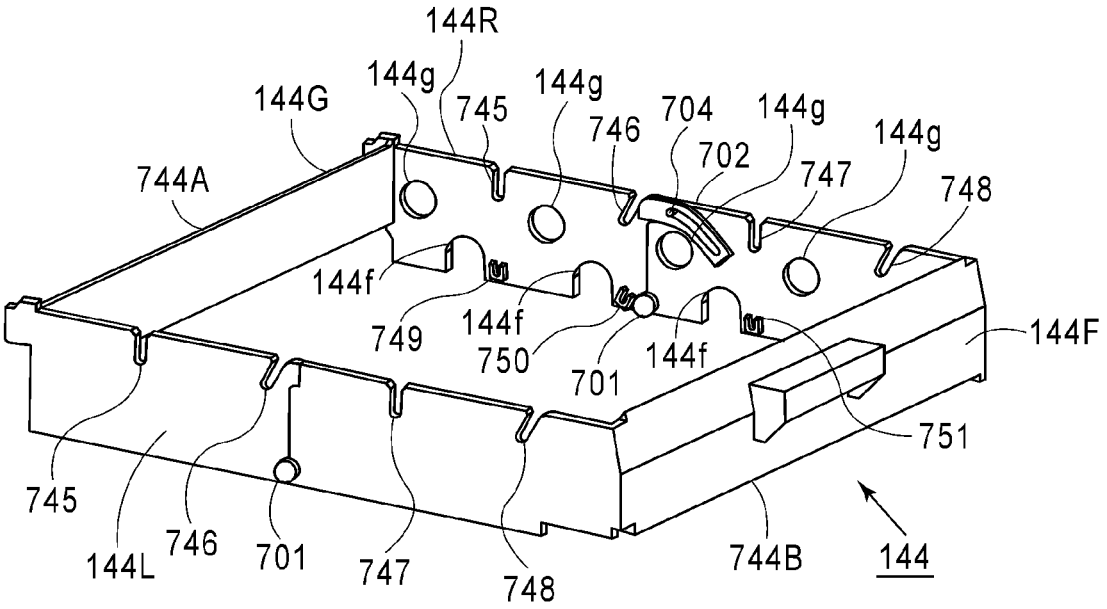
FIG. 50 is a perspective view of an outer appearance of the cartridge tray.
Figure 51:
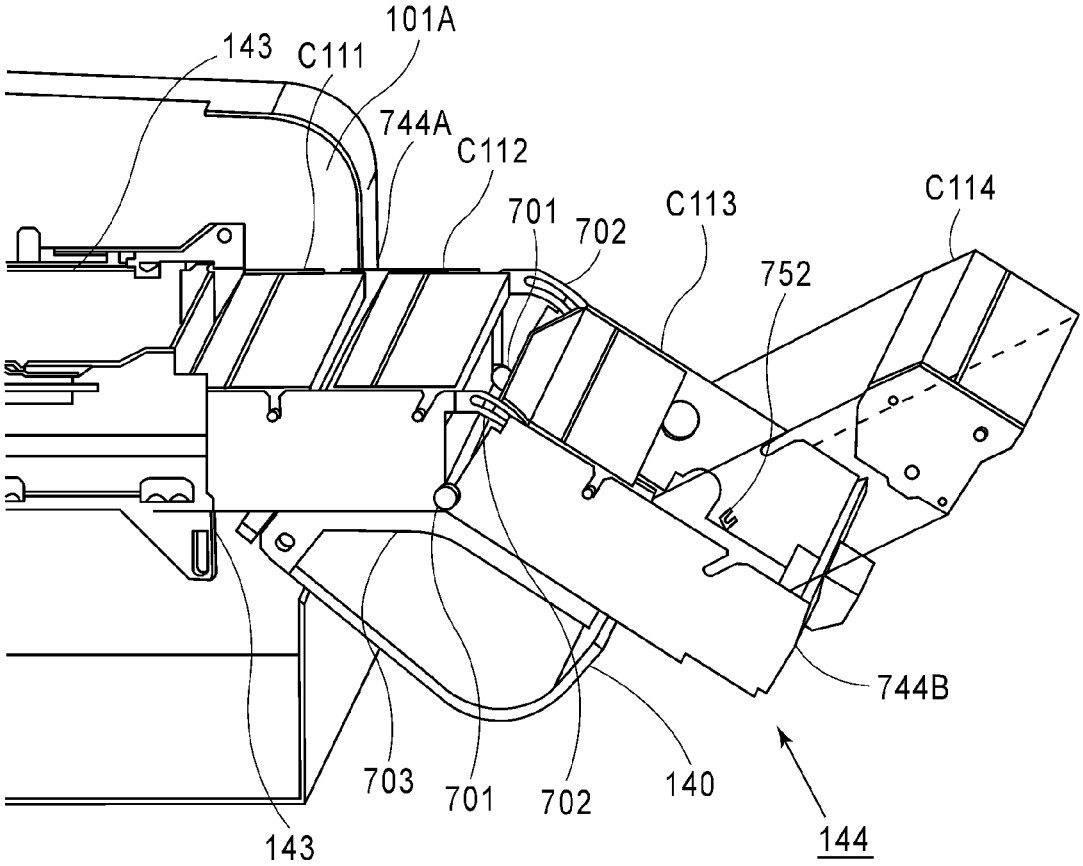
FIG. 51 is a perspective view of an outer appearance of the cartridge tray during mounting and dismounting of a cartridge.
Figure 52:
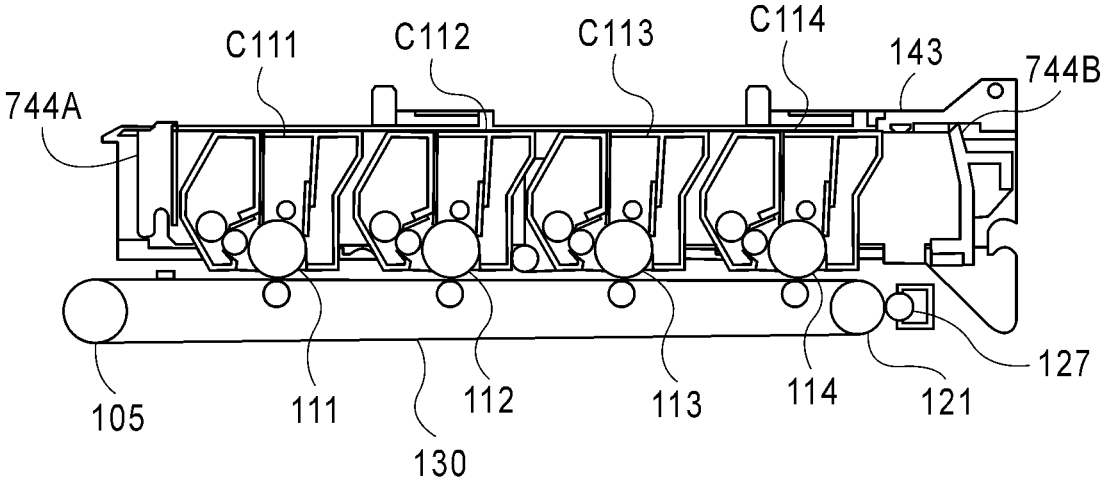
FIG. 52 is a schematic sectional view of the cartridge tray at an image forming position.

A structure of the cartridge tray 144 will be described with reference to FIGS. 49-52. FIG. 50 is a perspective view of an outer appearance of the cartridge tray 144. FIG. 51 is a perspective view of an outer appearance of the cartridge tray 144 at an outside position after pulling-out of the cartridge tray 144. In FIG. 52 is a perspective view of an outer appearance of the cartridge tray 144 at the outside position during insertion of the cartridge tray 144 into the apparatus main assembly 101.

The cartridge tray 144 roughly supports the process cartridges C111, C112, C113 and C114. A right frame portion 144R (driving side) is provided with holes 144*f* and 144*g* through which first and second drive output portions provided in the apparatus main assembly 101 side go in and out of the rear cartridge 744A and the front cartridge tray 744B. Further, the right frame portion 144R is provided with engaging portions 745-748 with which the driving side rotation preventing portions 157R are to be engaged, and is provided with roughly holding portions 749-752 where inner tray positioning portions 159R are to be positioned.

Further, the left frame portion 144L (non-driving side) is provided with the engaging portions 745-748 with which the non-driving side rotation preventing portions 157L are to be engaged, and is provided with the roughly holding portions 749-752 where inner tray positioning portions 159L are to be positioned.

Each of the process cartridges C111, C112, C113 and C114 are inserted into the cartridge tray 144 from a cut-away direction of the associated one of the engaging portions 745-748 in a drop-in manner. When the process cartridge C is gradually inserted, the driving side rotation preventing portion 157R and the non-driving side rotation preventing portion 157L are gradually engaged with the engaging portions 745-748 in the cartridge tray 144 side (FIG. 51).

The engaging portions 745-748 will be described specifically. The engaging portions 745-748 are different in shape every 2 stations.

First, the front cartridge tray 744B will be described. The engaging portion 748 corresponding to the process cartridge C114 is provided with an inclined I-shaped groove. This is because the mounting and dismounting of the cartridge C114 does not overlap with the cartridge C113, and for this reason the I-shaped groove is inclined. The engaging portion 747 corresponding to the process cartridge C113 is provided with an upward I-shaped groove. During mounting and dismounting of the C113, there is no portion overlapping with the cartridge C113 with respect to a right (directly) above direction (perpendicular to the front cartridge tray 744B), and therefore the cartridge tray C113 is mounted and dismounted in the right above direction.

Next, the rear cartridge tray 744A will be described. Similarly, also in this case, the engaging portion 746 corresponding to the process cartridge C112 is required to be inclined so that the mounting and dismounting of the cartridge C112 does not overlap with the cartridge C111. Therefore, the engaging portion 746 is provided with an inclined I-shaped groove. The engaging portion 745 corresponding to the process cartridge C111 is provided with an I-shape groove extending in the right above direction since there is no obstructing material with respect to the right above direction.

The four cut-away portions are formed in the shapes described above, so that when the cartridge tray 144 is moved to the mounting and dismounting position to be divided into the front cartridge tray 744B and the rear cartridge tray 744A, the adjacent process cartridge does not overlap with the associated process cartridge with respect to the mounting and dismounting direction.

As a result, the process cartridges can be dismounted upward in an arbitrary order, so that a smooth mounting and dismounting operation is realized. Incidentally, the shapes of each of the engaging portions 745-748 are the substantially same between the driving side and the non-driving side.

When the cartridge tray 144 is moved to the accommodating portion of the apparatus main assembly 101, a movement locus is set by the bending portion 701 and the link mechanism 702 which are provided in the cartridge tray and by the link rail 703 provided in the main assembly side and the tray holding member 143 in the main assembly. The link mechanism 702 and the link rail 703 will be described specifically.

First, the link mechanism 702 is fixed to the rear cartridge tray 744A, and is provided with a groove cut away so as to follow along a rotation locus of a link positioning portion 704 projected from the front cartridge tray 744B. This groove of the link mechanism 702 is engaged with the link positioning portion 704. By this engagement, when a user applies a force in the horizontal direction for pushing the cartridge tray 144 into the main assembly, the cartridge tray 144 is rotated about the bending portion 701 from a bent state to a linear state, and then is accommodated in the main assembly.

Next, the link rail 703 will be described. The link rail 703 comes to an outside portion of the main assembly in interrelation with opening and closing of the cartridge door 140 in the main assembly side. Further, the link rail 703 coming to the outside portion of the main assembly supports the cartridge tray 144 which is pulled out to the outside portion of the main assembly and which is bent.

By the link mechanism 702 and the link rail 703 described above, strength and usability of the cartridge tray 144 at the main assembly outside portion are ensured.

Further, when the cartridge tray 144 is mounted in the accommodating portion of the apparatus main assembly 101 and then the cartridge door 140 is closed, in interrelation with closing rotation of the door 140, the tray holding member 143 is lowered, so that the photosensitive drums of the cartridges contact the intermediary transfer belt 130. At this time, each of the cartridges C111-C114 overlaps with the adjacent cartridge with respect to a direction perpendicular to the intermediary transfer belt 130, so that it becomes possible to compatibly realize minimization of a distance between adjacent drum nips and effective utilization of a space in the tray.

As described above, when the cartridge tray 144 is pulled out, the cartridge tray 144 is divided, the process cartridge can be pulled out (dismounted) upward in an arbitrary direction and thus usability is improved. Further, during the mounting of the cartridges into the apparatus main assembly 101, the pitch between the photosensitive drums is narrowed (decreased), and therefore FPOT can be shortened.

Further, in Embodiment 7, although the description is made based on an ITB (intermediary transfer belt) type using the intermediary transfer belt, also in an image forming apparatus of an ETB (electrostatic transfer belt) type using an electrostatic conveying belt (FIG. 12), a similar effect can be obtained by employing a similar constitution.

<Embodiment 8>

Embodiment 8 of the present invention will be described with reference to FIGS. 53-58. An image forming apparatus 100 in this embodiment is similar to the image forming apparatus 100 in Embodiment 1, and constituent elements similar to those in Embodiment 1 will be omitted from description by adding the same reference numerals or symbols.

(Structure of Cartridge Tray)

Figure 53:
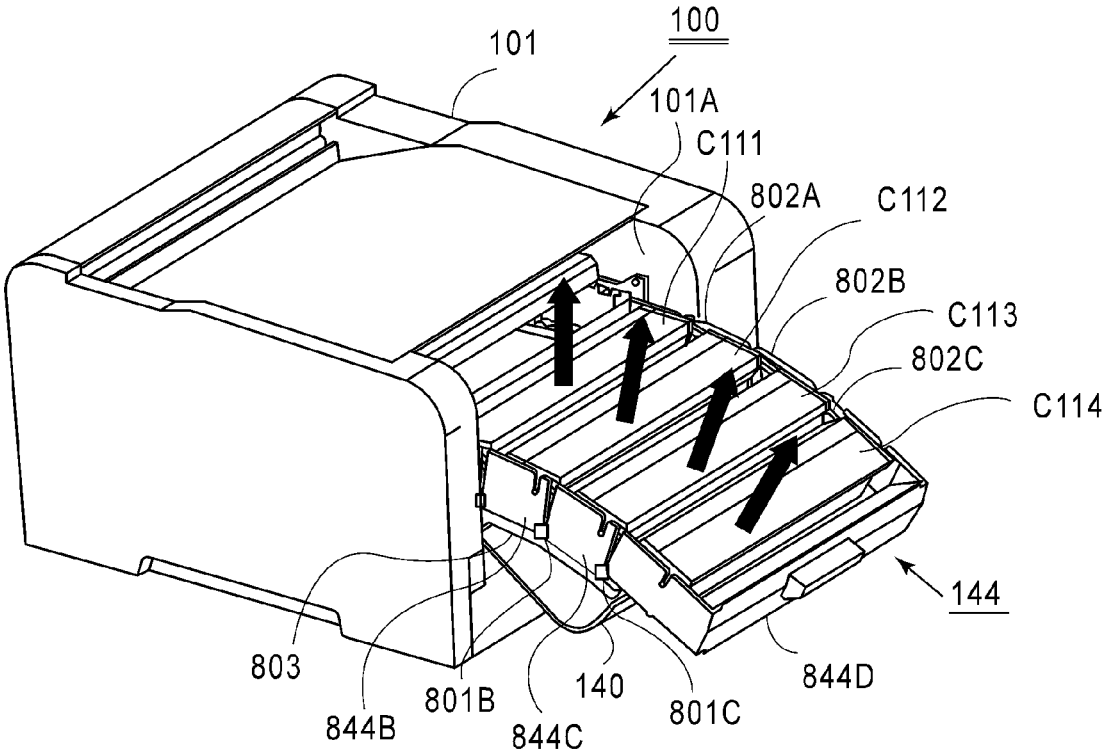
FIG. 53 is a perspective view of an outer appearance of an image forming apparatus in Embodiment 8 in a state in which a cartridge tray is pulled out.
Figure 54:
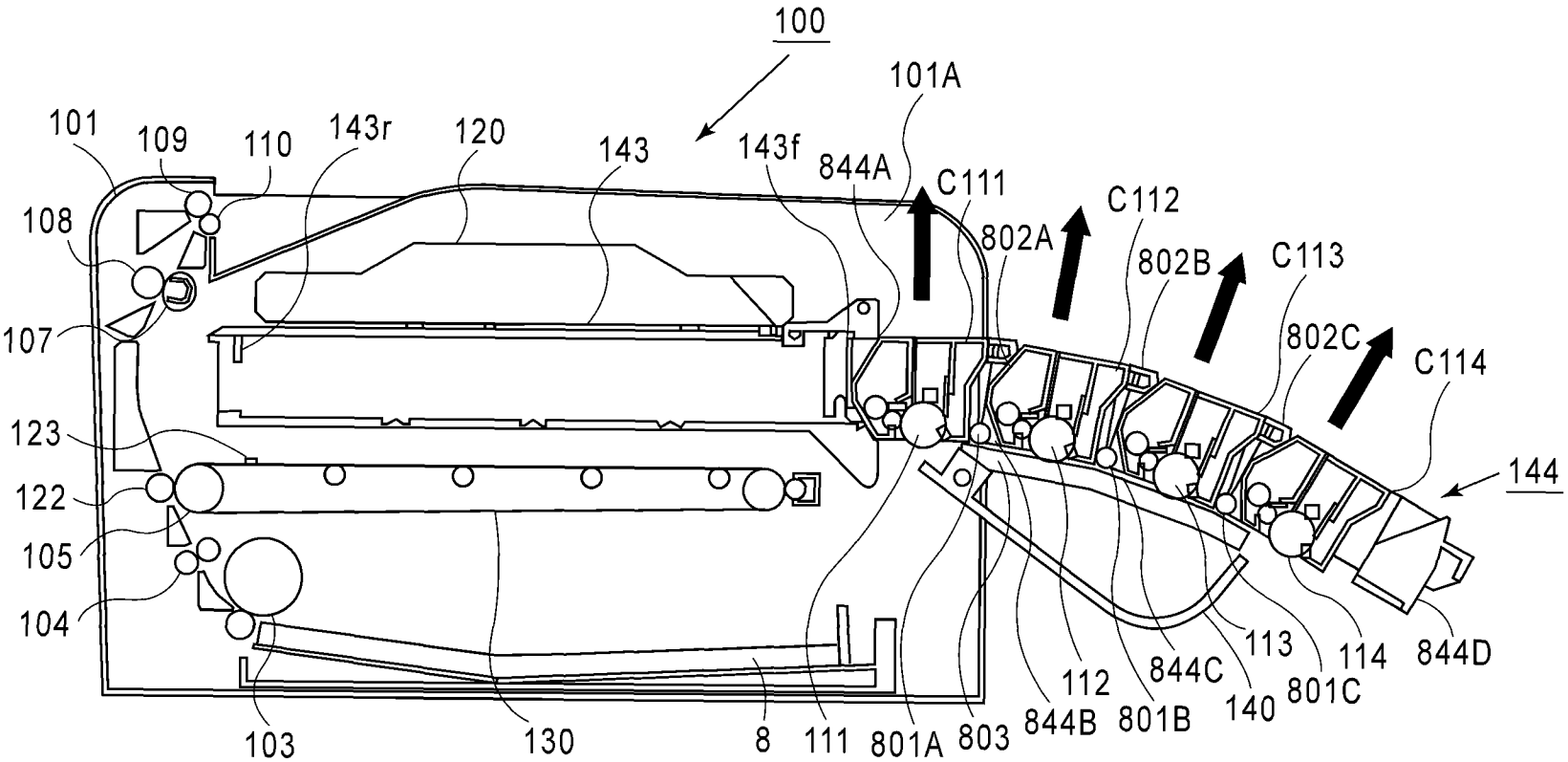
FIG. 54 is a longitudinal schematic side view of the image forming apparatus in the state in which the cartridge tray is pulled out.

An outline of a structure of the cartridge tray 144 will be described with reference to FIGS. 53-56. FIG. 53 is a perspective view of an outer appearance of the image forming apparatus 100 in a state in which the cartridge tray 144 is pulled out from the apparatus main assembly 101, as the cartridge door 140 is open, to the outside position through the opening 101A. FIG. 54 is a longitudinal schematic side view of the image forming apparatus 100 in the state.

Figure 55:
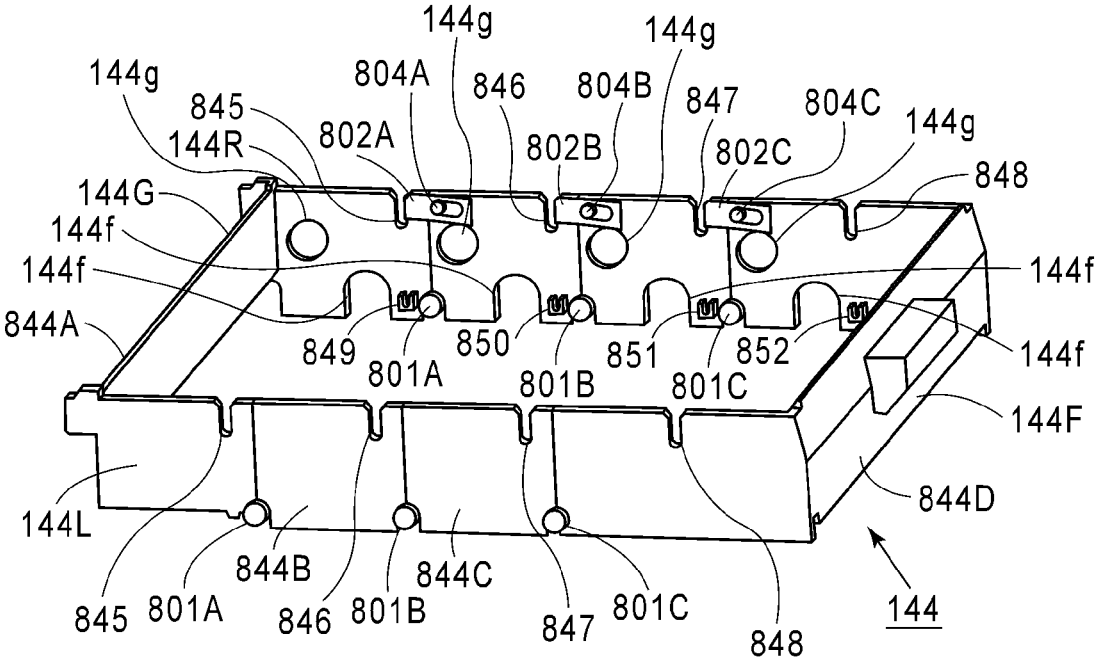
FIG. 55 is a perspective view of an outer appearance of the cartridge tray.
Figure 56:
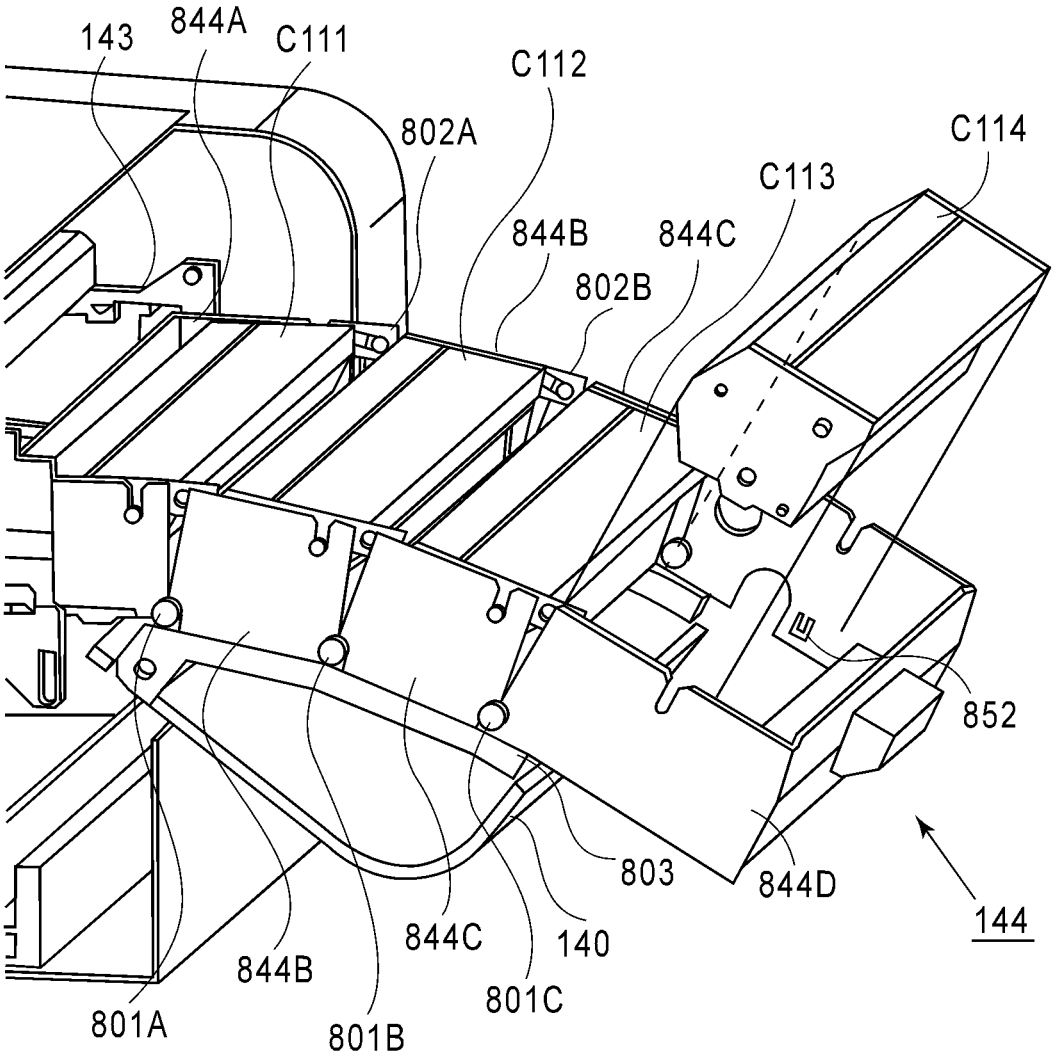
FIG. 56 is a perspective view of an outer appearance of the cartridge tray during mounting and dismounting of a cartridge.

FIG. 55 is a perspective view of an outer appearance of the cartridge tray 144. FIG. 56 is a perspective view of an outer appearance of the cartridge tray 144 at an outside position after pulling-out of the cartridge tray 144.

The cartridge tray 144 includes a first cartridge tray 844A, a second cartridge tray 844B, a third cartridge tray 844C and a fourth cartridge tray 844D.

These four cartridge trays roughly support the process cartridges C111, C112, C113 and C114. A right frame portion 144R (driving side) of each of the four cartridge trays is provided with holes 144*f* and 144*g* through which first and second drive output portions provided in the apparatus main assembly 101 side go in and out of the cartridge tray 144. Further, the right frame portion 144R is provided with engaging portions 845-848 with which the driving side rotation preventing portions 157R are to be engaged, and is provided with rotation center shaft roughly holding portions 849-852 where inner tray positioning portion 159R are to be positioned.

Further, the left frame portion 144L (non-driving side) of each of the four cartridge trays is provided with the engaging portions 845-848 with which the non-driving side rotation preventing portions 157L are to be engaged, and is provided with the roughly holding portions 849-852 where inner tray positioning portions 159L are to be positioned.

Each of the process cartridges C111, C112, C113 and C114 are inserted into the cartridge tray 144 from a cut-away direction of the associated one of the engaging portions 845-848 in a drop-in manner. When the process cartridge C is gradually inserted, the driving side rotation preventing portion 157R and the non-driving side rotation preventing portion 157L are gradually engaged with the engaging portions 845-848 in the cartridge tray 144 side (FIG. 56).

The engaging portions 845-848 will be described specifically.

The engaging portions 845-848 corresponding to process cartridge C111-C114 are identical in shape and are provided with an I-shape groove extending in the right above direction. The process cartridges C111-C114 are mounted and dismounted with respect to a direction parallel to the grooves (i.e., the direction perpendicular to the inclined cartridge trays).

When the cartridge tray 144 is moved to the mounting and dismounting position to be divided into the four (first to fourth) cartridges 844A-844D, the mounting and dismounting direction of each of the cartridges is set so as not to overlap with the adjacent process cartridge. As a result, a smooth mounting and dismounting operation in the upward direction is realized. Incidentally, the shapes of each of the engaging portions 845-848 are the substantially same between the driving side and the non-driving side.

When the cartridge tray 144 is moved to the accommodating portion of the apparatus main assembly 101, a movement locus is set by bending portions 801A-801C and link mechanisms 802A-802C which are provided in the cartridge tray and by the link rail 803 provided in the main assembly side and the tray holding member 143 in the main assembly.

The link mechanisms 802A-802C and the link rail 803 will be described specifically. First, the link mechanisms 802A and 802B will be described. The link mechanism 802A is fixed to the first cartridge tray 844A, and is provided with a groove cut away so as to follow along a rotation locus of a link positioning portion 804A projected from the second cartridge tray 844B. This link positioning portion 804A is engaged with the grove of the link mechanism 802A.

The link mechanism 802B is fixed to the second cartridge tray 844B, and is provided with a groove cut away so as to follow along a rotation locus of a link positioning portion 804B projected from the third cartridge tray 844C. This link positioning portion 804B is engaged with the grove of the link mechanism 802B.

The link mechanism 802C is fixed to the third cartridge tray 844C, and is provided with a groove cut away so as to follow along a rotation locus of a link positioning portion 804C projected from the fourth cartridge tray 844D. This link positioning portion 804C is engaged with the grove of the link mechanism 802C.

By these engagements, when a user applies a force in the horizontal direction for pushing the cartridge tray 144 into the main assembly, the cartridge tray 144 is rotated about the bending portions 801A-801C from a bent state to a linear state, and then is accommodated in the main assembly.

Next, the link rail 803 will be described. The link rail 803 comes to an outside portion of the main assembly in interrelation with opening and closing of the cartridge door 140 in the main assembly side. Further, the link rail 803 coming to the outside portion of the main assembly supports the cartridge trays 844A-844D which are pulled out to the outside portion of the main assembly and which is bent.

By the link mechanisms 802A-802C and the link rail 803 described above, strength and usability of the cartridge tray 144 at the main assembly outside portion are ensured.

Further, when the cartridge tray 144 is mounted in the accommodating portion of the apparatus main assembly 101 and then the cartridge door 140 is closed, the tray holding member 143 is lowered, so that the photosensitive drums of the cartridges contact the intermediary transfer belt 130. At this time, each of the cartridges C111-C114 overlaps with the adjacent cartridge with respect to a direction perpendicular to the intermediary transfer belt 130, so that it becomes possible to compatibly realize minimization of a distance between adjacent drum nips and effective utilization of a space in the tray.

Incidentally, in this embodiment, description was made based on arrangement such that the drum unit 151 of the process cartridge and the developing unit 156 of the adjacent process cartridge overlap with each other with respect to the up-down direction as the mounting and dismounting direction of the cartridge C relative to the apparatus main assembly. However, when attention is paid only improvement of usability, an effect can be obtained even in arrangement such that the adjacent process cartridges do not overlap with each other.

Figure 57:
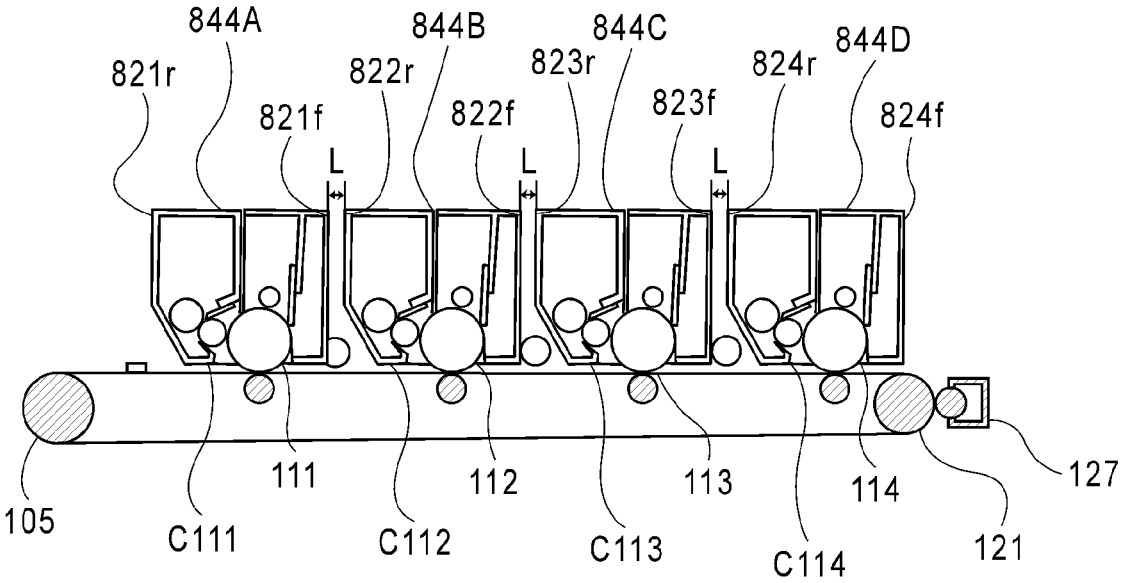
FIG. 57 is a schematic sectional view of an image forming apparatus, at an image forming position, having another structure in Embodiment 8.
Figure 58:
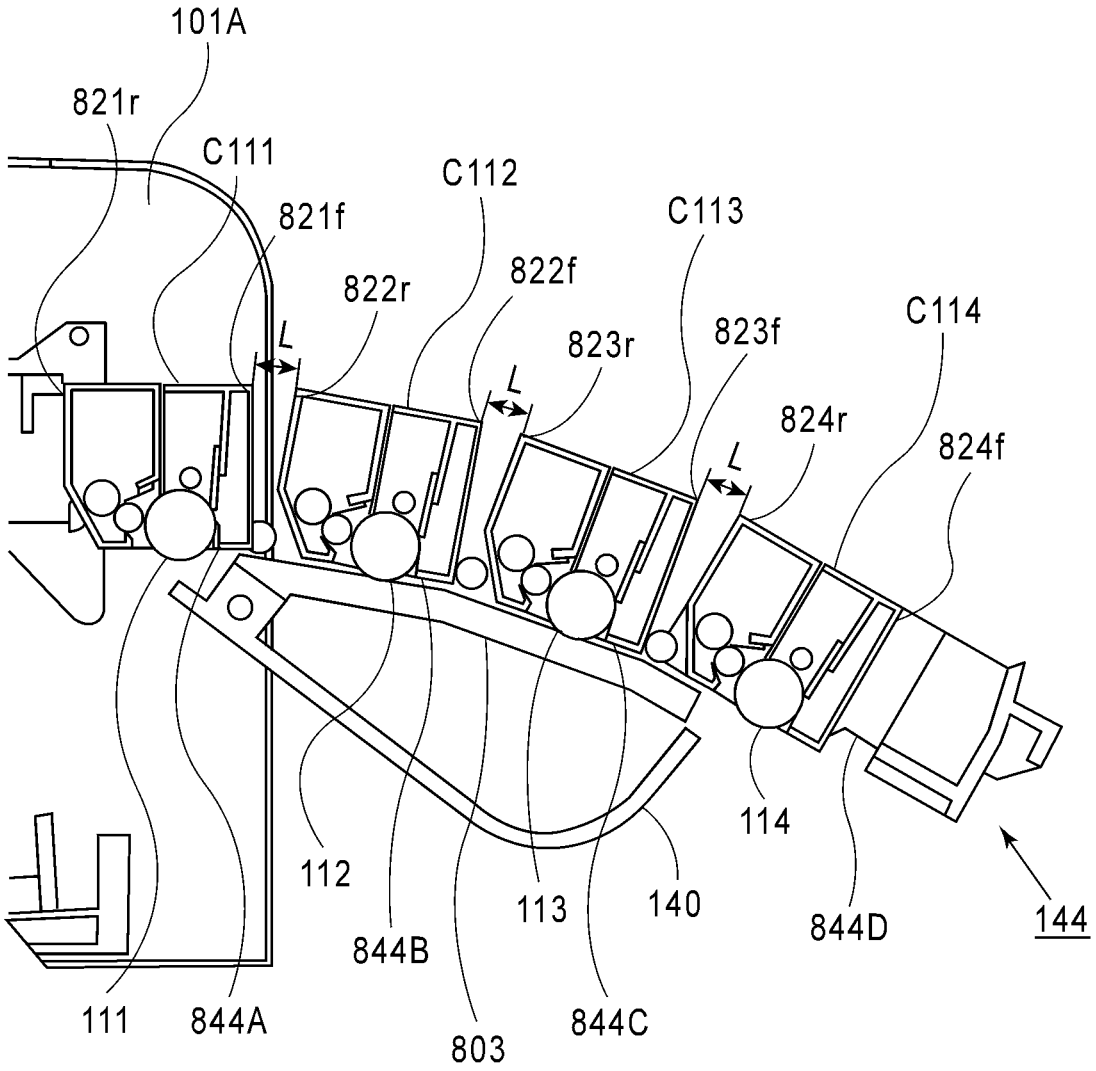
FIG. 58 is a schematic sectional view of the image forming apparatus in a state in which a cartridge tray is pulled out.

FIG. 57 is a sectional view of the image forming apparatus 100 during image formation in which the adjacent process cartridges do not overlap with each other with respect to the up-down direction. FIG. 58 is a partial sectional view of the image forming apparatus 100 in a state in which the tray 144 of FIG. 57 is pulled out from the inside position to the outside position.

An upper end distance L between the adjacent cartridges at the position relative to the image forming apparatus is increased, so that both upper end portions (front cartridge end portions 821*f*-824*f* and rear cartridge end portions 821*r*-824*r*) are easily held.

As a result, without providing recesses for holding the cartridges at the both upper end portions of the cartridges, usability is improved while ensuring a space for parts necessary to the process cartridges and a volume of the developer.

In this way, the cartridge tray 144 is divided when the cartridge tray 144 is pulled out, so that it is possible to ensure the mounting locus without causing mutual interference between the adjacent process cartridges during the mounting and dismounting of the process cartridge. As a result, the process cartridges can be pulled out (dismounted) upward in an arbitrary direction, and thus usability is improved. Further, during the mounting of the cartridges into the apparatus main assembly, the pitch between the photosensitive drums is narrowed (decreased), and therefore FPOT can be shortened.

Further, in Embodiment 8, although the description is made based on an ITB (intermediary transfer belt) type using the intermediary transfer belt, also in an image forming apparatus of an ETB (electrostatic transfer belt) type using an electrostatic conveying belt (FIG. 12), a similar effect can be obtained by employing a similar constitution.

<Summarization>

The structures of the image forming apparatuses in Embodiments 1 to 8 are summarized as follows.

(1) Embodiments 1-8

The image forming apparatus 100 is capable of forming the color image on the recording material 8. The image forming apparatus 100 includes the opening 101A provided in the apparatus main assembly 101 thereof and includes the movable members 144 (244, 344, 444, 544, 644).

Each of the movable members supports the plurality of the cartridges in the arranged state, and is movable in the arranging direction of the cartridges. Further, the movable member moves through the opening between the inside position where the plurality of the cartridges are positioned inside the apparatus main assembly and the outside position where the plurality of the cartridges are detachably mountable in the arranging direction and the direction crossing the longitudinal direction.

By the movement of the movable member from the inside position to the outside position, the cartridge is moved relative to the movable member so as not to interfere with the adjacent cartridge thereof when the cartridge is dismounted from the movable member.

By the movement of the movable member from the inside position to the outside position, the movable member supports the plurality of the cartridges so that the interval (distance) between at least one pair of adjacent cartridges is increased with respect to the arranging direction.

(2) Embodiments 1 and 4-6

The movable members include the first guiding portions (146*c*-147*c*, 148*b*), the second guiding portions (145*c*-147*c*) and the engaging members (161, 461, 561, 661).

Each of the first guiding portions is engageable with one of the pair of adjacent cartridges. Each of the second guiding portions is engageable with the other cartridge and is capable of guiding the other cartridge so that the other cartridge is movable in the arranging direction in a distance larger than the first guiding portion.

Each of the engaging members is engageable with at least the other cartridge and is provided movably on the movable member so that the other cartridge is moved along the second guiding portion by the movement of the movable member from the inside position to the outside position.

(3) Embodiment 1

The second guiding portions (145*c*-147*c*) are positioned upstream of the first guiding portions (146*c*-147*c*, 148*b*) with respect to the pulling-out direction of the movable member and has the rectilinear shape extending in the arranging direction.

(4) Embodiment 1

The second guiding portions are connected with the guiding portions (145*a*-148*a*) for mounting and dismounting the other cartridge, in the upstream side of the pulling-out direction, relative to the movable member in the direction crossing the arranging direction.

(5) Embodiments 4-6

Each of the second guiding portions is positioned downstream of the associated first guiding portion with respect to the pulling-out direction of the movable member, and has the arcuate shape extending in the arranging direction.

(6) Embodiments 4-6

The second guiding portions are connected with the third guiding portions (445*a*-448*a*, 545*a*-548*a*, 645*a*-648*a*) each for mounting and dismounting the other cartridge relative to the movable member with respect to the direction crossing the arranging direction.

(7) Embodiments 2-3 and 7-8

The movable members include the first mounting portions (344(1), 744A, 844A, etc.) each for supporting one of the pair of adjacent cartridges and the second mounting portions (344(2), 744B, 844B, etc.) each for supporting the other cartridge. Further, by the movement of each of the movable members from the inside position to the outside position, the distance between the first mounting portion and the second mounting portion is constituted so as to be increased.

(8) Embodiments 2-3 and 7-8

Each of the second mounting portions is constituted so as to be slid and moved relative to the associated first mounting portion.

(9) Embodiments 7-8

The second mounting portion is constituted so as to be rotationally moved relative to the first mounting portion.

(10) Embodiments 3 and 7

Further, to the movable members, the third cartridges (C111, C114) adjacent to at least one of the pair of adjacent cartridges are detachably mountable at the outside positions. Further, by the movement of each of the movable members from the inside position to the outside position, the associated third cartridge is not moved relative to the other cartridge in the arranging direction.

(11) Embodiments 3 and 7

The movable members include the first guiding portions (346, 347, 745, 747) each for mounting and dismounting the other cartridge relative to the movable member at the outside position and the third guiding portions (345, 348, 745, 748) each, for mounting and dismounting the third cartridge, different in angle from the associated first guiding portion. Further, of the first guiding portion and the third guiding portion, the guiding portion positioned in the downstream side with respect to the pulling-out direction of the movable member forms a small angle with respect to the pulling-out direction.

(12) Embodiments 1-8

Each of the cartridges is the process cartridge including the photosensitive drum and the process means actable n the photosensitive drum, and the arranging direction is the direction crossing the longitudinal direction of the photosensitive drum.

(13) Embodiments 1-8

The increase in distance between the cartridges means the increase in pitch between the photosensitive drums.

<Other Embodiments>

(a) The cartridge C is not limited to the process cartridge of the integral type in which the image bearing member 1, on which the latent image is to be formed, and the developing means 3 for developing the latent image formed on the image bearing member 1 are provided as in the embodiments described above.

The cartridge C may also be the process cartridge of the function separation type in which the image bearing member 1, on which the latent image is to be formed, and the image forming process means other than the developing means for developing the latent image formed on the image bearing member 1 are provided.

The cartridge C may also be the developing cartridge in which the developing means 3 for developing the latent image formed on the image bearing member 1 for forming the latent image and the developer accommodating portion in which the developer used for developing the latent image is accommodated are provided.

The cartridge C may include other units, such as the developer cartridge in which the developer is accommodated, which are detachably mounted to the apparatus main assembly 101 and which contribute to the image forming process for forming the image on the recording material.

The cartridge C may also be a combination of the above-described process cartridge of the function separation type with the above-described developing cartridge.

(b) The constitution of the image forming apparatus in which the image bearing member 1 on which the latent image is to be formed is fixedly mounted in the apparatus main assembly 101 or the movable member 144 and in which the cartridge C is the image forming process means actable on the image bearing member 1 may also be employed.

(c) The image forming process of the image forming apparatus is not limited to the electrophotographic process using the electrophotographic photosensitive member as the image bearing member, but may also be the electrostatic recording process using the electrostatic recording dielectric member as the image bearing member and the magnetic recording process using the magnetic recording (magnetic) material as the image bearing member.

(d) It is also possible to constitute image forming apparatuses obtained by appropriately and selectively combining constituent elements of the image forming apparatuses of Embodiments 1 to 8.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 170302/2013 filed Aug. 20, 2013, which is hereby incorporated by reference.

What is claimed is:

1. An image forming apparatus capable of forming a color image on a recording material, comprising:

an opening provided in a main assembly of said image forming apparatus;

an openable member for opening and closing said opening; and a movable member, supporting a plurality of cartridges in a state in which the cartridges are arranged in an arranging direction, movable in the arranging direction while passing through said opening between an inside position where the cartridges are positioned inside the main assembly and an outside position where the cartridges are detachably mountable, wherein when said movable member is in the outside position outside the main assembly, the cartridges are detachable in a direction crossing the arranging direction and a longitudinal direction of each of the cartridges, wherein when said movable member is positioned at the inside position, two adjacent cartridges of the cartridges are in an overlapping state as seen in a direction perpendicular to the arranging direction and the longitudinal direction, and wherein the two adjacent cartridges are moved relative to said movable member by movement of said movable member from the inside position to the outside position so that one of the two adjacent cartridges is prevented from interfering with the other cartridge when the one of the two adjacent cartridges is dismounted from said movable member.

2. An image forming apparatus according to claim 1, wherein said movable member is moved from the inside position to the outside position so that an interval between at least one pair of adjacent cartridges is increased with respect to the arranging direction.

3. An image forming apparatus according to claim 2, wherein said movable member includes:

a first guiding portion engageable with one of the pair of adjacent cartridges;

a second engageable with the other cartridge and capable of guiding the other cartridge movably in the arranging direction in an amount more than an amount by said first guiding portion; and an engaging member engageable with at least the other cartridge and provided movably relative to said movable member so as to move the other cartridge along said second guiding portion by movement of said movable member from the inside position to the outside position.

4. An image forming apparatus according to claim 3, wherein said second guiding portion is positioned upstream of said first guiding portion with respect to a pulling-out direction of said movable member and has a rectilinear shape extending in the arranging direction.

5. An image forming apparatus according to claim 4, wherein said second guiding portion is connected with a third guiding portion, in an upstream side with respect to the pulling-out direction, for mounting and dismounting the other cartridge relative to the movable member with respect to the direction crossing the arranging direction.

6. An image forming apparatus according to claim 3, wherein said second guiding portion is positioned downstream of said first guiding portion with respect to a pulling-out direction of said movable member and has an arcuate shape extending in the arranging direction.

7. An image forming apparatus according to claim 6, wherein said second guiding portion is connected with a third guiding portion for mounting and dismounting the other cartridge relative to the movable member with respect to the direction crossing the arranging direction.

8. An image forming apparatus according to claim 2, wherein said movable member includes a first mounting portion for supporting the one of the pair of adjacent cartridges and a second mounting portion for supporting the other cartridge, and wherein said movable member is moved from the inside position to the outside position so that an interval between said first and second mounting portions is increased with respect to the arranging direction.

9. An image forming apparatus according to claim 8, wherein said second mounting portion is slidably movable relative to said first mounting portion.

10. An image forming apparatus according to claim 8, wherein said second mounting portion is rotatably movable relative to said first mounting portion.

11. An image forming apparatus according to claim 8, wherein a third cartridge adjacent to at least one of the pair of adjacent cartridges is detachably mountable to said movable member at the outside position, and is immovable relative to said at least one of the pair of adjacent cartridges in the arranging direction by movement of said movable member from the inside position to the outside position.

12. An image forming apparatus according to claim 11, wherein said movable member includes a first guiding portion for mounting and dismounting one of the adjacent cartridges relative to said movable member at the outside position and a second guiding portion, angled in direction from said first guiding portion, for mounting and dismounting said third cartridge relative to said movable member at the outside position, and wherein of said first and second guiding portions, a portion positioned downstream with respect to a pulling-out direction of said movable member forms a small angle with respect to the pulling-out direction.

13. An image forming apparatus according to claim 1, wherein each of the cartridges is a process cartridge of an integral type including an image bearing member for forming a latent image and developing means for developing, with a developer, the latent image formed on the image bearing member.

14. An image forming apparatus according to claim 1, wherein each of the cartridges is a process cartridge of a separation type including an image bearing member for forming a latent image and image forming process means other than developing means for developing, with a developer, the latent image formed on the image bearing member.

15. An image forming apparatus according to claim 1, wherein each of the cartridges is a developing cartridge including developing means for developing, with a developer, a latent image formed on an image bearing member and a developer accommodating portion for accommodating the developer used for developing the latent image.

16. An image forming apparatus according to claim 1, wherein the cartridges include a combination of a process cartridge of a separation type including an image bearing member for forming a latent image and image forming process means other than developing means for developing, with a developer, the latent image formed on the image bearing member, and a developing cartridge including developing means for developing, with a developer, a latent image formed on an image bearing member and a developer accommodating portion for accommodating the developer used for developing the latent image.

17. An image forming apparatus according to claim 1, wherein an image bearing member for forming a latent image is fixedly mounted to the main assembly or said movable member, and wherein each of the cartridges is image forming process means actable on the image bearing member.

18. An image forming apparatus according to claim 13, wherein the image bearing member is an electrophotographic photosensitive member.

19. An image forming apparatus according to claim 1, wherein each of the cartridges is a process cartridge including a photosensitive drum and process means actable on the photosensitive drum, and wherein the arranging direction is a direction crossing a longitudinal direction of the photosensitive drum.

20. An image forming apparatus according to claim 19, wherein an interval between the adjacent two cartridges is a pitch between adjacent two photosensitive drums, and wherein the pitch is increased with respect to the arranging direction by movement of said movable member from the inside position to the outside position.

21. An image forming apparatus capable of forming a color image on a recording material, comprising:

an opening provided in a main assembly of said image forming apparatus;

an openable member for opening and closing said opening; and a movable member, supporting a plurality of cartridges in a state in which the cartridges are arranged in an arranging direction, movable in the arranging direction while passing through said opening between an inside position where the cartridges are positioned inside the main assembly and an outside position where the cartridges are detachably mountable, in a direction crossing the arranging direction and a longitudinal direction of each of the cartridges, at a position outside the main assembly, wherein when said movable member is moved from the inside position to the outside position so as to increase an interval between at least one pair of adjacent with respect to the arranging direction, and then one of the adjacent cartridges is dismounted from said movable member, the one of the adjacent cartridges is prevented from interfering with the other cartridge.

22. An image forming apparatus according to claim 21, wherein said movable member includes:

a first guiding portion engageable with one of the pair of adjacent cartridges;

a second engageable with the other cartridge and capable of guiding the other cartridge movably in the arranging direction in an amount more than an amount by said first guiding portion; and an engaging member engageable with at least the other cartridge and provided movably relative to said movable member so as to move the other cartridge along said second guiding portion by movement of said movable member from the inside position to the outside position.

23. An image forming apparatus according to claim 22, wherein said second guiding portion is positioned upstream of said first guiding portion with respect to a pulling-out direction of said movable member and has a rectilinear shape extending in the arranging direction.

24. An image forming apparatus according to claim 23, wherein said second guiding portion is connected with a guiding portion, in an upstream side with respect to the pulling-out direction, for mounting and dismounting the other cartridge relative to the movable member with respect to the direction crossing the arranging direction.

25. An image forming apparatus according to claim 22, wherein said second guiding portion is positioned downstream of said first guiding portion with respect to a pulling-out direction of said movable member and has an arcuate shape extending in the arranging direction.

26. An image forming apparatus according to claim 25, wherein said second guiding portion is connected with a third guiding portion for mounting and dismounting the other cartridge relative to the movable member with respect to the direction crossing the arranging direction.

27. An image forming apparatus according to claim 21, wherein said movable member includes a first mounting portion for supporting the one of the pair of adjacent cartridges and a second mounting portion for supporting the other cartridge, and wherein said movable member is moved from the inside position to the outside position so that an interval between said first and second mounting portions is increased with respect to the arranging direction.

28. An image forming apparatus according to claim 27, wherein said second mounting portion is slidably movable relative to said first mounting portion.

29. An image forming apparatus according to claim 27, wherein said second mounting portion is rotatably movable relative to said first mounting portion.

30. An image forming apparatus according to claim 27, wherein a third cartridge adjacent to at least one of the pair of adjacent cartridges is detachably mountable said movable member at the outside position, and is immovable relative to said at least one of the pair of adjacent cartridges in the arranging direction by movement of said movable member from the inside position to the outside position.

31. An image forming apparatus according to claim 30, wherein said movable member includes a first guiding portion for mounting and dismounting one of the adjacent cartridges relative to said movable member at the outside position and a second guiding portion, angled in direction from said first guiding portion, for mounting and dismounting said third cartridge relative to said movable member at the outside position, and wherein of said first and second guiding portions, a portion positioned downstream with respect to a pulling-out direction of said movable member forms a small angle with respect to the pulling-out direction.

32. An image forming apparatus according to claim 21, wherein each of the cartridges is a process cartridge of an integral type including an image bearing member for forming a latent image and developing means for developing, with a developer, the latent image formed on the image bearing member.

33. An image forming apparatus according to claim 21, wherein each of the cartridges is a process cartridge of a separation type including an image bearing member for forming a latent image and image forming process means other than developing means for developing, with a developer, the latent image formed on the image bearing member.

34. An image forming apparatus according to claim 21, wherein each of the cartridges is a developing cartridge including developing means for developing, with a developer, a latent image formed on an image bearing member and a developer accommodating portion for accommodating the developer used for developing the latent image.

35. An image forming apparatus according to claim 21, wherein the cartridges include a combination of a process cartridge of a separation type including an image bearing member for forming a latent image and image forming process means other than developing means for developing, with a developer, the latent image formed on the image bearing member, and a developing cartridge including developing means for developing, with a developer, a latent image formed on an image bearing member and a developer accommodating portion for accommodating the developer used for developing the latent image.

36. An image forming apparatus according to claim 21, wherein an image bearing member for forming a latent image is fixedly mounted to the main assembly or said movable member, and wherein each of the cartridges is image forming process means actable on the image bearing member.

37. An image forming apparatus according to claim 32, wherein the image bearing member is an electrophotographic photosensitive member.

38. An image forming apparatus according to claim 21, wherein each of the cartridges is a process cartridge including a photosensitive drum and process means actable on the photosensitive drum, and wherein the arranging direction is a direction crossing a longitudinal direction of the photosensitive drum.

39. An image forming apparatus according to claim 38, wherein an interval between the adjacent two cartridges is a pitch between adjacent two photosensitive drums, and wherein the pitch is increased with respect to the arranging direction by movement of said movable member from the inside position to the outside position.

* * * * *